US005813350A

United States Patent [19]

Ochi

[11] Patent Number: 5,813,350

[45] Date of Patent: Sep. 29, 1998

[54] AMUSEMENT RIDE WITH TRACK

[75] Inventor: Yasushi Ochi, Izumisano, Japan

[73] Assignee: Oriental Sangyo, Ltd., Osaka, Japan

[21] Appl. No.: 744,256

[22] Filed: Nov. 5, 1996

[30] Foreign Application Priority Data

Aug. 12, 1996 [JP] Japan ..... 8-231444

[51] Int. Cl.[6] ..... A63G 21/00

[52] U.S. Cl. ..... 104/54

[58] Field of Search ..... 104/53, 54, 55, 104/56, 69, 70, 85

[56] References Cited

U.S. PATENT DOCUMENTS

| | | | |
|---|---|---|---|
| 776,807 | 12/1904 | Shaules | 104/54 |
| 867,506 | 10/1907 | Hermann | 104/54 |
| 3,204,574 | 9/1965 | Frisbie et al. | 104/54 |
| 3,621,602 | 11/1971 | Barcus et al. | 104/54 |
| 5,038,685 | 8/1991 | Yoneda et al. | 104/54 |
| 5,102,133 | 4/1992 | Chilton et al. | 104/54 |
| 5,463,962 | 11/1995 | Gnezdilov . | |
| 5,542,668 | 8/1996 | Casale et al. | 104/54 |

FOREIGN PATENT DOCUMENTS

| | | |
|---|---|---|
| A-7-289738 | 11/1995 | Japan . |
| A-7-289739 | 11/1995 | Japan . |
| A-8-038742 | 2/1996 | Japan . |
| A-8-052276 | 2/1996 | Japan . |
| A-8-052277 | 2/1996 | Japan . |
| A-8-071253 | 3/1996 | Japan . |

*Primary Examiner*—Mark T. Le

*Attorney, Agent, or Firm*—Griffin, Butler, Whisenhunt & Szipl, LLP

[57] ABSTRACT

The present invention relates to amusement rides, such as roller coasters, installed in amusement parks and the like, which are adapted to allow a vehicle to travel on a track. The ride of the invention has an arrangement such that the track has a missing portion where the vehicle is adapted to transfer from the track on one side of the missing portion to the track on the other side. According to the invention, during the movement of the vehicle across the missing portion, passengers may be seized with the fear that the vehicle is off the track and out of control, thus increasing the thrill of the ride.

4 Claims, 50 Drawing Sheets

AMUSEMENT RIDE WITH TRACK

BACKGROUND OF THE INVENTION

1. Field of the Invention

The present invention relates to amusement rides installed in amusement parks, such as roller coasters and the like, and more particularly to an amusement ride wherein a passenger car is adapted to travel on a track.

2. Description of the Background Art

It is generally known that amusement parks offer their clientele a vast range of pleasure rides. Traditionally, roller coasters and the like have been known as rides allowing the passengers to experience sensations of speed and thrills. More recent designs have proposed rides with tracks having loops or spirals for enhancing the sensations of speed and thrills. Such rides have become very popular among people, particularly among younger generations, because of the chance of experiencing extraordinary sensations which are unobtainable in everyday life.

In the above prior-art roller coasters, however, the passenger car is adapted to travel at high speeds thereby exposing the passengers to rapid visual changes or high speed and thus, produces thrilling sensations. Given that the traveling speed of the car is limited to a certain level, the variation of such visual change and impression of speed is limited.

SUMMARY OF THE INVENTION

It is an object of the invention to provide a novel amusement ride wherein the passengers may experience thrilling sensations enhanced by new elements of visual change and unprecedented movement of the passenger car. The amusement ride of the invention comprising a track of a given trajectory and a passenger car for traveling on the track is characterized in that the track has at least one missing portion. In an aspect of the invention, the passenger car travels on the track to jump into the air from a car-releasing side of the track at the missing portion, with a traveling speed and a traveling direction maintained by inertia. Then, via a midair movement path determined by inertia, the car lands on a car-receiving side of the track. In this process, the passengers may experience a mixture of sensations such as a feeling of flying as they are released into the air, fear and an impression of speed. Incidentally, if the missing portion of the track is located in sight of the passengers, they will be seized with fear instinctively feeling that the car is moving free from the control of the track. This provides the passengers with an increased thrill because of an element of illusory danger.

In this case, a guide section for receiving the car moving from the car-releasing side of the track and guiding the same to the car-receiving side of the track may be disposed at the missing portion on the car-receiving side of the track. As guided by the guide section, the car moving across the missing portion can assuredly transfer onto the car-receiving side of the track.

Alternatively, the missing portion may be provided with a transfer mechanism for transferring the passenger car from the car-releasing side of the track onto the car-receiving side of the track. This provides a more assured transfer of the car from the car-releasing side of the track onto the car-receiving side of the track.

In another aspect of the invention, an amusement ride comprises a traveling course closing member of a fragile material disposed in a traveling course of the car along the track. In the ride, the passenger car travels on the track to collide with the traveling course closing member disposed in the traveling course of the car. In this process, the passengers may be seeing the traveling course closing member until the moment at which the car collides with the traveling course closing member, and hence, the passengers may experience the mixed thrill of fear of collision and an impression of the speed of the running car. On the other hand, because of its fragility, the traveling course closing member is readily broken upon receiving the impact of the collision of the car and thus, the car is allowed to continue running on the track.

In yet another aspect of the invention, an amusement ride comprises an obstacle disposed adjacent the track and a drive mechanism for advancing/retreating the obstacle with respect to the traveling course of the car along the track. In the ride, the drive mechanism is actuated to advance the obstacle into the traveling course of the car and to retreat the obstacle from the traveling course when the car passes the point where the obstacle is disposed. Thus, the passengers, seeing the obstacle in the traveling course of the car, may experience the mixed thrill of fear of collision with the obstacle and an impression of speed of the running car.

In still another aspect of the invention, an amusement ride comprises a passenger car having a seating section movably mounted to a car body and a drive mechanism for vertically moving the seating section. In the ride, the drive mechanism is actuated to elevate or lower the seating section while the car is running whereby the passengers are subject to a vertical movement in addition to forward movement. This provides an unprecedented sensation, thus offering an enhanced element of amusement.

In another aspect of the invention, an amusement ride comprises the track including a first track and a second track laid along the first track, the second track having a waved trajectory with respect to the first track, and the passenger car having front wheels thereof engaged with the first track and rear wheels thereof engaged with the second track. In the ride, the car travels with the front wheels and rear wheels engaged with the first track and second track, respectively. At a portion where the second track is waved, the rear wheels of the car moves along the waved trajectory and therefore, the car proceeds with the rear wheels vertically swung about the front wheel portion. Thus, the passengers are subject to a vertical movement at a smaller pitch than the prior art in addition to a forward movement. This provides unprecedented sensations, thus offering an enhanced element of amusement.

In still another aspect of the invention, an amusement ride comprises a track including a first track portion and a second track portion laid on an extension line of the first track, the passenger car including a first car for traveling on the first track and a second car resting on the first car, a halting mechanism interposed between the first and second tracks for halting the movement of the first car, a locking mechanism for prohibiting the second car from moving back and forth, and a releasing mechanism provided at the first car and adapted to contact the halting mechanism for releasing the locking mechanism thereby allowing the forward movement of the second car. According to the ride, the second car accommodating the passengers therein is mounted on the first car and is prohibited by the locking mechanism from moving back and forth. In this state, the first car carrying the second car thereon travels on the first track. Then, the first and second cars reach the halting mechanism where the first car collides with the halting mechanism to be halted whereas the second car is released forward by inertia from the first car because the releasing mechanism is actuated to release the locking mechanism thereby allowing the forward movement of the second car. Thus, the second car transfers onto the second track laid on the extension line of the first track, to travel on the second track. This provides the mixed thrill of a fear of collision of the first car against the halting mechanism and a feeling of speed. This also offers an unprecedented, extraordinary ride with an enhanced element of amusement wherein the second car accommodating the passengers is transferred from the first track to the second track.

DESCRIPTION OF THE PREFERRED EMBODIMENTS

With reference to FIGS. 1 through 5, description will be given of a first embodiment of the present invention.

Figure 1:
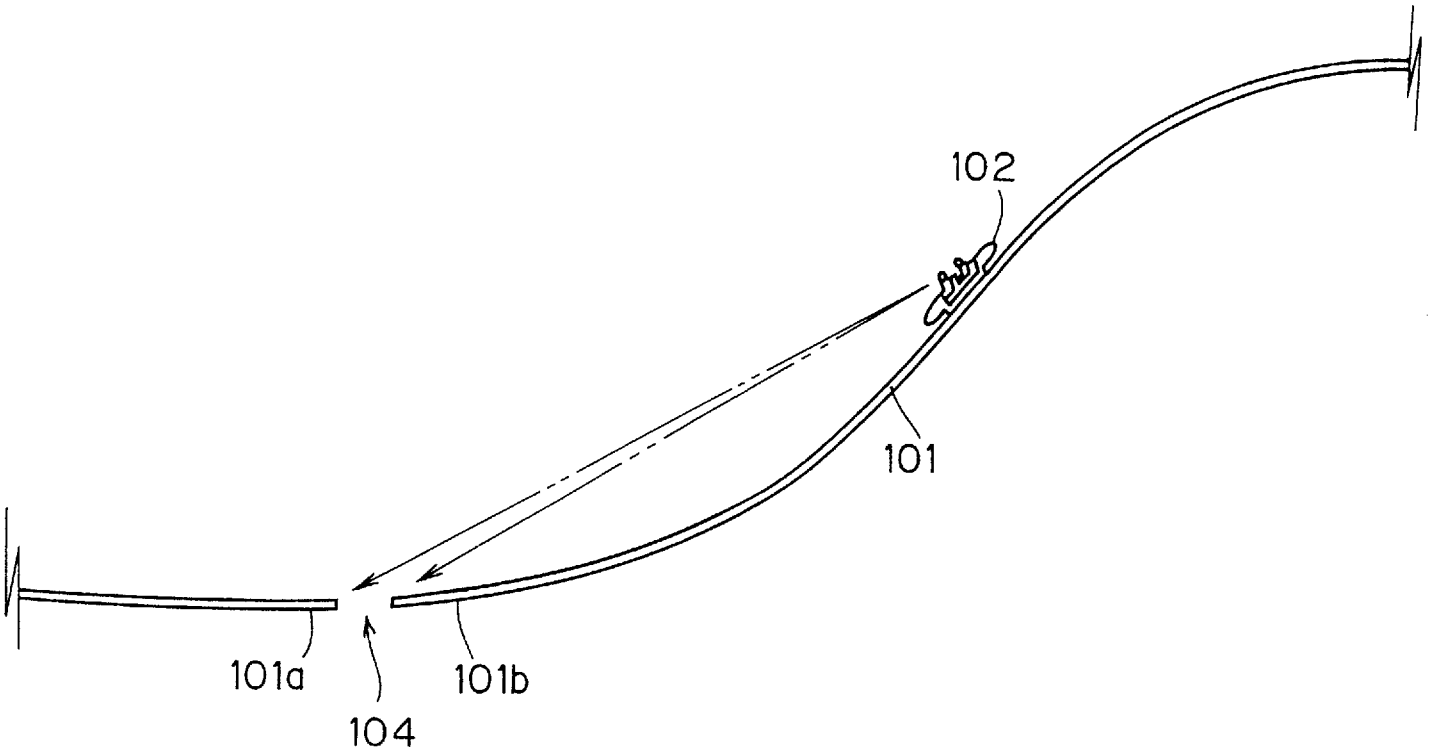
FIG.1 schematically illustrates an amusement ride according to a first embodiment of the invention as a preferred example thereof.

As shown in FIG.1, the amusement ride of the invention generally comprises a track 101 formed of rails, a part of which is shown in the figure, and a passenger car 102 for traveling on the track 101, the track having at least one missing portion. The provision of the missing portion 104 is not limited to one place and the location thereof is not particularly specified. Accordingly, the missing portion 104 may be disposed at a peak or crest of a waved portion of the track 101 but in this embodiment, the missing portion 104 is disposed at a bottom of trough of the waved portion of the track 101, that is, a place where the passengers seated in the passenger car 102 may see the missing portion 104 while they are riding in the car from section 101*b* to section 101*a* of track 101.

Figure 2:
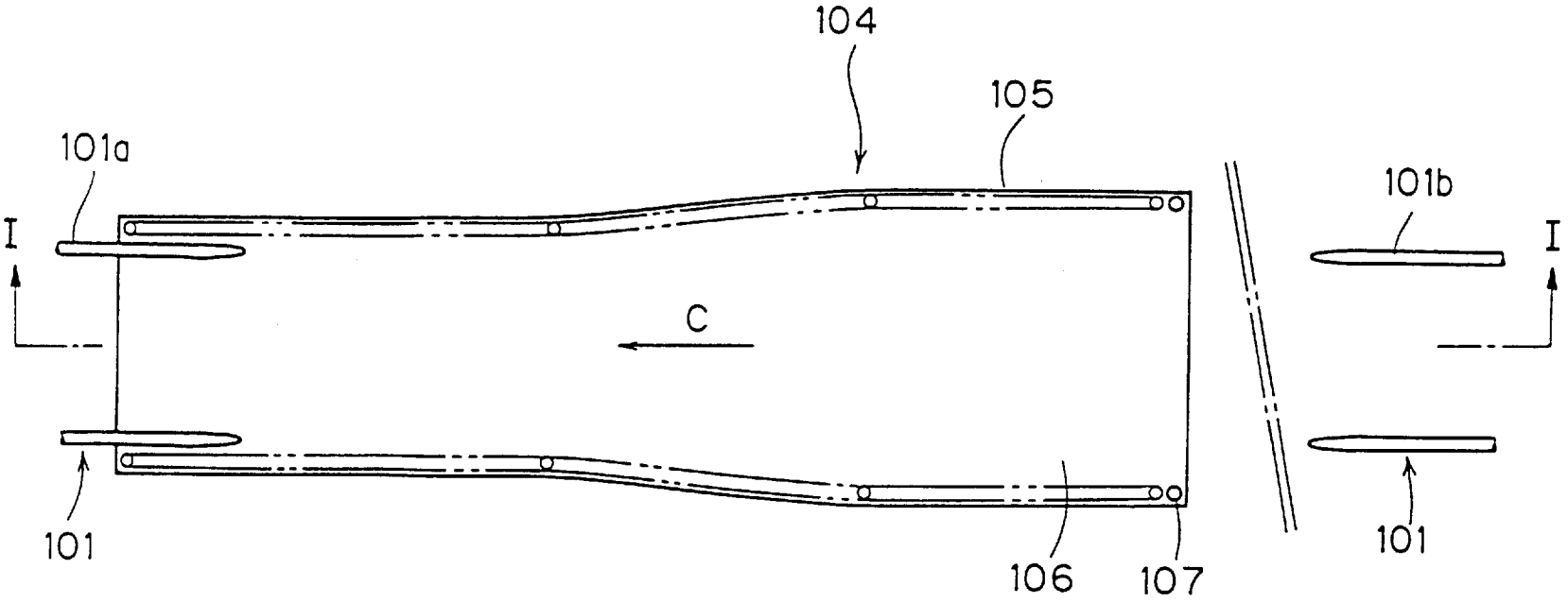
FIG.2 is a plan view for schematically illustrating the missing portion of the track shown in FIG.1.

As shown in FIG.2, the track 101 is comprised of two rails supported by a known structure (not shown in the figure), the continuous length of which is broken over a predetermined distance at the missing portion 104. The passenger car 102 is adapted to travel on such a track in the direction of arrow C, as seen in the figure, wherein the rails of a car-releasing side track section 101*b* and a receiving-side track section 101*a* are tapered at ends facing each other.

Figure 3:
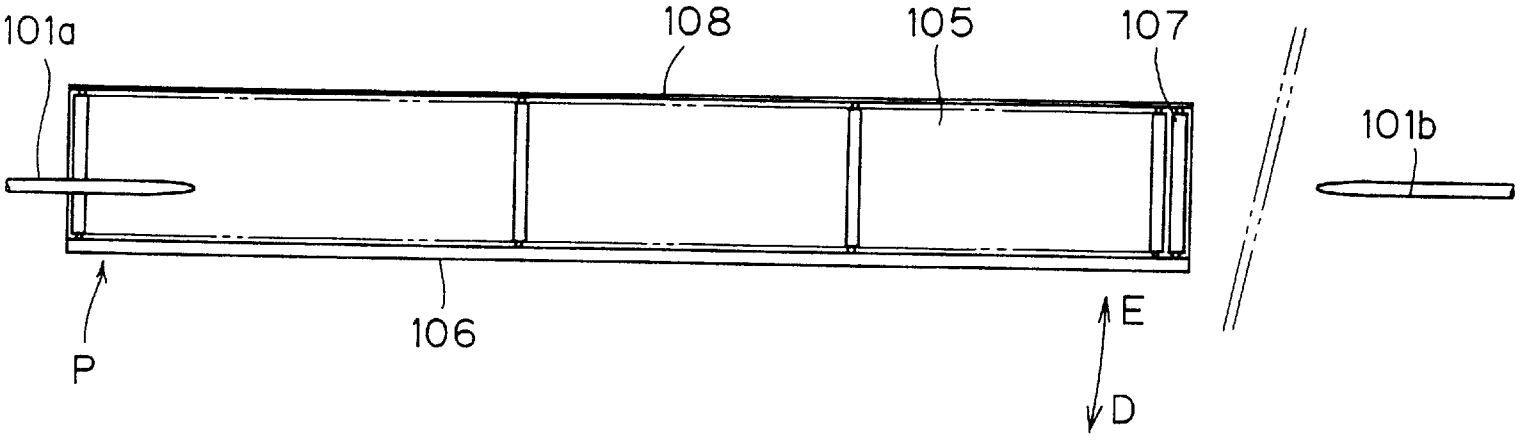
FIG.3 is a sectional view taken along line A—A of FIG.2.

As shown in FIGS.2 and 3, provided on the side of the track section 101*a* is a guide section 105 for receiving the car 102 moving from the track section 101*b* and guiding the car 102 to the track section 101*a*. The guide section 105 comprises a receiving plate 106 for receiving the car 102 on the upper surface thereof, and guide rollers 107. Rollers 107 are upright and disposed opposite sides of the upper surface of the receiving plate 106 along the direction of arrow C in FIG.2.

The receiving plate 106 is supported by the aforesaid structure (not shown), with the upper surface thereof so positioned as to sufficiently assure safe receipt of the moving car. More specifically, the path of the car 102 released into the air depends upon the traveling speed and direction of the car immediately before release from the track, the weight of the car 102, air resistance and the like. These parameters can be estimated beforehand, and thus, an appropriate position of the receiving plate 106 can be determined. Although the space between the track section 101*b* and the receiving plate 106 is not particularly specified, the space must be such that a safe receipt of the moving car 102 is sufficiently assured while at the same time an intended thrill can be offered to the passengers.

As shown in FIG.3, the guide rollers 107 are held, rotatable about their central shafts, between the receiving plate 106 and a support plate 108. Incidentally, the support plate 108 may be secured to the aforesaid structure (not shown) or to the receiving plate 106. A space between the guide rollers 107 on the opposite sides of the receiving plate 106 is wider on the track section 101*b* side than on the track section 101*a* side; a space on the track section 101*b* side is much greater than the width of the passenger car 102 whereas that on the track section 101*a* side is slightly greater than the width of the car 102.

Figure 4:
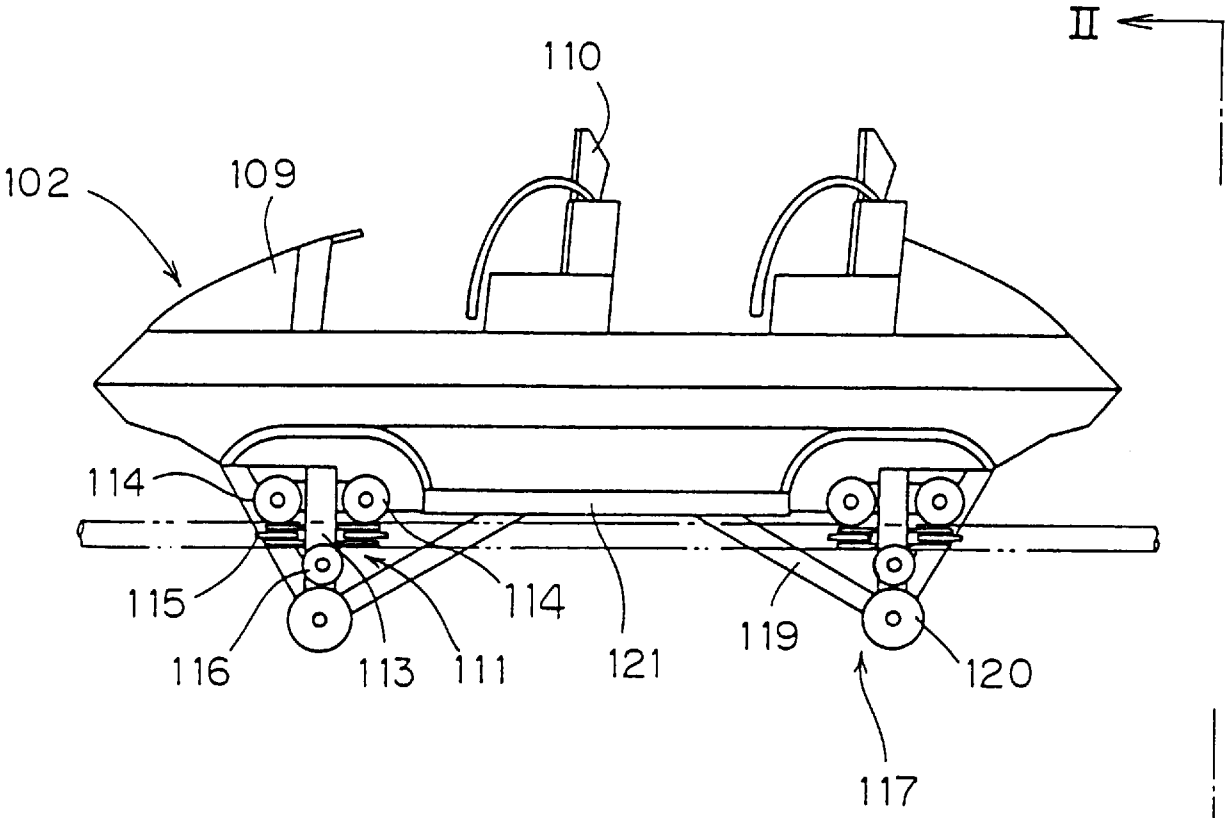
FIG.4 is a front view of a passenger car for use with the present invention.
Figure 5:
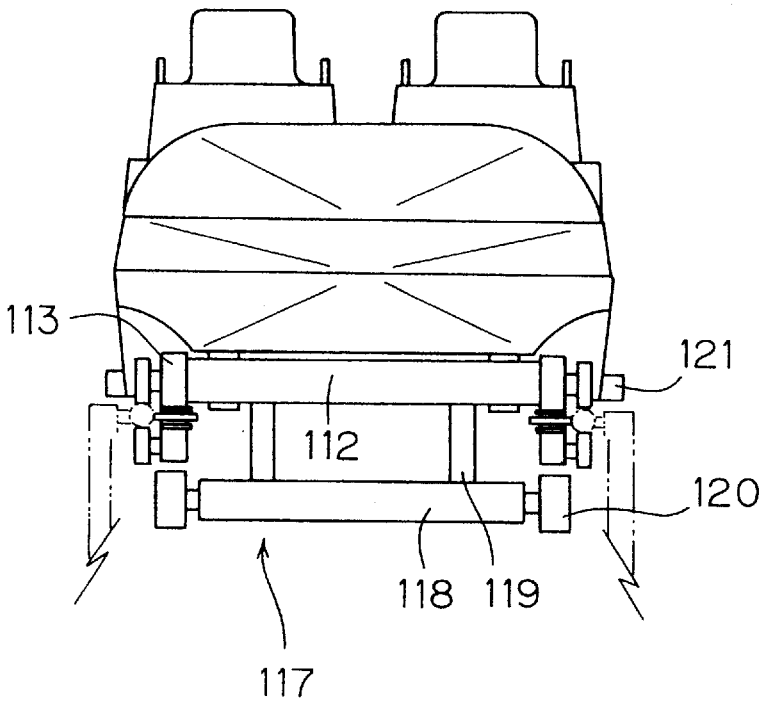
FIG.5 is a side view of the passenger car taken along line B—B of FIG.4.

As shown in FIGS.4 and 5, the passenger car 102 comprises a car body 109 including seats 110 for seating passengers, a running wheel section 111 disposed at the bottom of the car body 109 and engaging the track 101, and a coasting wheel section 117 disposed under the running wheel section 111 for allowing the car body 109 to coast by inertia.

The aforesaid car body 109 is of a known structure and therefore, detailed description thereof is not required, but the car body 109 is provided with a guided portion 121 on both sides of the car body 109 for engagement with the guide rollers 107 of the guide section 105 (See FIG.2).

The aforesaid running wheel section 111 comprises a pair of axles 112 disposed at the fore and rear portions of the car body 109, and wheel mounting stays 113 disposed at opposite ends of the respective axles 113, each wheel mounting stay 113 having two wheels 114 mounted thereto for engaging the upper portion of the rail of the track 101. Two wheels 115 are similarly mounted to section 111 for engaging the inner surface of the rail 101, and a wheel 116 is mounted for engaging the lower surface of rail 101. The wheels 114 and 115 are adapted to grip the rail from above and below thereby preventing a vertical movement of the car body 109 while the wheels 115 serves to prevent lateral movement of the car body 109. Thus, stable movement of the car body 109 is assured.

The aforesaid coasting wheel section 117 comprises a pair of axles 118 disposed at the fore and rear portions of the car body 109 and under the aforesaid running wheel section 111, wheels 120 mounted to the opposite ends of the respective axles 118, and support stays 119 for securing the respective axles 118 to the car body 109. There are provided six support stays 119 for each axle 118, as shown in the figures, so as to provide a structure having a sufficient strength to withstand a load on the axle 118. In this embodiment, the coasting wheel section 117 is disposed under the running wheel section 111 because of the relation with the receiving plate 106. However, it is obvious to those skilled in the art that the position thereof is not limited to the above. It is more desirable that the coasting wheel section 117 include a suspension element.

According to the amusement ride of the invention, the passenger car 102 travels on the track 101 by gravity with the running wheel section 111 engaged with the rails of the track 101, as described above. The passengers in the passenger car 102, as shown in FIG.1, may see the missing portion 102 during a ride from the beginning of a descending slope to a point immediately before the missing portion 104. Hence, the passengers may experience the mixed thrills of instinctive fear as they feel that the car 102 is moving free from the control of the track 101 and an impression of speed of the car descending the slope.

Subsequently, at the missing portion 104 of the rack 101, the car 102 is released into the air from the track 101 by inertia and maintains the speed it had immediately before it was released. In this embodiment, the rail ends of the track section 101*b* are so tapered as to reduce resistance when the car 102 is released. Hence, the car can stably maintain its speed and orientation. Then, the car 102 lands on the receiving plate 106 of the guide section 105 ahead of its moving direction by means of the coasting wheel section 117. In this embodiment, the receiving plate 106 is provided in a direction where the car 102 should move by inertia so that the car 102 receives little impact as it lands on the receiving plate 106. In this manner, the passengers may have at the same time a fear of being actually released into the air in a state absolutely free of control as well as impressions of zero gravity and speed, and thus experience an even greater intensity of thrills in this amusement ride.

The car 102 is allowed to transfer onto the receiving plate 106 safely because a space between the guide rollers 107 on the opposite sides of the receiving plate on the track section 101*b* side is sufficiently greater than the width of the car 102 (See FIG.2). Subsequently, the car 102 moves in the direction of arrow C in FIG.2 by means of the wheels 120 of the coasting wheel section 117. In this movement, the car 102 moves as progressively constrained by the guide rollers 107, because a space between the guide rollers 107 on opposite sides gradually decreases toward the track section 101*a* side to a width slightly greater than that of the car 102. Then, the rail ends of the track section 101*a* are relatively inserted into the respective sets of three wheels 114, 115 and 116 of the running wheel section 111 so that the car 102 travels on the track section 101*a*. In this embodiment, the guide rollers 107 are rotatable so that the friction between the car 102 and guide rollers 107 is very small when the guide rollers 107 come into contact with the guided portion 121 of the car 102 for controlling the position of the car 102. Accordingly, the car 102 can accomplish smooth movement without decreasing in traveling speed. The tapered rail ends of the track section 101*a* facilitate the insertion of the rails in space surrounded by the wheels 114, 115 and 116. In the amusement ride, the passengers may experience unprecedented thrilling sensations such as the mixed sensations of an instinctive fear as they feel the car 102 moving free from the control of the track 101 and an impression of speed of the car descending a slope, and sensations produced by a fear as they are actually released into the air in a state absolutely free of any control and by impressions of zero gravity and speed.

It is noted that the aforesaid guide rollers are not always required and may be replaced by simple flat guide plates, if the car 102 is smoothly transferred. In this case, the car 102 may be provided with rollers on both sides, respectively.

Alternatively, as shown in FIG.3, an arrangement may be made such that, for example, the receiving plate 106 is supported by the aforesaid structure (not shown) pivotally about a fulcrum P in the direction of arrow D–E, (the movement direction of the receiving plate is not limited to this but may be moved in parallel) and provided are a drive section for swinging the receiving plate 106 in the direction of arrow D–E, a sensor for detecting a position of the car and a control section responsive to a detection signal from the sensor for actuating the drive section. In this arrangement, the receiving plate 106 is normally moved in a direction of arrow D or E to be tilted down or up, and when the car 102 approaches the missing portion 104, the control section responds to the sensor detecting the approach of the car to actuate the drive section for moving the receiving plate 106 in the direction of arrow E or D to the position shown in FIG.3. Thus, the passengers are not aware of the existence of the receiving plate 106 and are kept from seeing the receiving plate 106 closing the track until the car 102 comes very close to the missing portion 104. Hence, they may feel the highest intensity of stress. In this case, it is desirable for safety reasons to employ a safety device for halting the car 102 on the track section 101*b* side in case that the receiving plate 106 should not be in a horizontal position.

Now referring to FIGS.6 through 9, description will be given of a second embodiment of the present invention.

Figure 6:
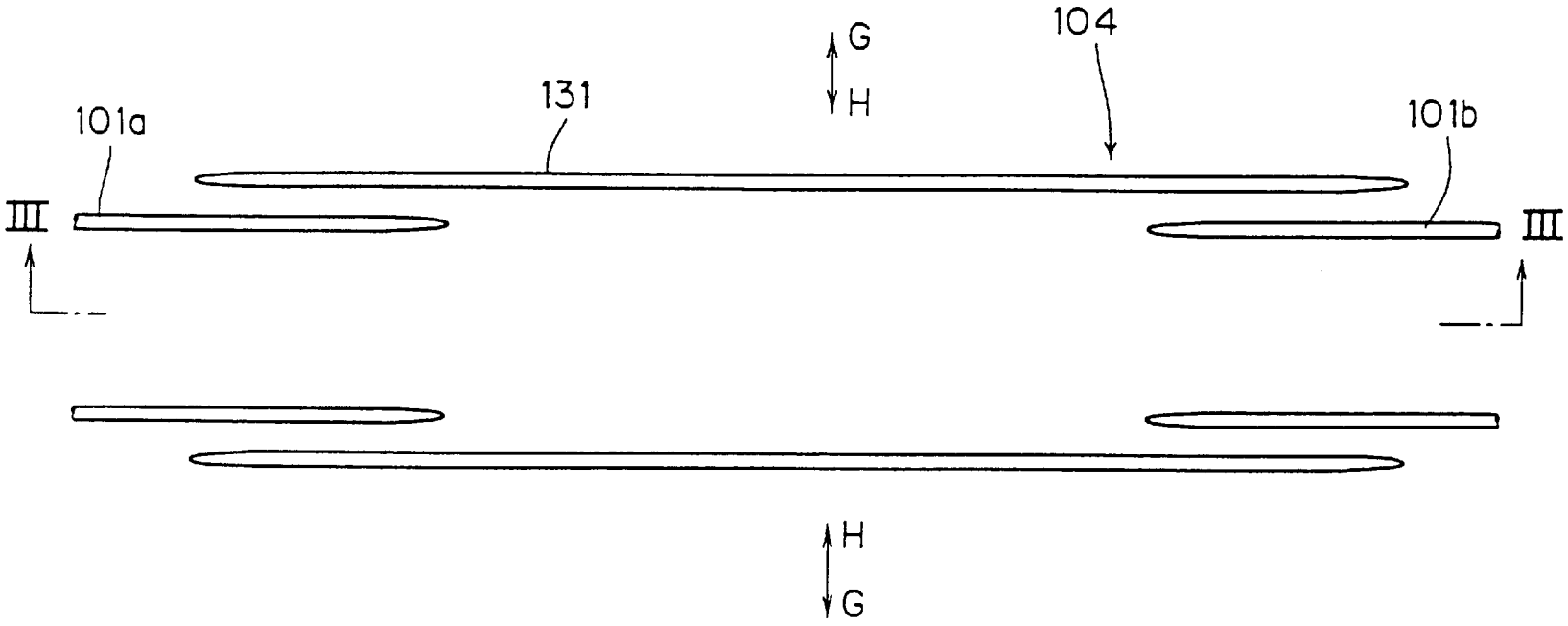
FIG.6 is a top plan view for schematically illustrating a missing portion of a track of a second embodiment of the invention.
Figure 7:
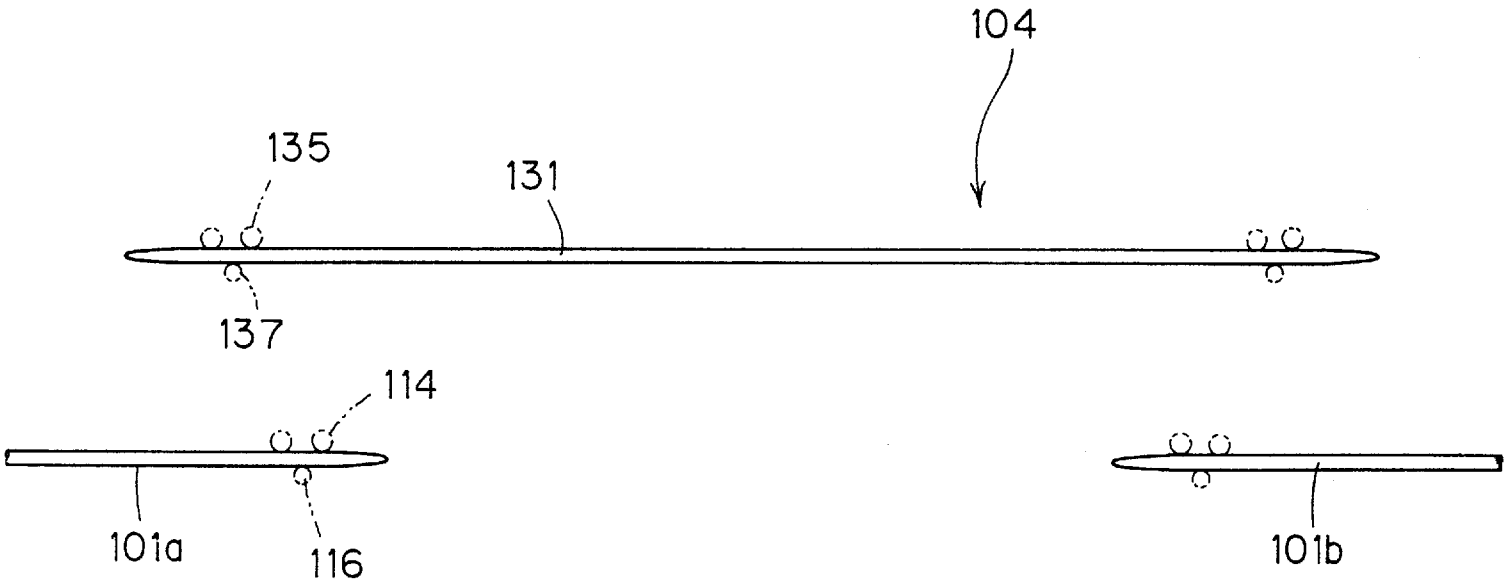
FIG.7 is a front view taken along line F—F of FIG.6.

The amusement ride of the second embodiment differs from the aforesaid first embodiment only in a part of the construction of the missing portion 104 and the passenger car 102. As shown in FIGS.6 and 7, the ride is provided with a transfer mechanism at a missing portion 104 of a track 101, the transfer mechanism comprising an auxiliary track 131 for transferring a passenger car 102 from a track section 101*b* to a track section 101*a* and a transfer wheel section 132 mounted to the car 102 for engaging the auxiliary track 131 (See FIG.8).

As shown in FIGS.6 and 7, the auxiliary track 131 comprises a pair of rails extended between the track section 101*a* and the track section 101*b* parallel thereto. The rails are supported by the aforesaid structure (not shown) above the track sections 101*a* and 101*b* at a predetermined height such that the transfer wheel section 132 can engage with the rails. The rails have such a length as to allow the opposite ends thereof to adequately overlap the track sections 101*a* and 101*b*, as seen in the vertical plane, respectively. Furthermore, the opposite ends of the rails are tapered. Incidentally, the embodiment is arranged such that the auxiliary track 131 overlaps the track sections 101*a* and 101*b* at the end portions for safety reasons. However, the rails are not necessarily required to overlap each other but the end portions thereof may be spaced from each other as long as the car 102 is smoothly transferred.

Figure 8:
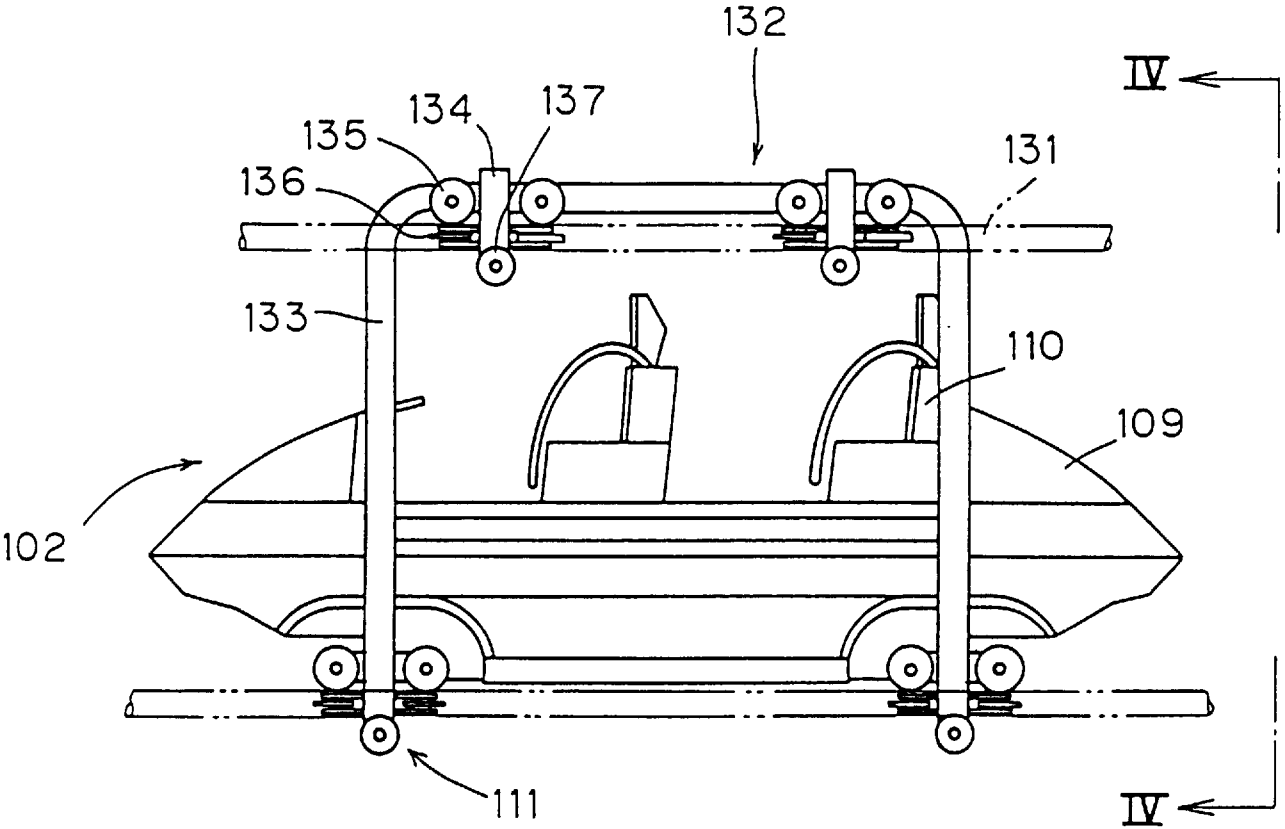
FIG.8 is a front view of a passenger car of the second embodiment.
Figure 9:
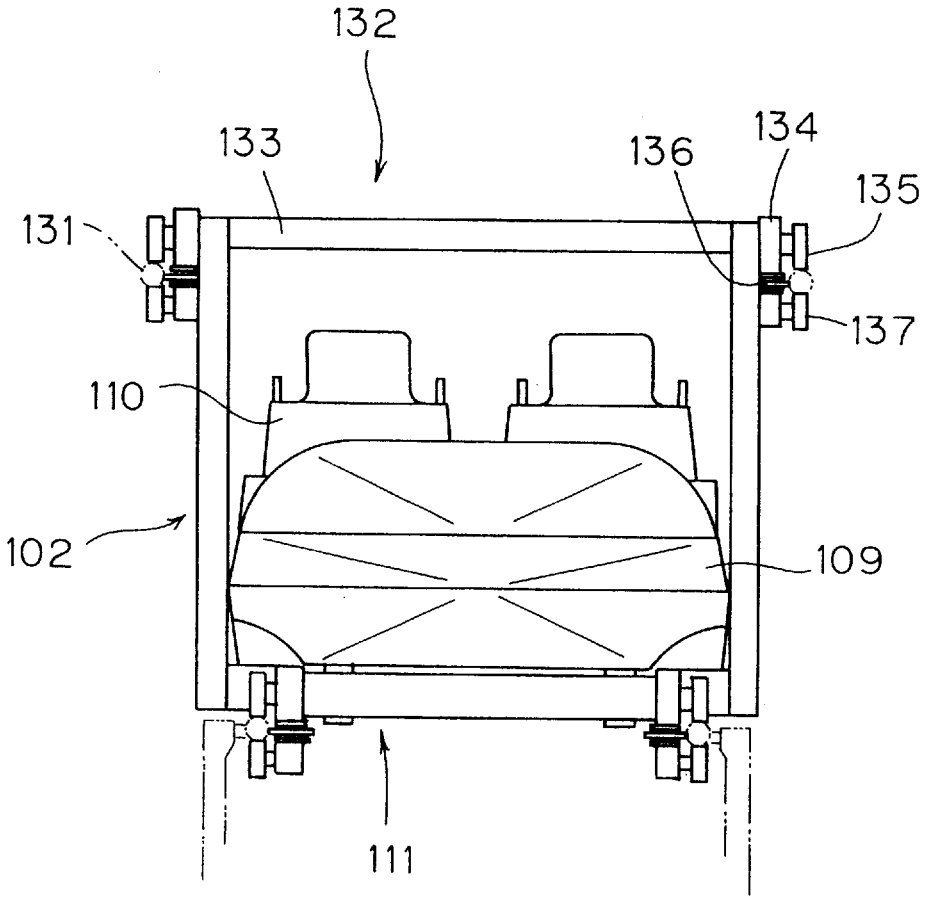
FIG.9 is a side view taken along line I—I of FIG.8.

As shown in FIGS.8 and 9, the passenger car 102 comprises the car body 109 having seats 110 for seating passengers, the running wheel section 111 disposed under the car body 109 for engaging the track 101 and the transfer wheel section 132 for engaging the auxiliary track 131. The transfer wheel section 132 comprises a wheel mounting frame 133, a wheel mounting stay 134 secured to the wheel mounting frame 133, and wheels 135, 136 and 137 mounted to the wheel mounting stay 134.

The wheel mounting frame 133 comprises U-shaped members mounted to both lateral sides of the car body 109, and members laterally extended between the U-shaped members for supporting them. The wheel mounting stay 134 and wheels 135, 136 and 137 are of the similar construction to that of the aforesaid running wheel section 111.

According to the ride, the passenger car 102 travels on the track 101 by gravity with the running wheel section 111 engaged with the track 101. The passengers in the car 102 may see the missing portion 104 of the track 101, as shown in FIG.1, during a ride from the beginning of a descending slope to a point immediately before the missing portion 104. Hence, the passengers may experience the mixed thrills of an instinctive fear as they feel that the car 102 is moving free from the control of the track 101 and an impression of speed of the car descending the slope.

Subsequently, approaching the missing portion 104, the car 102 continues to proceed at an unchanged speed to allow the rail ends of the auxiliary track 131 to be relatively inserted in a space surrounded by the wheels 135, 136 and 137 on the fore side of the car, then allowing the wheels 114, 115 and 116 on the fore side of the car to be disengaged from the track section 101*b*. Similarly, the rail ends of the auxiliary track 131 are inserted in a space surrounded by the wheels 135, 136 and 137 on the rear side of the car, and thereafter the wheels 114, 115 and 116 disengage from the track section 101*b*.

The car 102 continues to travel on the auxiliary track 131 to allow the rail ends of the track section 101*a* to be relatively inserted in a space surrounded by the wheels 114, 115 and 116 on the fore side of the car, then allowing the wheels 135, 136 and 137 on the fore side of the car to disengage from the auxiliary track 131. Similarly, the rail ends of the track section 101*a* are relatively inserted in a space surrounded by the wheels 114, 115 and 116 on the rear side of the car, and, thereafter, the wheels 135, 136 and 137 on the rear side disengage from the auxiliary track 131.

Thus, the passenger car 102 is transferred from the track section 101*b* to the track section 101*a* quite safely because the transfer thereof is carried out by way of the auxiliary track section 131. In addition, the tapered rail ends of the track sections 101*b*, 101*a* and the auxiliary track 131 streamline the insertion of the rail ends in a space surrounded by the wheels 114, 115 and 116 and the wheels 135, 136 and 137 or the disengagement of these wheels from the rails.

Obviously the passenger car 102 is not limited to that employed by this embodiment. For example, the passenger car 102 may be of a type wherein the passengers assume a stand-up position or a monorail car having the running wheel section 111 at the top of the car body 109 for traveling as suspended. In this case, the transfer wheel section 132 may be disposed at the bottom of the car body 109 while the auxiliary track 131 may be located under the track 101.

There may be made an arrangement such that the rails of the auxiliary track 131 are mounted to the aforesaid structure (not shown) to pivot or move in the direction of arrow G–H, for example (the direction of movement is not limited to these). In this case, a drive section would be provided for moving the rails in the direction of arrow G–H, a sensor would be provided for detecting a position of the car and a control section would be provided responsive to a detection signal from the sensor for actuation of the drive section. In this arrangement, the rails are normally shifted in the direction of arrow G but in response to the sensor detecting the car 102 approaching the missing portion 104, the control section actuates the drive section for moving the rails in the direction of arrow H to the position shown in FIG.6. Thus, the passengers are not aware of the existence of the auxiliary track until the car 102 comes very close to the missing portion 104. Hence, they may feel the highest intensity of stress. In this case, it is desirable for safety reasons to employ a safety device adapted to halt the car 102 on side of the track section 101*b* in case that the rails should not be positioned in the direction of arrow H.

Next, description will be given of a third embodiment of the present invention. As is seen from FIG.10, an amusement ride of the embodiment comprises a track 201 including rails 203, the continuous length of which is broken at least at one place (missing portion 213), a passenger car 207 for traveling on the track 201 with the passengers seated therein, and a transfer mechanism 217 for transferring the car 207 across the missing portion 213 from the track 201 on one side (first rails 203*a*) to the track 201 on the other side (second rails 203*b*).

Figure 10:
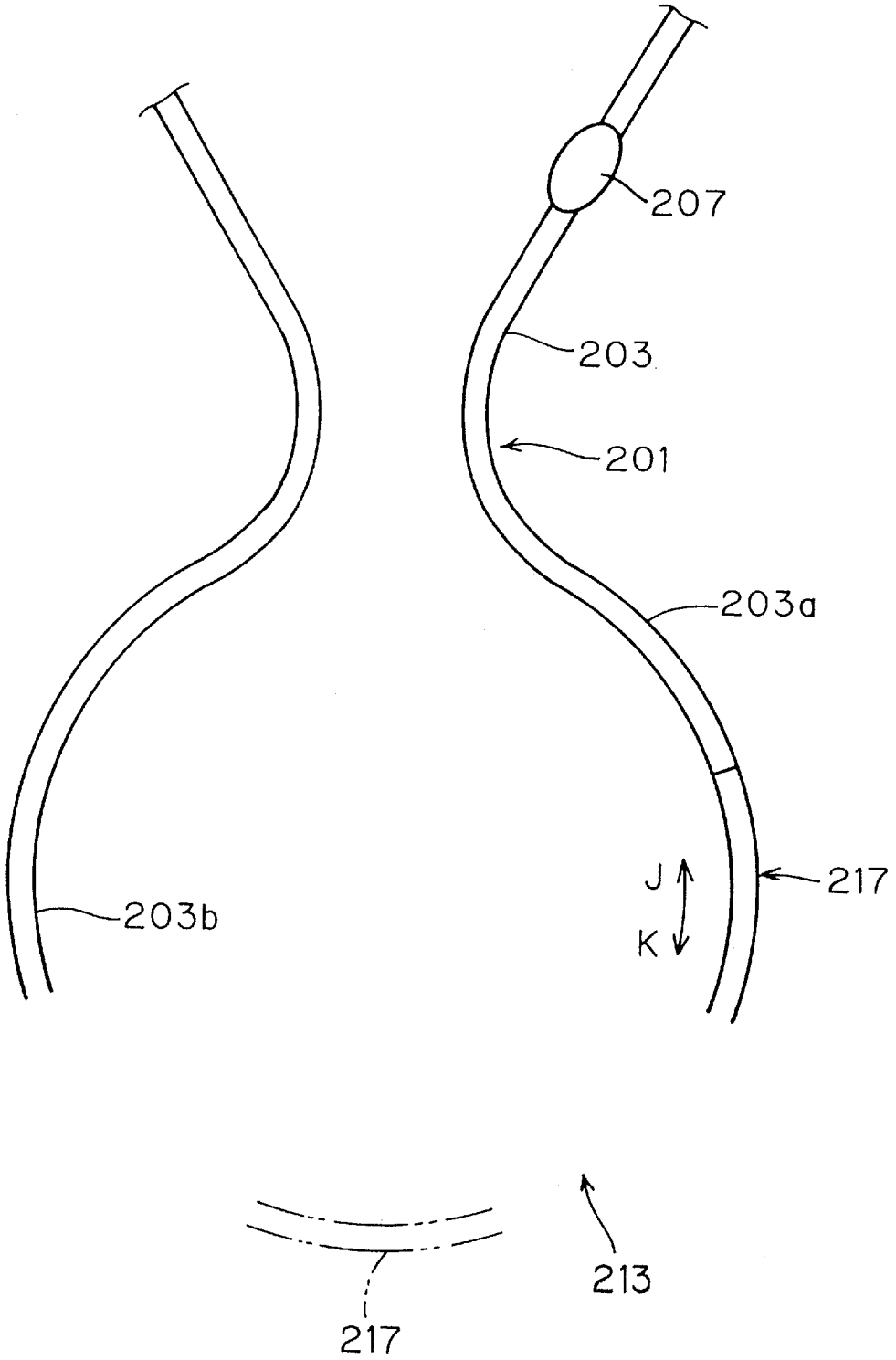
FIG.10 schematically illustrates an amusement ride according to a third embodiment of the invention.
Figure 13:
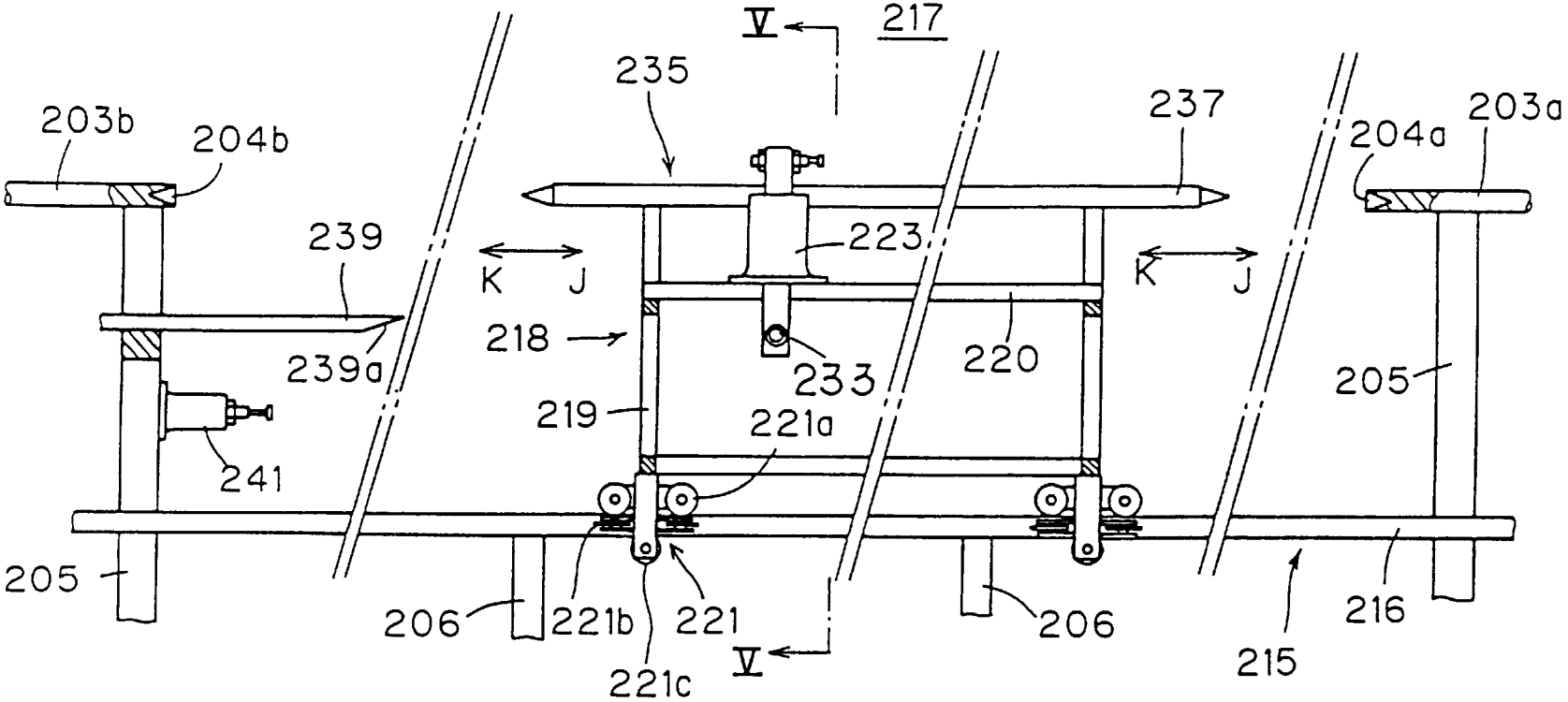
FIG.13 is a side view for illustrating a transfer mechanism of the third embodiment.

The rails 203 comprises a pair of rails laid in parallel to each other and supported by posts 205, as shown in FIG.13. In the ride, the rails 203 are substantially formed like an arc, having a portion thereof cut away therefrom so as to define the missing portion 213, as seen in FIG.10. It is obvious to those skilled in the art that the track layout as seen in the top plan view is not limited to that shown in FIG.10 nor the missing portion 213 is not limited to one place, the position of which is not particularly specified.

Figure 11:
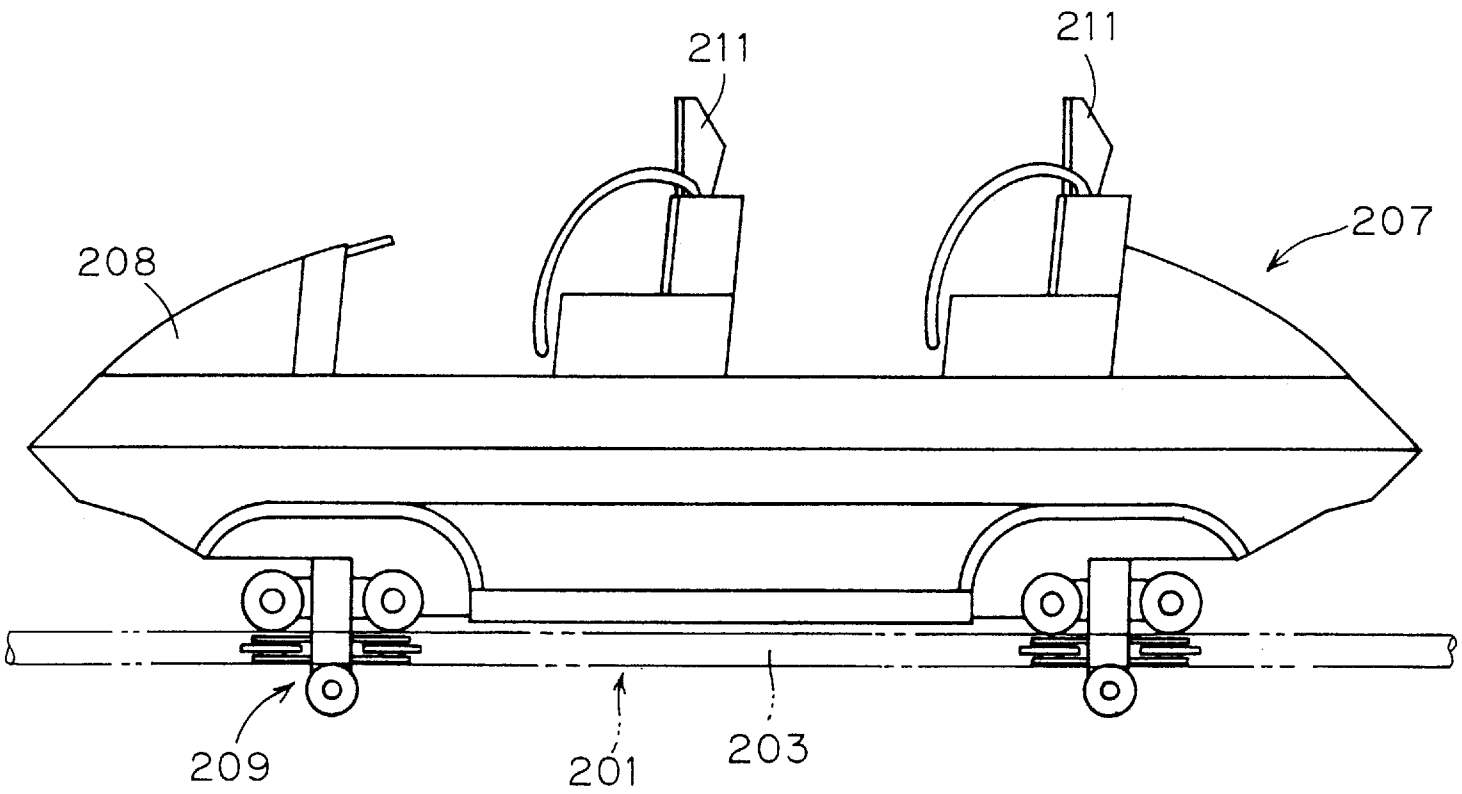
FIG.11 is a side view of a passenger car of the third embodiment.
Figure 12:
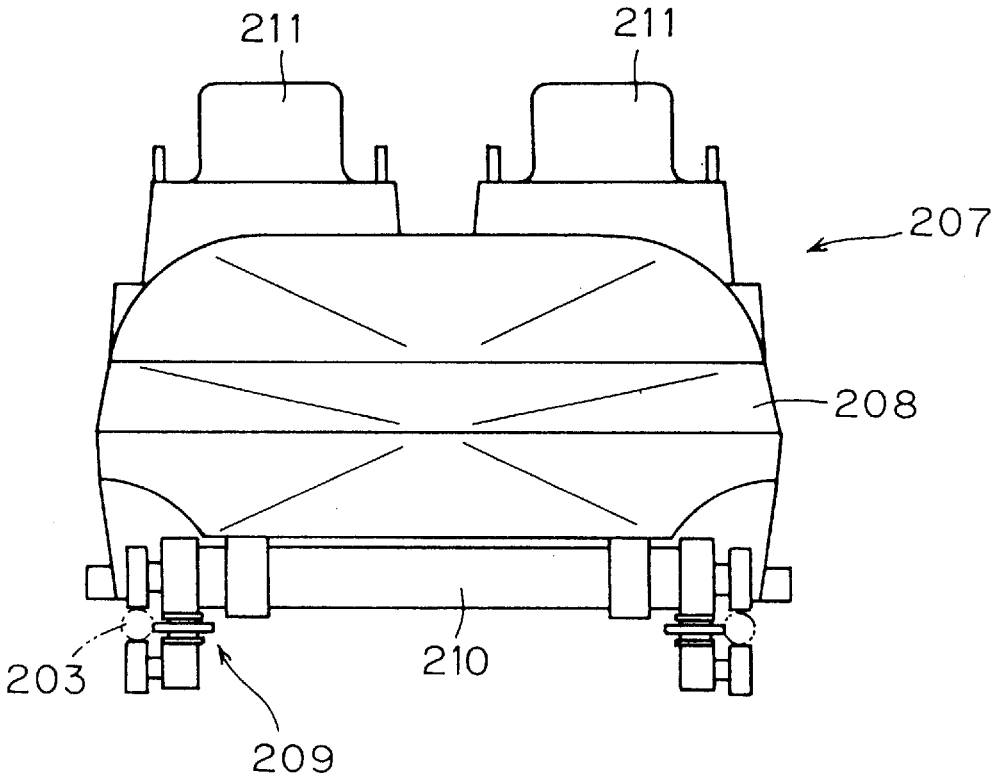
FIG.12 is a front view of the passenger car of FIG.11.

As seen in FIGS.11 and 12, the passenger car 207 is of a known vehicle generally employed by the traditional roller coasters which comprises a car body 208 including seats 211 for seating passengers and a wheel section 209 disposed at the bottom of the car body 208. As shown in the figure, the wheel section 209 comprises a pair of axles 210 disposed at the fore and rear portions of the car body and wheels mounted to the respective ends of the axles. The wheels engage the upper, lower and lateral portions of the rail 203, respectively, for preventing vertical and lateral movement of the car 207, so that the car may travel on the rails 203 in a stable manner.

Figure 17:
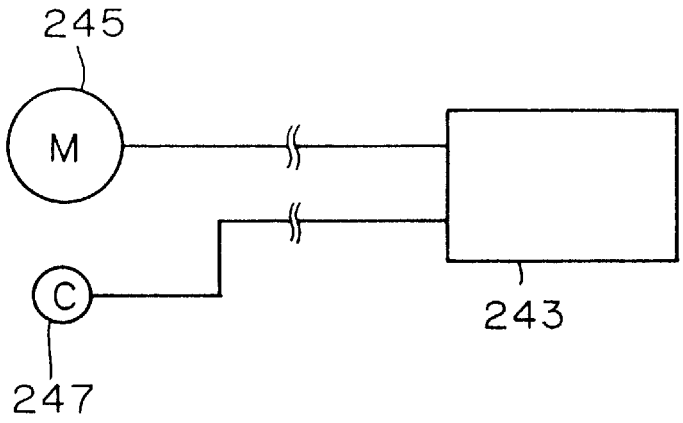
FIG.17 is a diagrammatic illustration of a control device of the third embodiment.

The aforesaid transfer mechanism 217 is disposed between the first rail 203*a* and the second rail 203*b*, as shown in FIG.13, and comprises a transfer vehicle 218, a halting mechanism 223 and a car-relay mechanism 235 provided at the transfer vehicle 218, an auxiliary track 215, a release bar 239, a shock absorber 241 and a control device 243 of FIG.17 for controlling the transfer vehicle 218.

Figure 14:
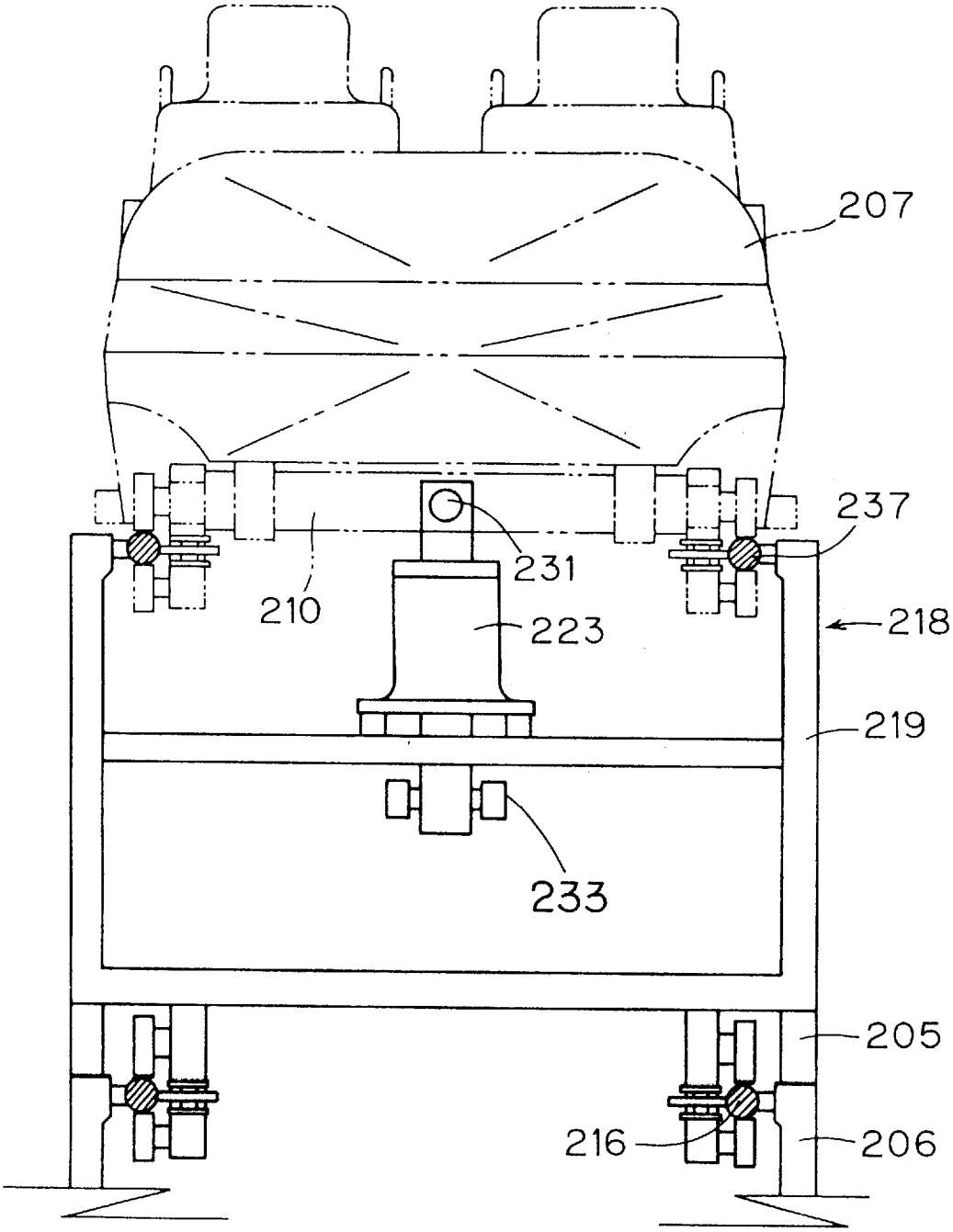
FIG.14 is a sectional view taken along line L—L of FIG.13.

Similarly to the rails 203, the auxiliary track 215 includes auxiliary rails 216 comprised of a pair of rails laid parallel to each other (see FIG.14). The auxiliary rails 216 have one end supported by the posts 205 under the first rails 203*a* and the other end supported by the posts 205 under the second rails 203*b*. The auxiliary rails 216 are formed like an arc having the same curvature with the rails 203, and have an intermediate portion thereof supported by posts 206.

The aforesaid transfer vehicle 218 comprises a trestle 219 and a wheel section 221 disposed at four corners of the lower end portions of the trestle 219. The wheel section 221 is of a similar construction to that of the wheel section 209 of the aforesaid passenger car 207, which comprises an upper wheel 221*a*, a lateral wheel 221*b* and a lower wheel 221*c*. As seen in FIG.13, the upper wheel 221*a* and lower wheel 221*c* engage the upper and lower surfaces of the auxiliary rail 216, respectively, whereas the lateral wheel 221*b* engages the inner surface of the rail 216. This prevents vertical and lateral movements of the trestle 219 thereby assuring a stable travel of the transfer vehicle. There is provided an electric motor 245 with a clutch 247 as shown in FIG.17, which is connected to at least two sets of upper wheels 221*a* on either side of the direction of arrow J or K and is controlled by the aforesaid control device 243.

As shown in FIG.13, the car-relay mechanism 235 comprises relay rails 237 laid atop the trestle 219. The relay rails are formed of the same rail member with the aforesaid rails 203 and have the opposite ends thereof tapered. The first rails 203*a* and second rails 203*b* are formed with engageable holes 204*a* and 204*b* at respective ends thereof, such that the transfer vehicle 218 moves in the direction of the arrow in FIG.13 to bring the respective ends of the relay rails into engagement with the engageable holes 204*a* or 204*b* to thereby form the track unitarily with the first rails 203*a* or the second rails 203*b*.

Figure 15:
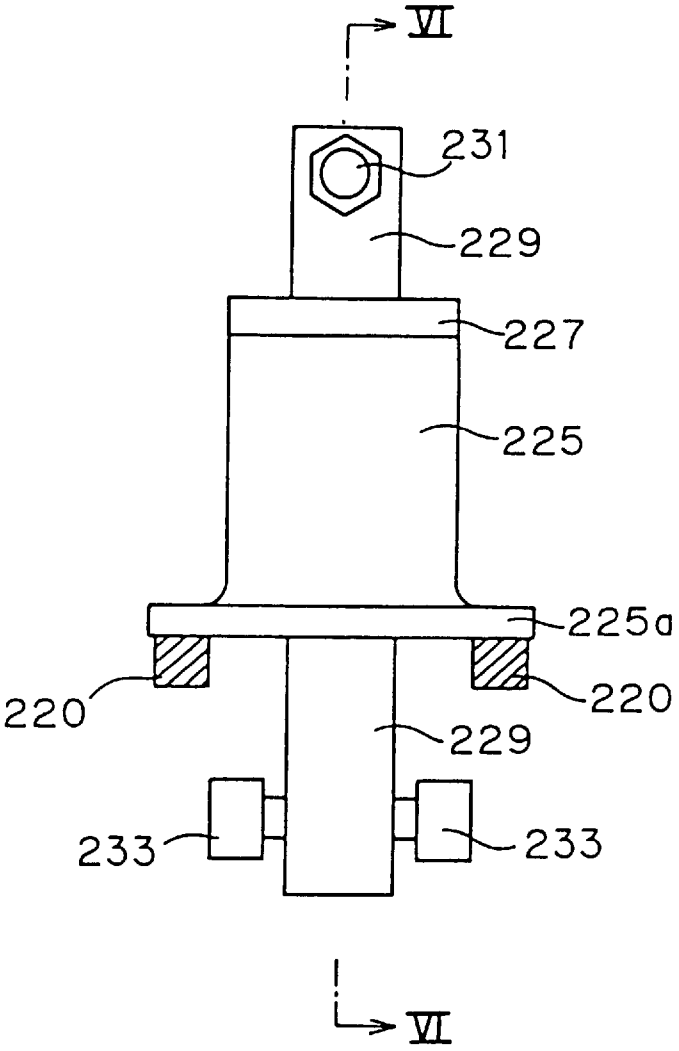
FIG.15 is a front view of a halting mechanism of the third embodiment.
Figure 16:
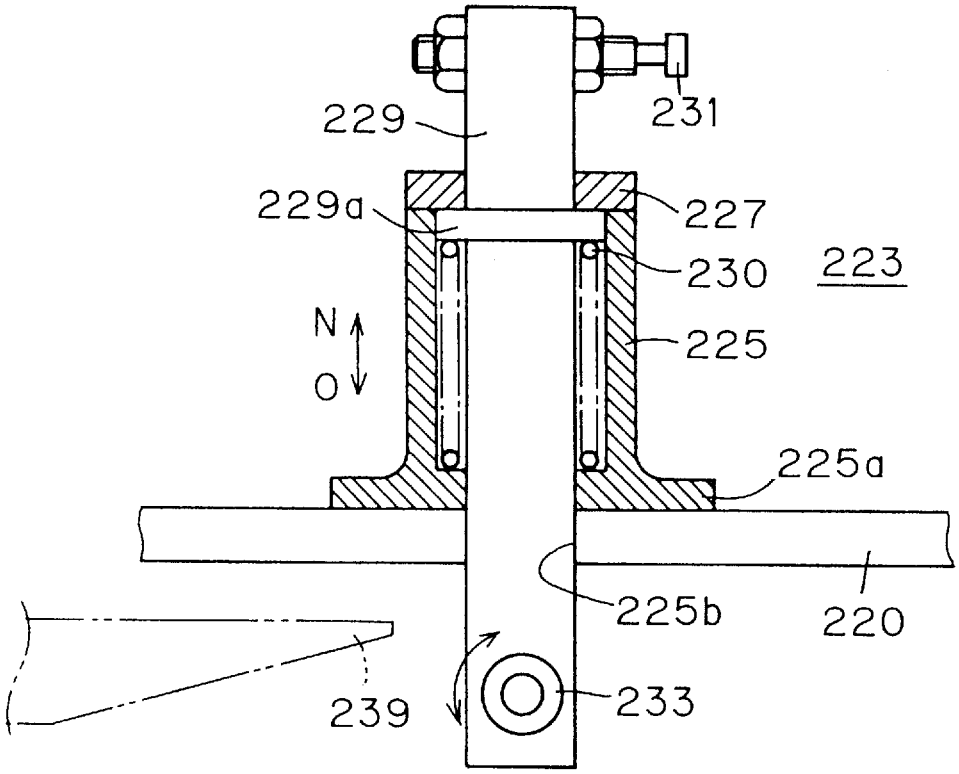
FIG.16 is a sectional view taken along line M—M of FIG.15.

The aforesaid halting mechanism 223 is secured on a support bar 220 disposed at an intermediate height of the trestle 219, as shown in FIG.13, and comprises a housing 225, a lid 227, a movable shaft 229, a spring 230, a shock absorber 231 and a roller 233, as seen in FIGS.15 and 16. The housing 225 is comprised of a substantially cylindrical member which opens to the upper end thereof and has at the lower end thereof, a mounting flange 225*a* and a fitting hole 225*b* fitted with the movable shaft 229. The movable shaft 229 has a collar 229*a* at an intermediate portion thereof and is movable in the direction of arrow N–O as received within the housing 225, as shown in the figure. The opening of the housing 225 is closed by the lid 227. As seen in the figure, the spring 230 is contained in the housing for biasing the movable shaft 229 in the direction of arrow N. The shock absorber 231 is of a known member for receiving a moving body as damping an impact of collision, and is disposed at the upper portion of the movable shaft 229. In this embodiment, a hydraulic type shock absorber is employed and is disposed so that when the passenger car 207 transfers onto the relay rails 237, the distal end of the shock absorber 231 abuts against the axle 210 of the car 207. The roller 233 is rotatable in the direction of the arrow in the figure and mounted to the lower portion of the movable shaft 229. The roller 233 is adapted to engage the release bar 239 for moving the movable shaft 229 in the direction of arrow O.

The aforesaid release bar 239, as shown in FIG.13, comprises a pair of bar members mounted to the posts 205 of the second rails 203*b* as spaced a predetermined distance from each other and having at the distal ends thereof wedge-like engageable portions 239*a* slanted at the lower surfaces thereof. As described above, the engageable portions 239*a* are to engage the aforesaid rollers 233.

Similarly to the aforesaid shock absorber 231, the shock absorber 241 (See FIG.13) is a known member for receiving a moving body and damping an impact of collision. In this embodiment, a hydraulic type shock absorber is employed.

According to the ride of this embodiment, the car 207 with the passengers seated therein travels on the rails 203 along the track to reach the missing portion 213 of the rails 203, as shown in FIG.10. In this process, the passengers may see the missing portion 213, experiencing the mixed thrills of a fear of the car 207 falling off from the rails 203 at the missing portion 213 and an impression of speed of the car traveling at a predetermined speed. It is to be understood that the transfer vehicle 218 has been previously moved in the direction of arrow J by the electric motor 245 controlled by the control device 243 so that the tips of the relay rails 237 have engaged the engageable holes 204*a* of the first rails 203*a*. Thereafter, the clutch 247 of the electric motor 245 is released so that the transfer vehicle 218 is ready to move in the direction of arrow K in the figure.

Subsequently, the car 207 transfers from the first rails 203*a* to the relay rails 237. At this time, the car 207 is subject to no impact because the first rails 203*a* tightly joins with the relay rails 237.

Then, the axle 210 of the car 207 transferred onto the relay rails 237 abuts against the shock absorber 231 of the halting mechanism 223, so that the car 207 is halted with an impact of the abutment damped by the shock absorber 231. At the same time, gaining momentum from the car 207, the transfer vehicle 218 starts to move on the auxiliary track 215 in the direction of arrow K at a predetermined speed. Incidentally, the passengers cannot foresee that the car 207 can transfer onto the second rails 203*b* because the auxiliary rails 216 are not laid on an extension line of the first rails 203*a*, making it impossible for the passengers to see them and because the car 207 is not provided with a member for engagement with the auxiliary track 215. Hence, the passengers are seized with fear, assuming that the car 207 is just falling off from the first rails 203*a*.

Next, as the arrow K-side end of the transfer vehicle 218 approaches the ends of the second rails 203*b*, the rollers 233 are first engaged with the release bars 239 of FIG.13. This causes the movable shafts 299 and shock absorbers 231 to move in the direction of arrow O as seen in FIG.16 for disengagement of the shock absorbers 231 from the axle 210 and thus, the car 207 is ready to move in the direction of arrow K. Subsequently, the arrow K-side end of the trestle 219 abuts against the shock absorbers 241 so that the transfer vehicle 218 is halted and the impact of the abutment damped while the arrow K-side ends of the relay rails 237 join with the engageable holes 204*b* of the second rails 203*b*. In this process, the tapered ends of the relay rails 237 on the arrow K-side assuredly guide the relay rails 237 into the engageable holes 204*b* so that the relay rails 237 and the second rails 203*b* are smoothly joined.

Upon disengagement of the axle 210 from the shock absorbers 231, the car 207 starts to move by inertia in the direction of arrow K and transfers onto the second rails 203*b*, continuing to travel thereon at a predetermined speed.

In the above mentioned manner, the car 207 can assuredly and smoothly transfer from the first rails 203*a* to the second rails 203*b*. Accordingly, the traveling speed of the car 207 is not decreased so much during the transfer of the car 207 from the first rails 203*a* onto the second rails 203*b*. This prevents a decrease in the intensity of impression of speed felt by the passengers.

Subsequently, the control device 243 couples the electric motor 245 to the upper wheels 221*a* via the clutch 247 while actuating the electric motor 245 to cause the transfer vehicle 218 to move in the direction of arrow J for joining the arrow J-side ends of the relay rails 237 with the engageable holes 204*a* of the first rails 203*a*. Thus, the transfer vehicle 218 is returned to its original position for cycling the same operations as those aforementioned.

The ride of this embodiment is arranged such that the transfer vehicle 218 is returned to its original position by means of the control device 243 and electric motor 245. However, the arrangement is not limited to the above but other drive means such as a winch may be employed. An alternative arrangement may be made such that the drive means is eliminated but the auxiliary rails 216 are inclined to thereby return the transfer vehicle 218 to its original position.

Now referring to FIGS. 18 through 21, description will be given of a fourth embodiment of the present invention The ride of this embodiment essentially has the same construction as the third embodiment. As shown in FIG.19, a passenger car 307 has a second wheel section 309 securely attached to a car body 208 by means of a mounting stay 311 at a position below the wheel section 209 of the aforesaid car 207. Other features of the passenger car 307 are similar to those of the car 207. As shown in FIG.21, the second wheel section 309 comprises upper, lower and lateral wheels mounted to opposite ends of axles 310, respectively.

Figure 20:
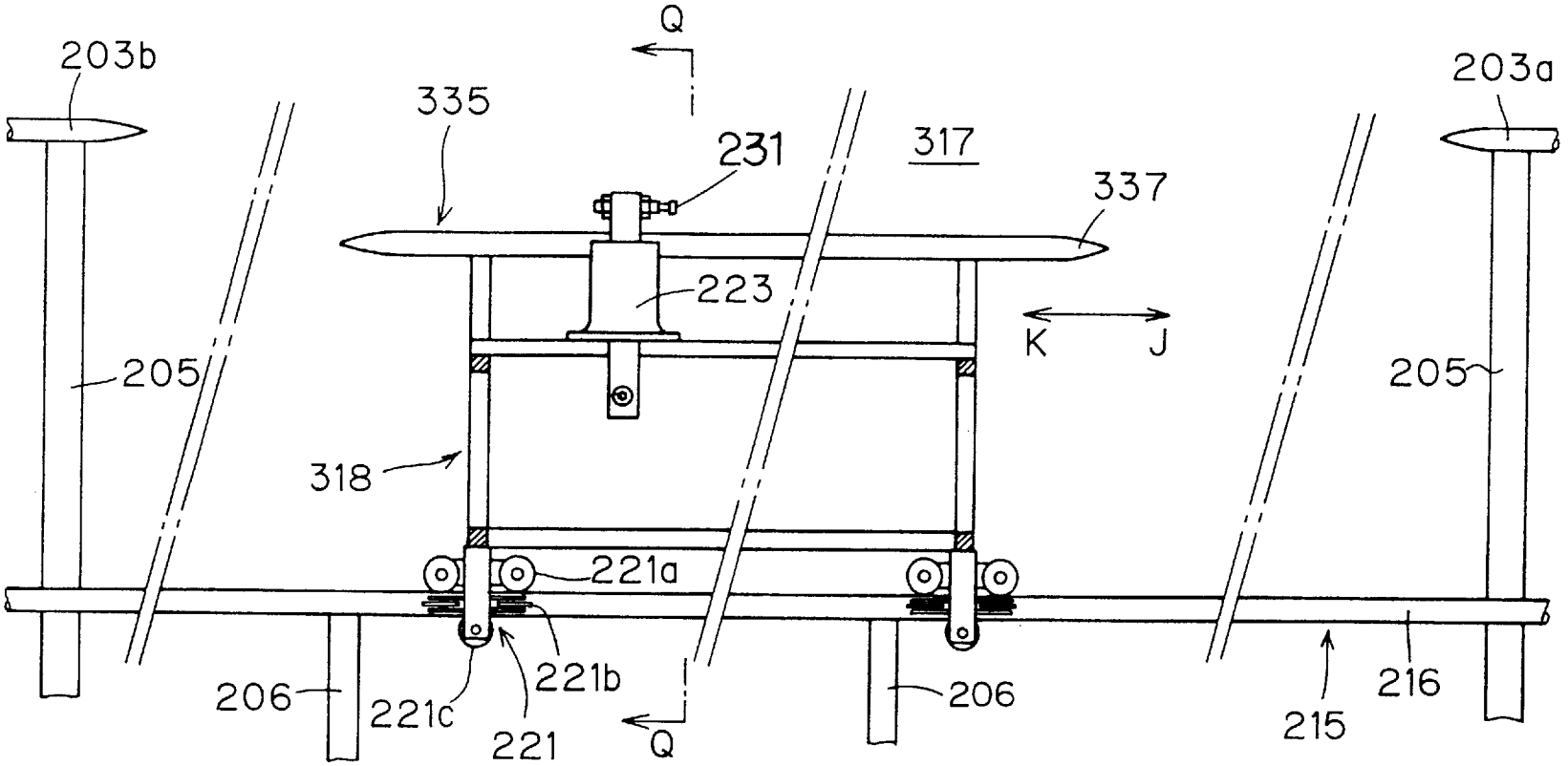
FIG.20 is a side view of a transfer mechanism of the fourth embodiment.
Figure 21:
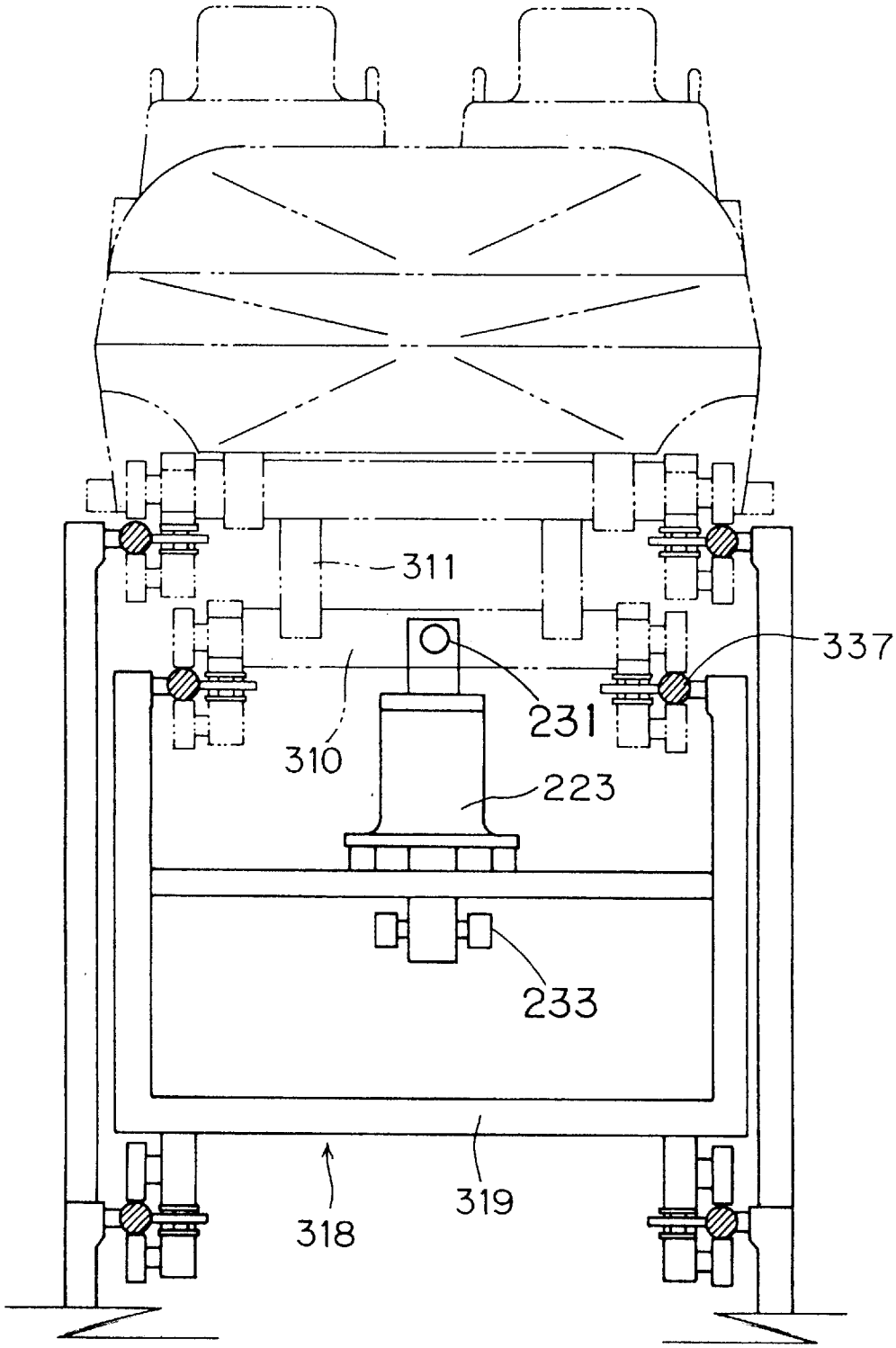
FIG.21 is a sectional view taken along line Q—Q of FIG.20.

A transfer vehicle 318 has a construction such that a trestle 319 has an outer width smaller than an inner spacing between the posts 205 so as to be allowed in between the posts 205 and relay rails 337 have a smaller height than the rails 203 so as to engage with the second wheel section 309 of the passenger car 307, as Shown in FIG.20.

Further, as shown in the figure, the first and second rails 203*a* and 203*b* have tapered ends. Although not particularly illustrated in the figure, there is provided a shock absorber of a similar construction to the aforesaid shock absorber 241 at an end point of the movement of the transfer vehicle 318 in a direction of arrow J. On the other hand, a release bar and shock absorber of the similar construction to the aforesaid release bar 239 and shock absorber 241 are disposed at an end point of the movement of the transfer vehicle 318 in a direction of arrow K.

With the above construction, the transfer vehicle 318 is adapted for travel in the direction of arrow J–K, wherein at the end point of the movement in direction J, the J-side end portion of the transfer vehicle 318 is allowed in a space between the posts 205 for supporting the first rails 203*a* and at the end point of the movement in direction K, the K-side end portion of the transfer vehicle 318 is allowed in a space between the posts 205 for supporting the second rails 203*b*.

Figure 18:
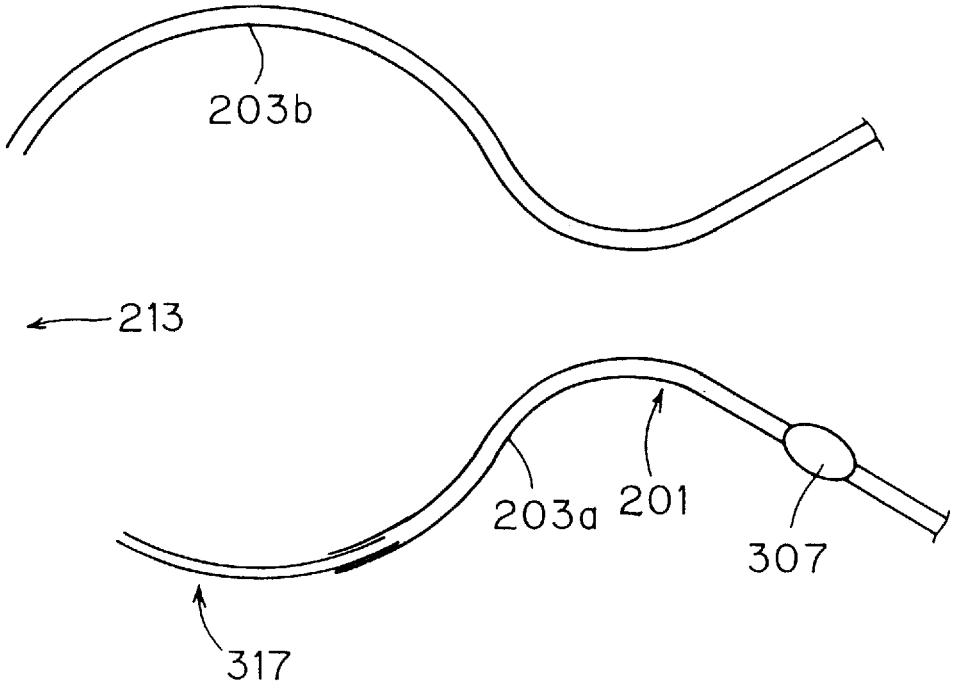
FIG.18 schematically illustrates an amusement ride according to a fourth embodiment of the invention.
Figure 19:
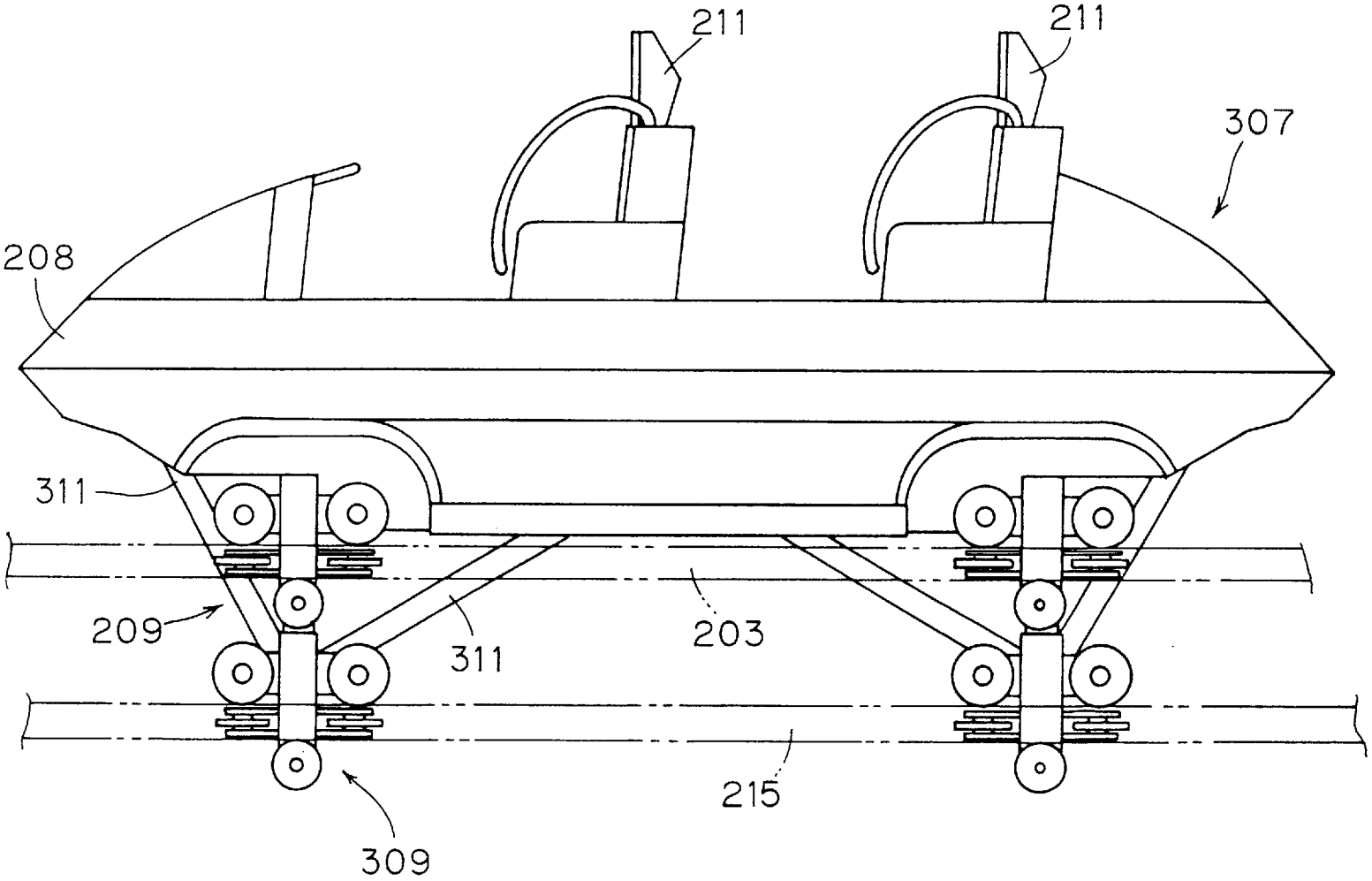
FIG.19 is a side view of a passenger car of the fourth embodiment.

According to the ride of this embodiment, the passenger car 307 with the passengers seated therein travels on the rails 203 to approach the missing portion 213, as shown in FIG.18. It is to be understood that the aforesaid control device 243 would have actuated the electric motor 245 so that the transfer vehicle 318 has already moved to the end point of the movement in direction J when car 307 arrives. Thereafter, the clutch 247 of the electric motor 245 was released so that the transfer vehicle 318 is ready to move in the direction of arrow K.

Subsequently, the second wheel section 309 of the car 307 comes into engagement with relay rails 337 of the transfer vehicle 318, which engagement is established quite positively and smoothly because of the tapered tips of the relay rails 337. Thereafter, the axle 310 of the transfer vehicle 307 abuts against the shock absorbers 231 of the halting mechanism 223 whereby the car 307 is halted with an impact of the abutment damped by the shock absorbers 231. At the same time, the transfer vehicle 318 gains momentum from the car 207 to start traveling on the auxiliary track 215 at a predetermined speed in the direction of arrow K. Traveling a predetermined distance, the transfer vehicle 318 disengages the wheel section 209 of the passenger car 307 from the first rails 203*a*.

Then, the K-side end portion of the transfer vehicle 318 enters a space between the posts 205 supporting the second rails 203*b* so that the wheel section 209 of the car 307 comes into engagement with the second rails 203*b*. When the transfer vehicle 318 reaches the end point of the movement in direction K, the release bars and rollers 233 engage each other to thereby disengage the axle 310 from the shock absorbers 231, and thus the passenger car 307 is allowed to move in the direction of arrow K. Subsequently, the K-side end portion of the trestle 319 abuts against the shock absorbers so that the transfer vehicle is halted with an impact of the abutment damped by the shock absorbers. The passenger car 307, in turn, starts moving by inertia in the direction of arrow K, continuing to travel on the second rails 203*b* at a predetermined speed.

According to the ride of this embodiment, as described above, in the transfer of the passenger car 307 onto the transfer vehicle 318 at the missing portion 213, the wheel section 209 and the second wheel section 309 engage the first rails 203*a* and the relay rails 337 at the same time, respectively. Therefore, the car 307 can transfer from the first rails 203*a* to the second rails 203*b* in a more positive, continuous and smooth manner than in the aforesaid third embodiment. This contributes to an even smaller decrease in the speed of the car 307 transferring from the first rails 203*a* to the second rails 203*b*.

Thereafter, the aforesaid control device 243 couples the electric motor 245 to the upper wheels 221*a* by means of the clutch 247 and actuates the electric motor 245 to move the transfer vehicle 318 in the direction of arrow J and thus, the transfer vehicle is returned to its original position for cycling the same operations as those aforementioned.

Figure 22:
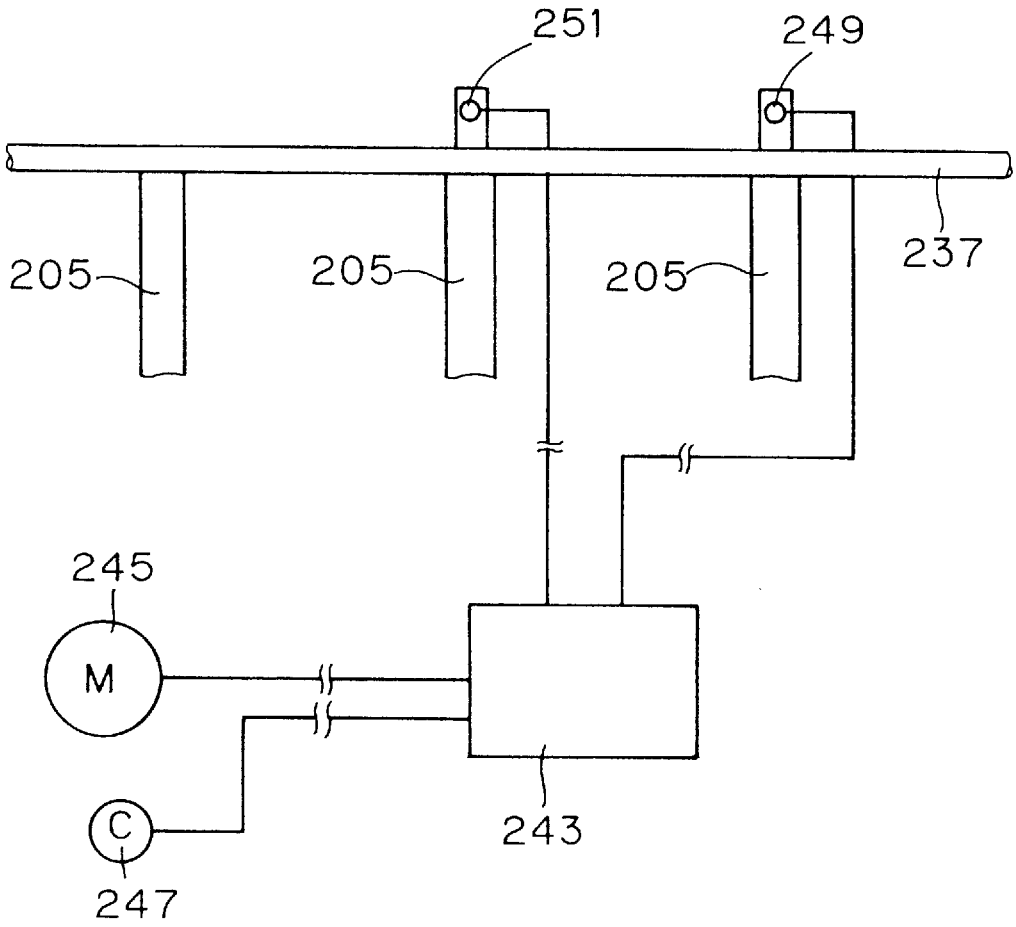
FIG.22 illustrates a control device as a modification of the third and fourth embodiments.

Additionally, as shown in FIG.22, the third or fourth embodiment may be arranged such that a first and a second detection sensors 249 and 251 are spaced a predetermined distance along the relay rails 237 or 337 and coupled to the control device 243. The control device 243, in turn, responds to a detection signal from the first detection sensor 249 for detecting a position of the passenger car 207 or 307, as well as to a detection signal from the second detection sensor 251 for calculating a traveling speed of the car 207 or 307 from a spacing and a detection time difference between the first and second detection sensors 249 and 251. Based on the traveling speed thus calculated, the control device 243 controls the electric motor 245 with clutch 247 for moving the transfer vehicle 218 or 318 in the direction of arrow K at the same speed with the car 207 or 307. A sensor such as a photoconductive sensor or the like may be used as the first and second detection sensors 249 and 251.

With such an arrangement, when the passenger car 207 or 307 has transferred to the transfer vehicle 218 or 318, the transfer vehicle 218 or 318 travels at the same speed as that of the car 207 or 307 and therefore, the car 207 or 307 is temporarily halted on the relay rails 237 or 337 due to the law of conservation of momentum. Incidentally, the above-mentioned operations can be assuredly controlled because the traveling speed of the car 207 or 307 is detected by the first and second detection sensors 249 and 251. Then after the transfer vehicle 218 or 318 is coupled with the second rails 203*b* to stop moving, the passenger car 207 or 307 transfers by inertia onto the second rails 203*b* at a predetermined speed. In this case, the halting mechanism 223 serves as a safety mechanism for preventing the overrun of the passenger car 207 or 307.

If, in this case, the passenger car 207 or 307 transfers from the first rails 203*a* onto the relay rails 237 or 337 at a substantially constant speed, an arrangement may be made such that the second detection sensor 251 is eliminated and the control device 243 is adapted to respond to a detection signal from the first detection sensor 249 to control the electric motor 245 for moving the transfer vehicle 218 or 318 at a preset speed which is equal to the speed of the car 207 or 307.

Figure 23:
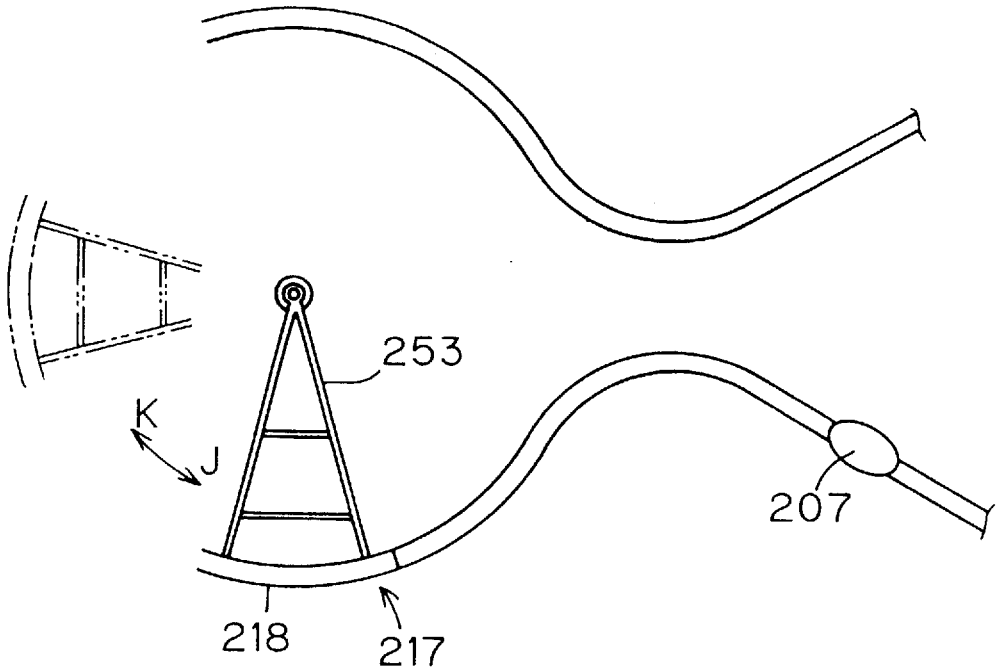
FIG.23 schematically illustrates an amusement ride that is a modification of the third and fourth embodiments.
Figure 24:
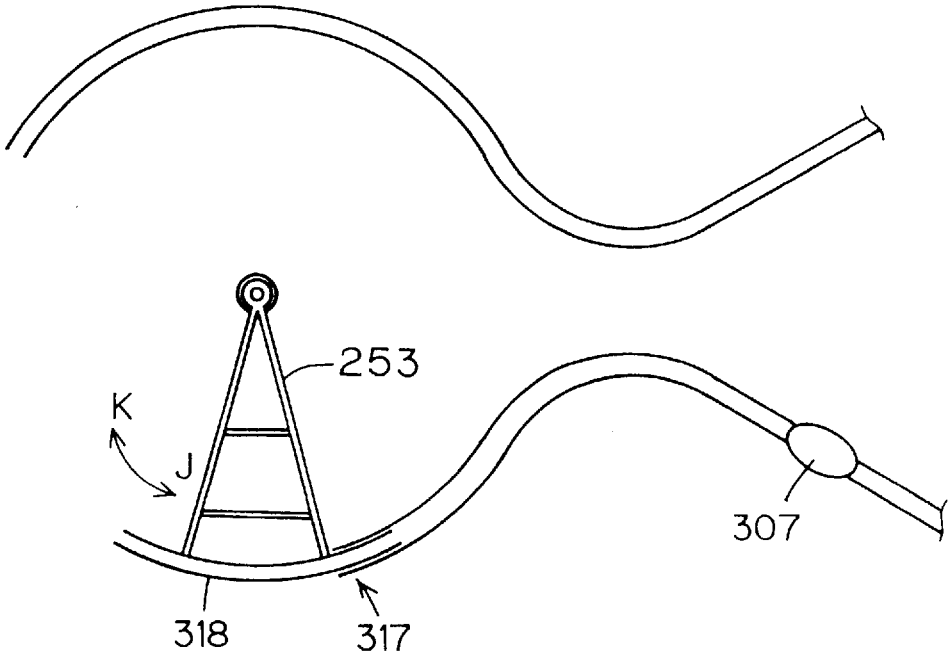
FIG.24 schematically illustrates an amusement ride that is a modification of the third and fourth embodiments.

An alternative arrangement is also possible, as shown in FIGS. 23 and 24, wherein the aforesaid electric motor 245 with the clutch 247 is replaced by a driving arm 253 coupled to the transfer vehicle 218 or 318 and a drive motor (not shown) for driving this driving arm 253, the driving arm 253 and drive motor causing the transfer vehicle 218 or 318 to move in the direction of arrow K–J.

Figure 25:
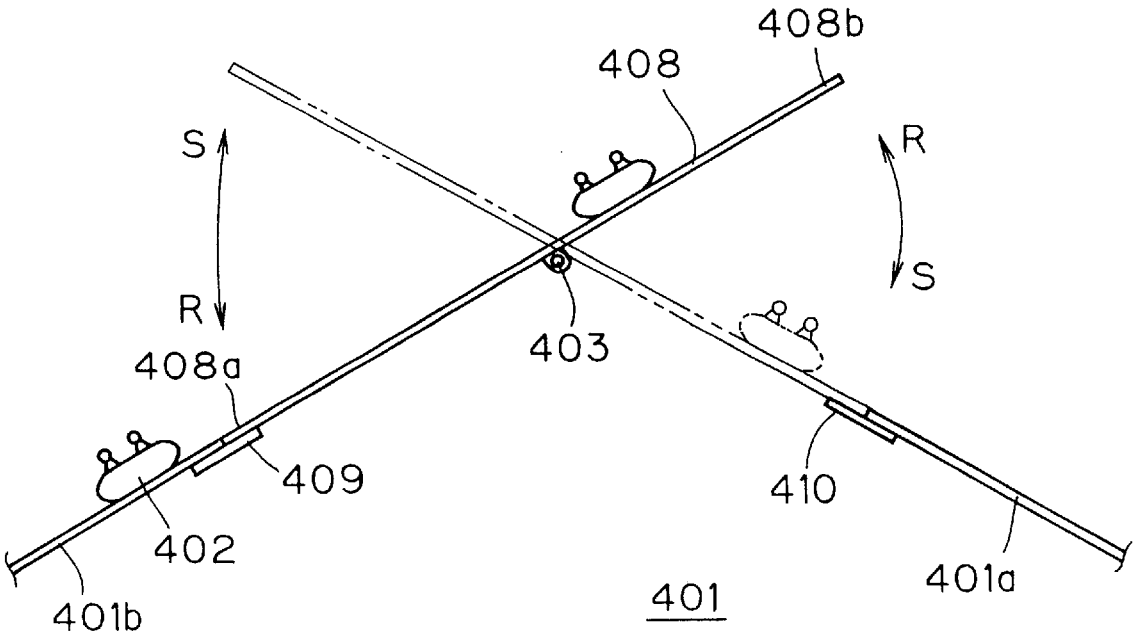
FIG.25 schematically illustrates an amusement ride according to a fifth embodiment of the invention.

Now with reference to FIG.25, description will be given of a fifth embodiment of the present invention. As it is seen in FIG.25, a ride of the embodiment comprises a track 401*b* on the car-releasing side of the track 401, a track 401*a* on the car-receiving side of the track 401, and a transfer track 408 for transferring a passenger car 402 from the track 401*b* to the track 401*a*.

The aforesaid transfer track 408 is movable in the direction of arrow R–S as pivoted on a bearing 403 or the like at an intermediate portion between the opposite ends 408*a* and 408*b* thereof. When moved in the direction of arrow R, the end portion 408*a* is connected with the track 401*b* whereas the end portion 408*b* is connected with the track 401*a* when moved in the direction of arrow S. The transfer track 408 is pivotally supported at a point which is shifted from the central point toward the end portion 408*b*. Hence, as balanced only by its own weight, the transfer track 408 is heavier on side of the end portion 408*a* from the pivotal center to be inclined toward arrow R. There are provided a support plate 409 at a place where the end portion 408*a* is connected with the track 401*b* and a support plate 410 at a place where the end portion 408*b* is connected with the track 401*a*, respectively.

In this ride, the passenger car 402 traveling on the track 401*b* proceeds on the transfer track 408, passing the aforesaid pivotal point. At this time, the weight balance of the transfer track 408 is lost because the weight of the car 402 is added to the weight of the side of the end portion 408*b*, which, in turn, exceeds the weight of the side of the end portion 408*a*. As a result, the end portions 408*a* and 408*b* are moved in the direction of arrow S whereby the end portion 408*b* comes into contact with the support plate 410 for support and thus is connected to the track 401*a*. In this process, the passengers can experience a feeling of zero gravity associated with the descent of the car 402. Subsequently, the car 402 continues to travel, transferring from the transfer track 408 to the track 401*a*. Upon completion of the transfer of the car 402, the weight balance of the transfer track 408 is lost again so that the end portions 408*a* and 408*b* are moved in the direction of arrow R. This brings the end portion 408*a* into contact with the support plate 409 for support thereby connecting it with the track 401*b* and thus, the transfer track 408 is returned again to its original position.

It is more desirable that the aforesaid support plates 409 and 410 are provided with a damper mechanism for damping an impact of the abutment of the transfer track 408 against these support plates. Alternatively, there may be provided a drive unit for moving the transfer track 408 in the direction of arrow R–S and a sensor for detecting a position of the passenger car 402, which drive unit is to be actuated according to a position of the car 402 for moving the transfer track 408 in the direction of arrow R–S.

Figure 26:
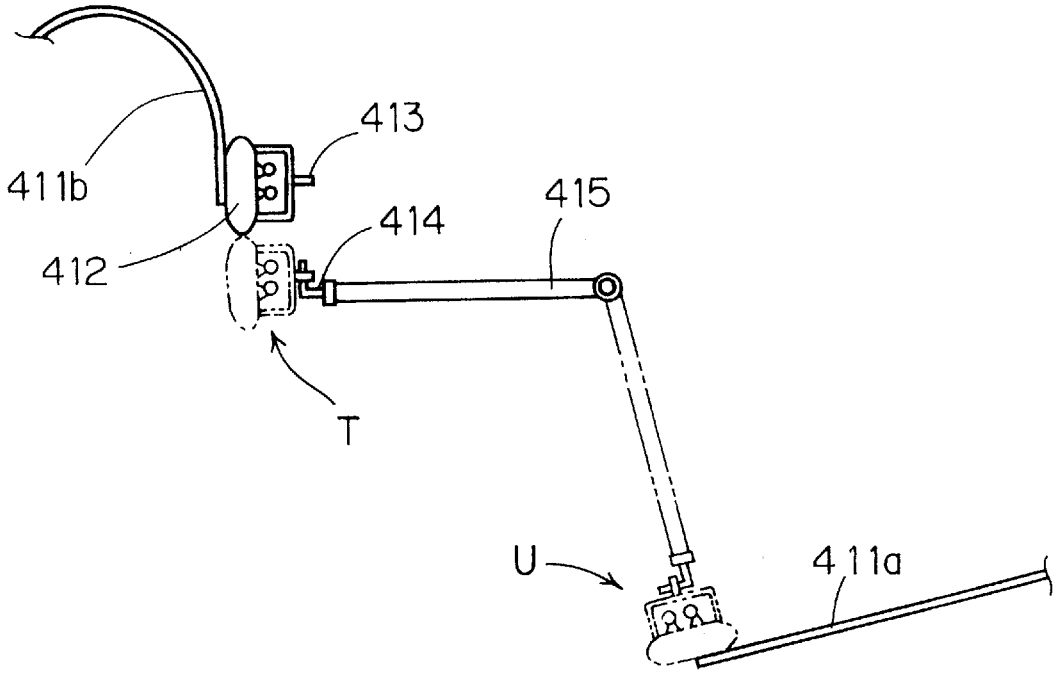
FIG.26 schematically illustrates an amusement ride according to a sixth embodiment of the invention.

Now referring to FIG.26, description will be given of a sixth embodiment of the present invention. As shown in FIG.26, the ride of this embodiment comprises a track 411*b* on the car-releasing side of the track 411, a track 411*a* on the car-receiving side of the track 411, a passenger car 412 provided with a first engageable portion, and a transfer arm 415 provided with a second engageable portion to engage the first engageable portion for transferring the car 412 from the track 411*b* to the track 411*a*. As illustrated by the figure, the track 411*b* is bent downward at an end portion to terminate in a downward slope. The track 411*a* is spaced from the track 411*b* a predetermined distance. An annular ring, for example, may be employed as the first engageable portion 413 of the car 412 whereas a hook, for example, may be employed as the second engageable portion 414, which is disposed at one end of the transfer arm 415. The transfer arm 415 has the other end thereof pivotally supported for swinging motion between a position (T-point) for the second engageable portion 414 to receive the car 412 moving from the track 411*b* and a position (U-point) to deliver the car 412 onto the track 411*a*. With this system, the passenger car 412 traveling on the track 411*b* falls from the termination of the track 411*b* to T-point thereby bringing the first engageable portion 413 into engagement with the second engageable portion 414 of the transfer arm 415. Gaining inertia from the car 412, the transfer arm 415 swings to transfer the car 412 to a point labelled "U" in FIG.26, thus delivering the car onto the track 411*a*. In this process, the passengers can experience the mixed thrilling sensations of a feeling of zero gravity, fear and an impression of speed. Thereafter, the passenger car 412 continues to travel on the track 411*a* by inertia.

As to the engagement relation between the first and second engageable portions 413 and 414, it is desirable to provide a safety mechanism for preventing an easy release of the engageable portions. In such a case, a mechanism for releasing the safety mechanism may be provided at point U. Additionally, it is desirable to provide a guide mechanism at point U for streamlining the transfer of the car 412 onto the track 411*a*.

There may be provided a drive unit for moving the transfer arm 415 between points T and U and a sensor for detecting a position of the passenger car 412, the drive unit being actuated based on a position of the car 412 to move the transfer arm 415 between points T and U. An alternative arrangement may be made such that a detection sensor is adapted to detect a traveling speed of the car 412 moving on the track 411*b* so as to synchronize the transfer arm to pivot at the same speed with that of the car 412 moving on the track 411*b*, thus bringing the first engageable portion 413 of the car 412 into engagement with the second engageable portion 414 of the transfer arm 415 for transfer of the car 412 onto the track 411*a*.

Figure 27:
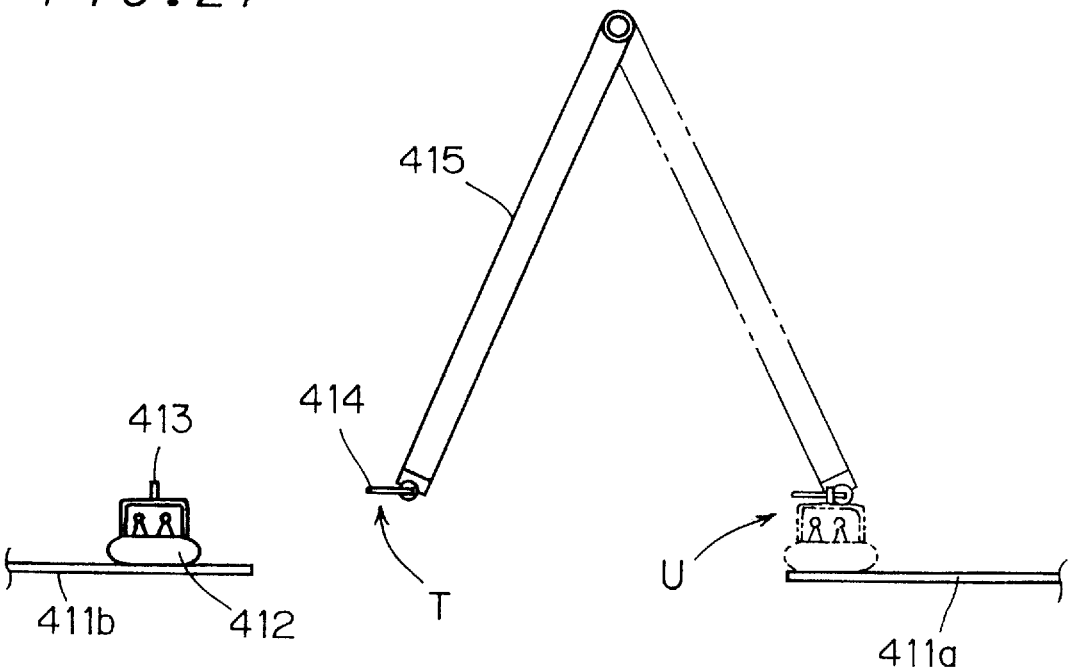
FIG.27 schematically illustrates an amusement ride that is a modification of the sixth embodiment.
Figure 28:
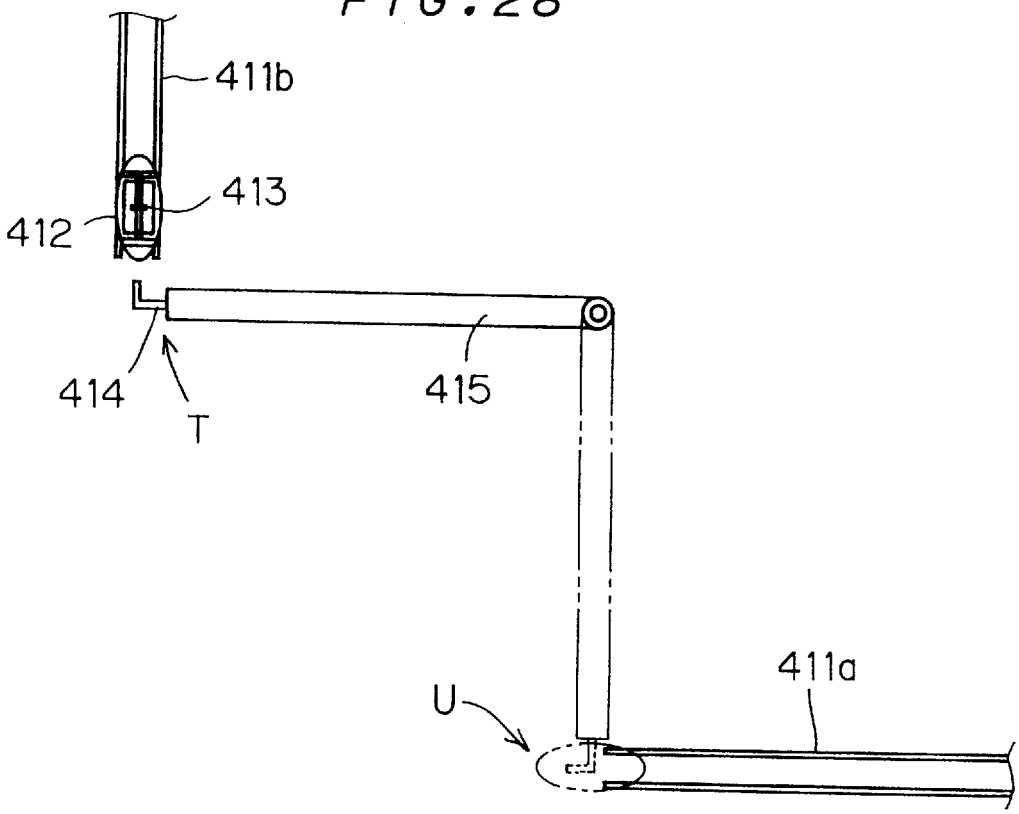
FIG.28 schematically illustrates another amusement ride that is a modification of the sixth embodiment.

It is to be noted that the aforesaid T-point is located below the termination of the track 411*b* in this embodiment, but it may be located at the termination of the track 411*b*. Additionally, the tracks 411*a* and 411*b* may be laid in parallel, as shown in FIG.27. It is also possible to arrange such that the passenger car 412 is adapted to travel in a horizontal plane.

It is to be noted that although the transfer arm 415 is adapted to pivot about the pivotal center in this embodiment, the arrangement is not limited to this. Alternatively, the whole body of the transfer arm 415 may be adapted to move.

Figure 29:
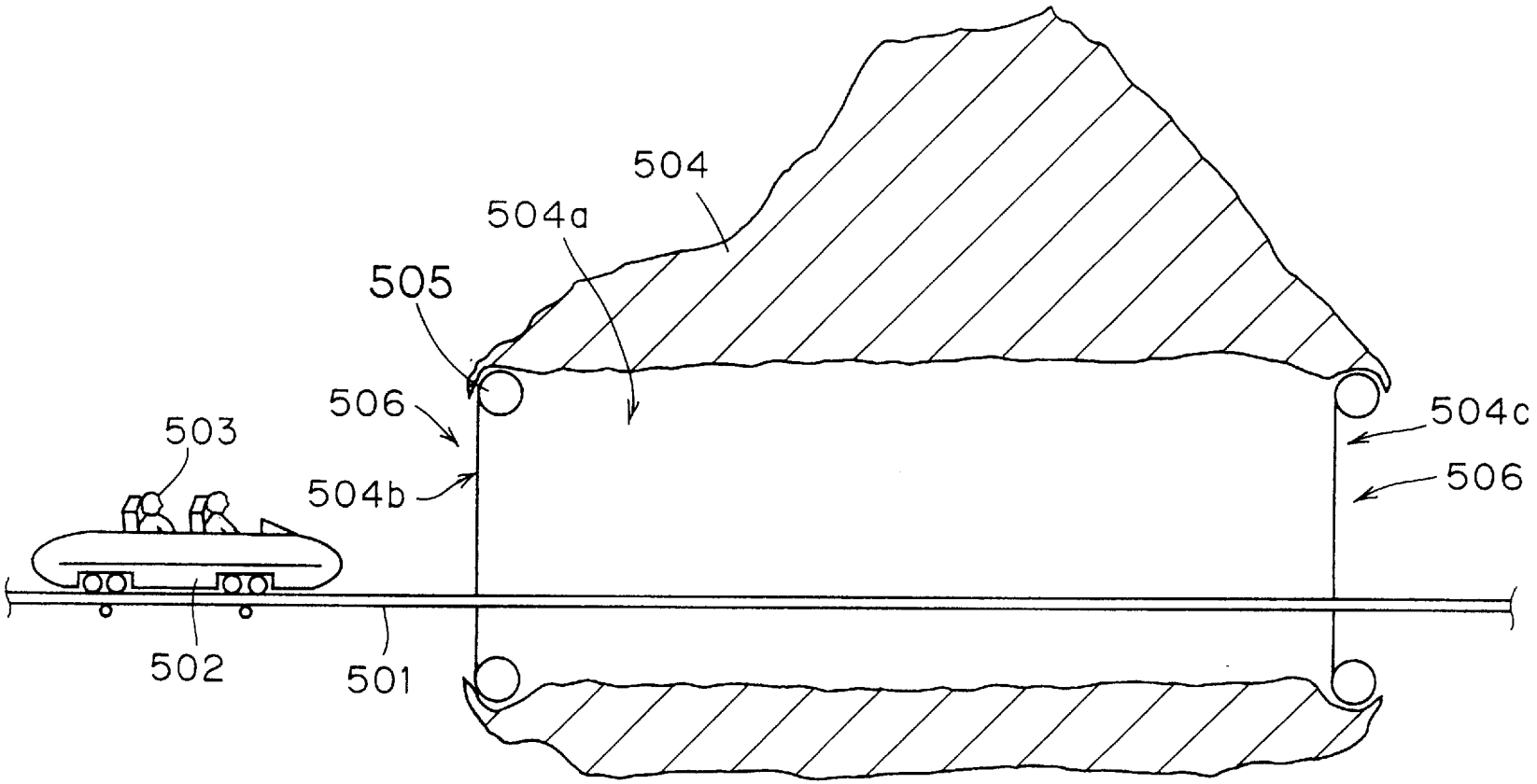
FIG.29 is a sectional view for illustrating an amusement ride according to a seventh embodiment of the invention.

Now referring to FIGS.29 and 30, description will be given of a seventh embodiment of the present invention. As seen in FIG. 29, a ride of this embodiment comprises a track 501 having a given trajectory (a part thereof is illustrated in the figure), a passenger car 502 with passengers 503, for traveling on the track 501, an exterior structure 504 attached to a portion of the track 501, and a roll member 505 and a feeding section 506 attached to the exterior structure 504. A place where the exterior structure 504, roll member 505 and feeding section 506 are attached to the track 501 is not particularly limited and such components may be provided at several places.

Tracks used in various types of rides are applicable to the track 501, as mentioned above, but in this embodiment, track 501 is comprised of two rails supported by a known structure (not shown in the figure). Similarly, passenger cars used in various types of rides are applicable to the passenger car 502 but the car 502 of the embodiment comprises a car body 502*a* and wheels 502 mounted to the bottom of the car body, as shown in FIG.30.

As seen in FIG.29, the exterior structure 504 is formed of styrofoam and other building materials in imitation of a mountain and is supported by a suitable support structure (not shown). The exterior structure is formed with a passage bore 504*a* extending therethrough from one side to the opposite side thereof wherein the track 501 is laid. In addition to the aforesaid mountain, the exterior structure may have other forms imitating various natural objects such as a rocky mountain, a fall, a forest, a huge animal and the like, or of various artificial objects such as buildings, walls, monsters and the like.

Figure 30:
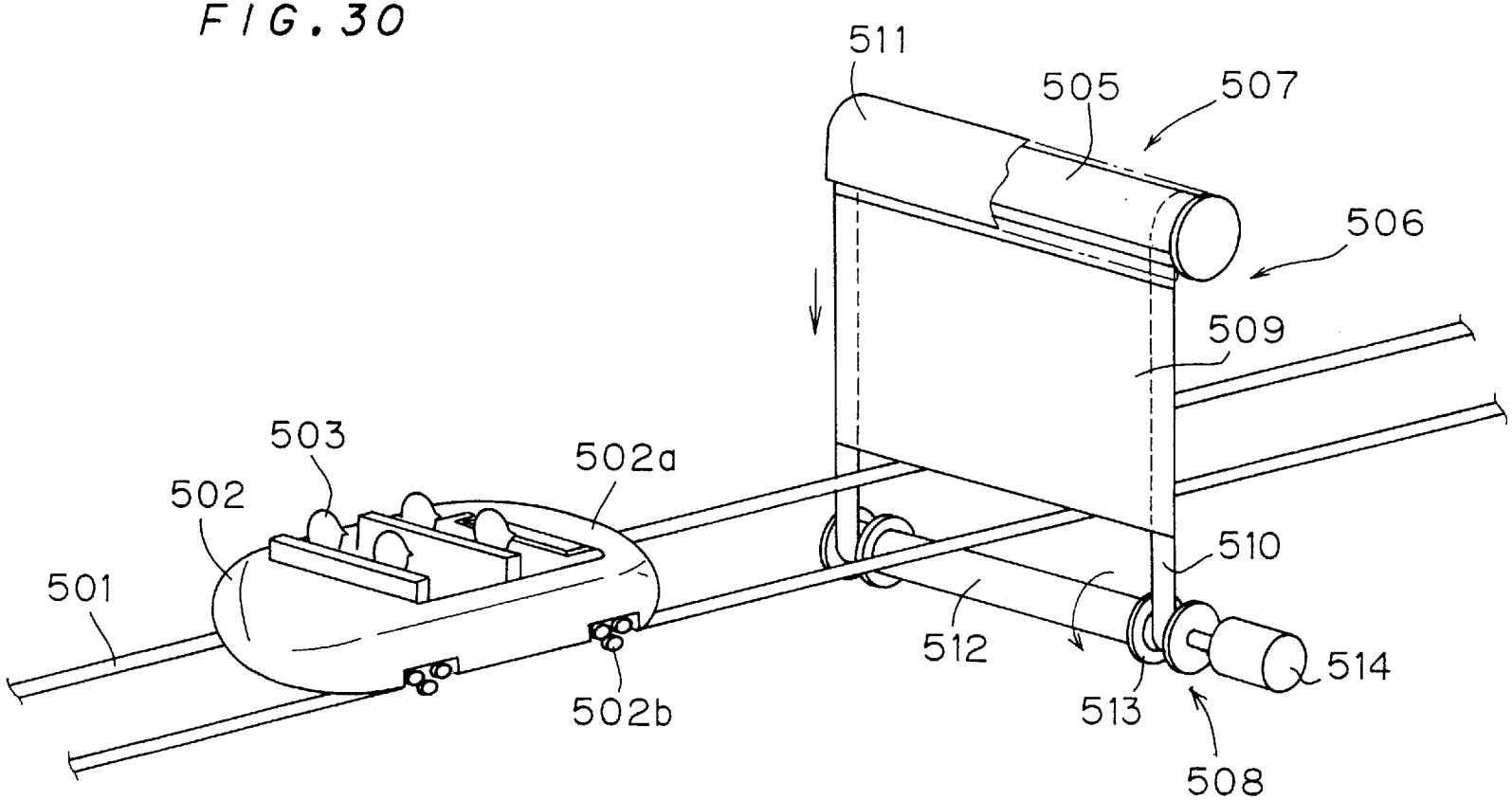
FIG.30 is a perspective view for illustrating a principal portion of the amusement ride of the seventh embodiment.

As shown in FIG.30, the aforesaid roll member 505 comprises a pair of continuous flat belts 510 and a plurality of parallel sheet-like traveling course closing members 509 extending between and secured to the belts, the traveling course closing members 509 wound around a shaft (not shown) in the form of a roll. The parallel traveling course closing members 509 are spaced from each other by a predetermined distance in this embodiment, but they may be disposed adjacent to each other.

As seen in FIG.30, the aforesaid traveling course closing member 509 comprises a rectangular sheet-like member which is formed of a fragile material, as already described, to be readily broken by a predetermined intensity of impact, or an impact of collision of the car traveling at a predetermined speed in this embodiment. The traveling course closing member of this embodiment is formed of a paper material. The traveling course closing member 509 carries at least on one surface thereof a picture of a scene such as rock which is associated with the exterior structure 504 in the form of a mountain. Similarly to the exterior structure 504, examples of such a picture includes a variety of scenes. An electrophotographic print is also usable. The traveling course closing member 509 may be provided with perforation at the inner sides of the portions secured to the belts so that the traveling course closing member may be broken from the perforation.

Various types of continuous elements may be used as the flat belts 510, as aforementioned. In this embodiment, the two pieces of flat belts 510 face opposite to each other across the track 501, so as not to interfere with the passage of the car 502.

The feeding section 506 comprises a pay-out section 507 and a take-up section 508. The pay-out section 507 removably and rotatably carries the shaft (not shown) of the roll member 505 and is supported by the exterior structure 504 or support structure (not shown). The pay-out section 507 is also provided with a cover 511 for wrapping the roll member 505 therein.

The take-up section 508 comprises a take-up shaft 512, a support (not shown) for removably and rotatably carrying the take-up shaft 512, a drive motor 514 coupled to the take-up shaft 512 for causing the rotation of the shaft 512 in the direction of the arrow in the figure, a sensor (not shown) for detecting the traveling course closing member 509 assuming a close position, and a control device (not shown) responsive to a detection signal from the sensor to actuate the drive motor 514. The take-up shaft 512 is provided with pulleys at opposite ends thereof which take up the flat belts thereabout. Incidentally, usable as the aforesaid sensor (not shown) are a variety of sensors such as photoconductive sensors, limit switches or the like.

In this embodiment, the pay-out section 507, roll member 505 and take-up section 508 are disposed at an entrance 504*b* and an exit 504*c* of the passage bore 504*a* in the exterior structure 504, respectively (See FIG.29).

According to this ride, the passenger car 502 travels on the track 501 to collide with the traveling course closing member 509 disposed at the entrance 504*b* of the passage bore 504*a*. In this process, the passengers may continue to see the traveling course closing member 509 to the moment just before the car 502 collides with the traveling course closing member 509. Thus, they may experience the mixed thrilling sensations of fear of collision and an impression of speed of the car 502. The exterior structure 504 formed in imitation of a mountain and traveling course closing member 509 carrying the picture of rock produces a realistic impression of a collision, which increases the intensity of the fear of collision by the passenger 503. On the other hand, upon collision of the car 502, the traveling course closing member 509 is readily broken to open up the track because it is formed of paper or like material. Hence, the passenger car 502 continues to travel on the track 501.

Upon breakage of the traveling course closing member 509, the sensor (not shown) of the take-up section 508 is turned off. In response to this, the control device (not shown) actuates the drive motor 514 in a predetermined period of time, that is, after the car 502 has left the close position, whereby the flat belts 510 are taken up for guiding the succeeding traveling course closing member 509 to the close position. Subsequently when the aforesaid sensor (not shown) detects the traveling course closing member 509, the control device (not shown) responds to a signal indicative of the detection to stop the operation of the drive motor 514. Thus, a new traveling course closing member 509 is set at the close position. In this manner, the traveling course closing members 509 are fed to the traveling course very quickly and continuously. Incidentally, it is also possible to provide a sensor for detecting a passage of the car 502 and supplying a signal indicative of such passage, the signal triggering the operation of the drive motor 514.

Subsequently, the passenger car 502 approaches the exit 504*c* of the exterior structure 504*c* where the same operations as the above are carried out. In the case of a darkened passage bore 504*a*, the passengers may be surprised as they are suddenly released in the open. On the other hand, if the interior of the passage bore 504*a* is illuminated and the traveling course closing member 509 carries a suitable picture thereon, the passengers may continue to enjoy a thrilling sensation.

When all the traveling course closing members 509 have been rolled out, the unillustrated shaft of the roll member 505 and the take-up shaft 512 of the take-up section 508 are replaced. The traveling course closing members 509 of this embodiment are packed in the form of a roll, and therefore, are easy to carry and to be replaced.

Obviously, the exterior structure 504 is not an essential element for offering thrills to the passengers although this embodiment utilizes the exterior structure 504 to produce a realistic visual effect. Additionally, cutters may be provided adjacent the take-up section on lateral opposite inner sides of the two flat belts 510, respectively, which cutters cut off from the flat belts 510 a broken traveling course closing member 509 as it is taken up. This allows the flat belts 510 to be smoothly taken up.

Figure 31:
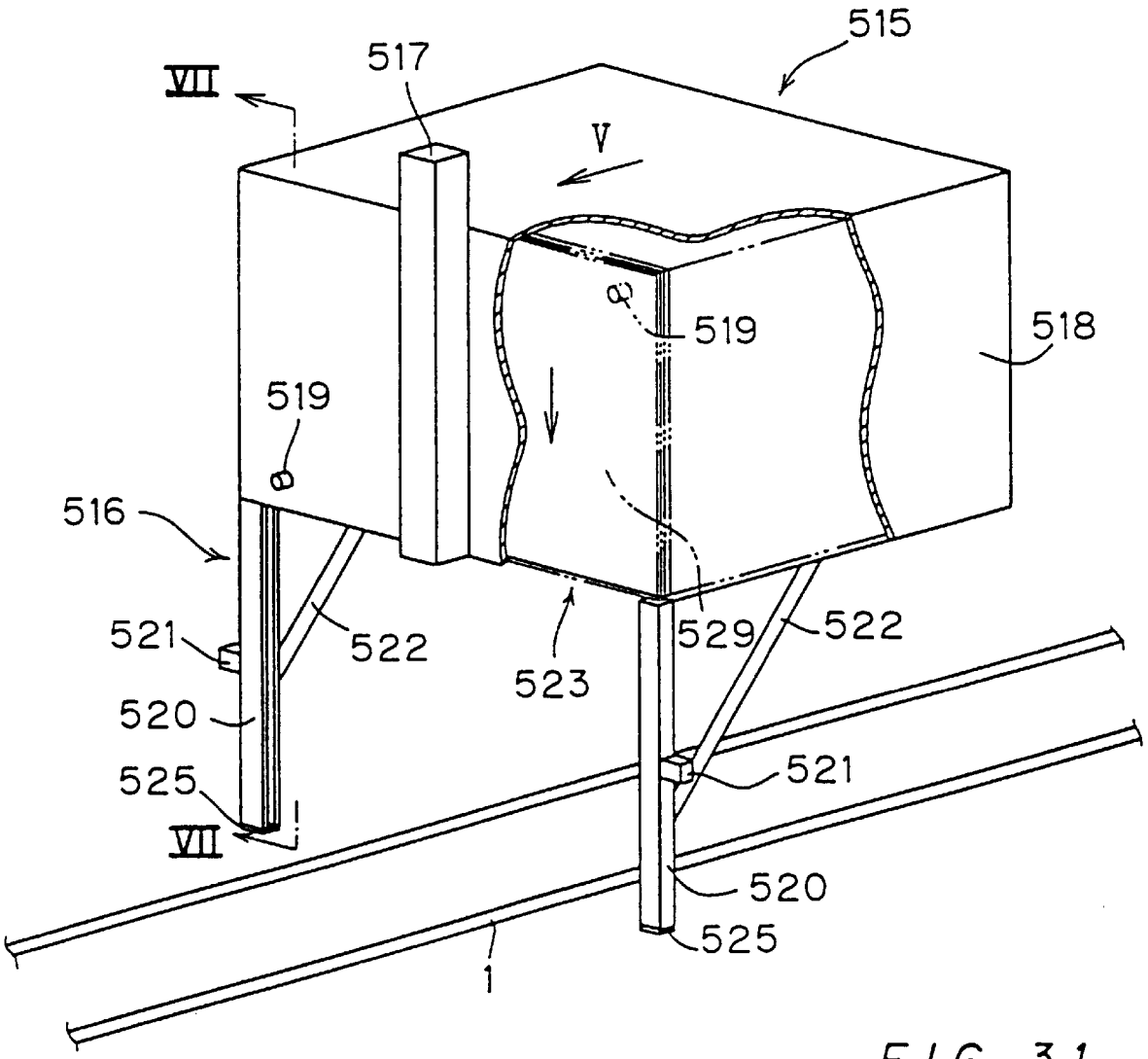
FIG.31 is a perspective view for illustrating a principal portion of an amusement ride according to an eighth embodiment of the invention.

Next with reference to FIGS. 31 and 32, description will be given of an eighth embodiment of the present invention. As shown in FIG. 31, a ride of this embodiment comprises a traveling course closing member 529, a stock section 515 disposed above the track 501 and containing therein the traveling course closing members 529, a guide section 516 disposed under the stock section 515 for guiding a traveling course closing member 529 to the closed position, a feeding mechanism 517 for pushing out a traveling course closing member 529 from the stock section 515 to the closed position, a passage detection sensor (not shown) for detecting the car 502 passing by the close position, and a control device (not shown) for controlling the operations of the respective sections.

As described above, a variety of materials may be used for the traveling course closing member 529 but this embodiment employs a styrofoam plate-like member, on one surface of which an object such as rock is depicted.

The stock section 515 is supported by a support structure (not shown) and comprises a bin 518 for containing the traveling course closing members 529 therein, a biasing mechanism (not shown) for biasing the contained traveling course closing members 529 in the direction of arrow V, and an edge position sensor 519 disposed on a surface of the bin 518 on an end side in a direction indicated by arrow V of the figure. Usable as the biasing mechanism (not shown) is a hydraulic cylinder, air cylinder, spring or the like. A variety of sensors, such as a contactless switch, limit switch or the like, can be used as the edge position sensor 519. The bin 518 includes a feed port 523 for feeding a traveling course closing member 529 in the bottom surface at an edge in a direction indicated by arrow V, the feed port 523 having a width slightly greater than the lower side of the traveling course closing member 529.

Figure 32:
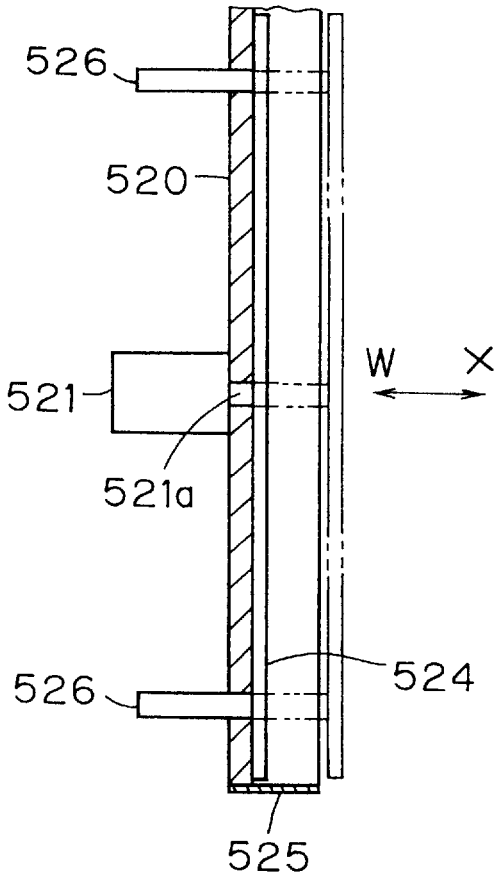
FIG.32 is a sectional view taken on line Y—Y of FIG.31.

The guide section 516 comprises a pair of slide guides 520 disposed below opposite ends of the feed port 523 in the bin 518, stays 522 for supporting the slide guides 520 with one end thereof secured to the bin 518 and the other end thereof secured to the slide guide 520, respectively, pushing cylinders 521 disposed at the respective slide guides 520 as shown in FIG.32, and pushing members 524 secured to the respective distal ends of piston rods 521*a* of the pushing cylinders 521. The slide guides 520 comprise members having a U-shaped form and opposing each other at the concave portions thereof, and have stoppers 525 at the lower ends thereof, respectively. The pushing member 524 comprises a stick-like member of a predetermined length contained within the concave portion of each slide guide 520 and provided with guide bars 526 adjacent both ends of the pushing member, the guide bars supported by the slide guide 520. The pushing member 524 is caused by the pushing cylinder 521 to move in the direction of arrow W–X as stably supported by the slide guide 520.

The aforesaid feeding mechanism 517 comprises an air cylinder. A rodless cylinder is employed by this embodiment but various other drive means, such as a hydraulic cylinder, a combination of motor and driving screw or the like, may be used.

The aforesaid control device (not shown) is responsive to a detection signal from the passage detection sensor (not shown) and edge position sensor 519 to control the biasing mechanism (not shown), pushing cylinder 521 and feeding mechanism 517.

According to this ride, the control device (not shown) first actuates the biasing mechanism (not shown) to move a traveling course closing member 529 in the direction of arrow V and stops driving the biasing mechanism in response to the edge position sensor 519 detecting the traveling course closing member 529 set at the feeding position.

Subsequently, the control device (not shown) drives the feeding mechanism 517 in the direction of the downward arrow in the figure for feeding a traveling course closing member 529 from the feed port 523 of the bin 518 to the slide guides 520. During the operation, the pushing members 524 are moved in the direction of arrow W so that the traveling course closing member 529 may be guided at both side ends thereof by the slide guides 520 to a position to close the traveling course of the passenger car 502. At this time, the passengers may experience the mixed thrilling sensations of a fear of collision and an impression of speed of the car 502.

Then, the passenger car 502 approaching the close position breaks through the traveling course closing member 529. In response to the passage detection sensor (not shown) detecting the passage of the car 502, the control device (not shown) causes the pushing cylinders 521 and pushing members 524 to move in the direction of arrow X to thereby discharge the residue of the traveling course closing member 529 from the concaves of the slide guides 520. Thereafter, the control device causes the pushing cylinders 521 and pushing members 524 to move in the direction of arrow W while actuating the biasing mechanism (not shown) to feed a traveling course closing member 529 to the feed port 523 in the bin 518. By cycling the above operations, the traveling course closing members 529 may be continuously fed to the close position.

In the seventh and eighth embodiments, a similar effect may be attained by projecting an image from a projector on one surface of the traveling course closing member 509 or 529, instead of providing a picture of a scene on one surface thereof. The eighth embodiment may also be arranged such that a plurality of traveling course closing members 529 contained in the bin are cut off one by one to be fed to the close position by means of a robot which may be of an orthogonal type or an articulated type, or operate hydraulically or electrically.

Figure 33:
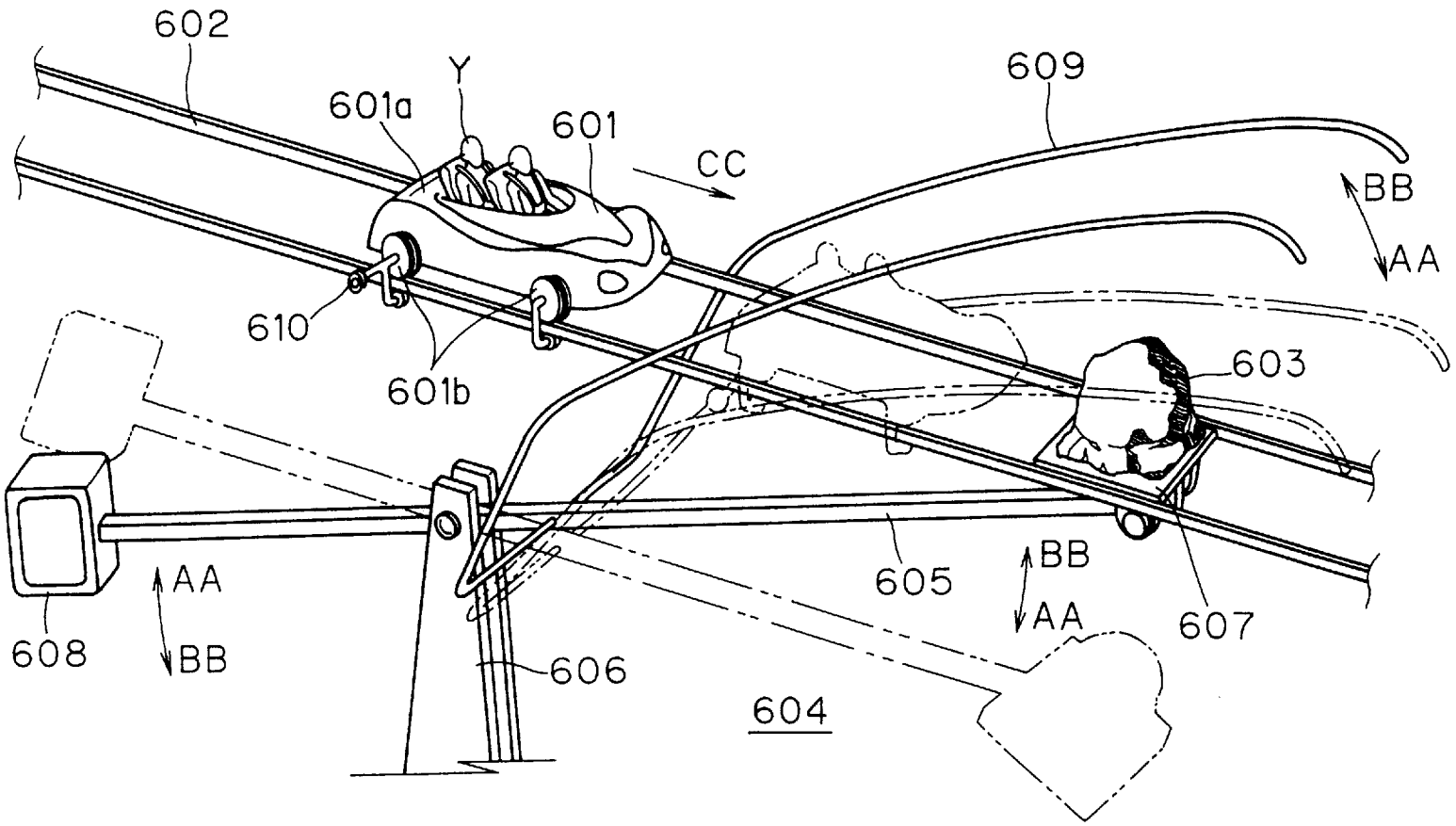
FIG.33 is a perspective view for illustrating an amusement ride according to a ninth embodiment of the invention.

Now referring to FIGS. 33 through 38, description will be given of a ninth of the present invention. As shown in FIG. 33, a ride of this embodiment comprises a track 602 having a given trajectory, a passenger car 601, with passenger Y, for traveling on the track 602, an obstacle 603 disposed adjacent the track 602, and a drive mechanism 604 for advancing/retreating the obstacle 603 with respect to a traveling course of the passenger car 601 along the track 602.

As described above, tracks used in various types of amusement rides may be employed as the aforesaid track 602. As shown in FIG.33, the track 602 of the embodiment comprises a pair of rails supported by the known structure (not shown). Likewise, vehicles used in various types of the amusement rides may be used as the passenger car 601. The car 602 of the embodiment comprises a car body 601*a* and wheels 601*b* mounted to the bottom of the car body 601*a*, as illustrated by FIG.33.

As shown in FIG.33, the drive mechanism 604 comprises a swinging arm 605 disposed below and along the track 602, a support base 606 for pivotally supporting the swinging arm 605 in the direction of arrow AA–BB, a mounting base 607 disposed at one end of the swinging arm 605, a weight 608 disposed at the other end of the swinging arm 605, an engageable arm 609 mounted to the swinging arm 605, and engaging rollers 610 mounted to the passenger car 601.

The support base 606 carries the swinging arm 605 on the shaft, as allowing the arm to swing in the direction of arrow AA–BB, as mentioned above. The mounting base 607 serves to fixedly support the obstacle 603 whereas the weight 608 is operative to bias the swinging arm 605 in the direction of arrow BB. The weight 608 has such a weight that the total weight of the weight-side swinging arm 605 and the weight 608 exceeds the total weight of the mounting base-side swinging arm 605, mounting base 607, obstacle 603 and engageable arm 609. Thus, as shown in FIG.33, the swinging arm 605 is inclined toward the direction of arrow BB to locate the obstacle 603 in the traveling course of the car 602.

As shown in FIG.33, the engageable arm 609 comprises two substantially L-shaped members, the member having one end (the short portion of the L) secured to the swinging arm 605 on the side of the mounting base 607 and the other end positioned above the traveling course of the track 602. The respective longer lengths of the engageable arm 609 extend abreast both sides of the track 602 with one portion thereof positioned below the track 602 and the other portion thereof positioned above the track 602. That is, the longer lengths of the engageable arm 609 is inclined upward along the direction in which the passenger car 601 travels. The engaging rollers 610 are rotatable about the axis and mounted to opposite lateral portions of the car 601 (to rear wheels 601*b* in this embodiment). As the car 601 travels along, the engaging rollers come into engagement with the engageable arm 609.

Dummies or physical objects of various forms may be used as the aforesaid obstacle 603 and a dummy rock is employed by this embodiment. By way of precaution against a case where the passenger car 601 should collide with the obstacle 603, the obstacle 603 is formed of a fragile styrofoam material while the position of the mounting base 607 when the swinging arm 605 is moved in the direction of arrow BB is so set as to prevent the passing car 601 from colliding with the mounting base 607.

According to this ride, the drive mechanism 604 is normally in a state wherein the weight 608 acts to move the swinging arm 605 in the direction of arrow BB thereby locating the obstacle 603 on the traveling course of the passenger car 601, as seen in FIG.33. When the car 601 with the passengers seated therein proceeds in the direction of arrow CC to approach the engageable arm, the passengers may see the obstacle 603. This offers the passengers the mixed thrill of fear of a collision and an impression of speed of the running car.

The passenger car 601 proceeding further in the direction of arrow CC brings the engaging rollers 610 into engagement with the engageable arm 609, or into abutment thereagainst to thereby push the engageable arm 609 downward. The working force affects the swinging arm 605 to which the engageable arm 609 is bonded, thereby turning the swinging arm 609 in the direction of arrow AA. As the car 601 proceeds, the obstacle 603 is moved in the direction of arrow AA and thus collision of the car 601 with the obstacle 603 is avoided.

When the car 601 proceeds further in the direction of arrow CC to thereby disengage the engaging rollers 610 from the engageable arm 609, the swinging arm 605 is caused by the weight 608 to move in the direction of arrow BB to return to its original position.

Figure 34:
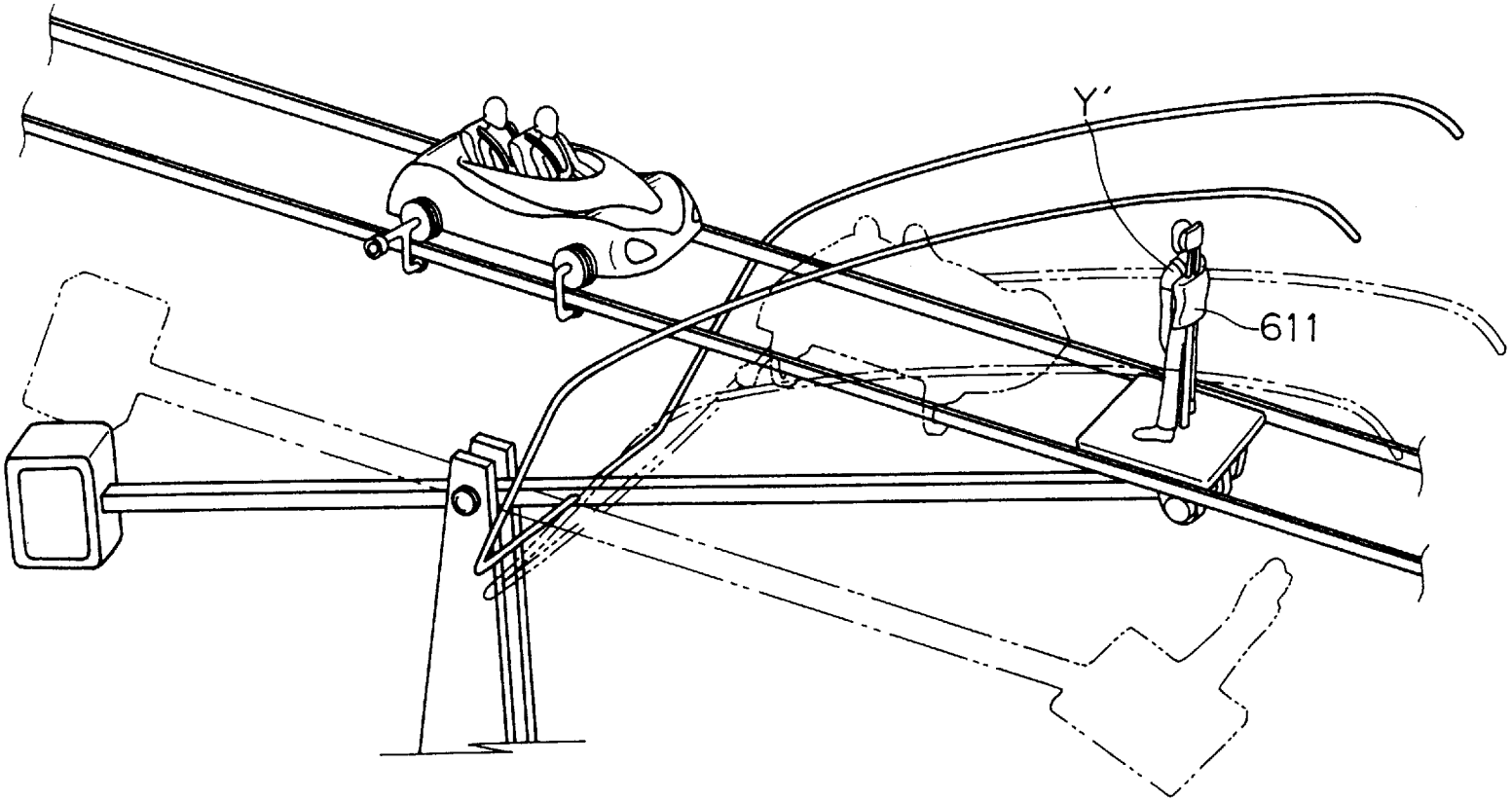
FIG.34 is a perspective view for showing another example of the obstacle of the ninth embodiment.

Although this embodiment utilizes a dummy rock as the obstacle 603, as mentioned above, the obstacle 603 may be replaced by another passenger Y' held on the mounting base 607, as seen in FIG.34. With this arrangement, this passenger can experience the fear of a collision. In this case, it is desirable to provide a holding mechanism 611 for securely holding the passenger onto the mounting base 607.

Figure 35:
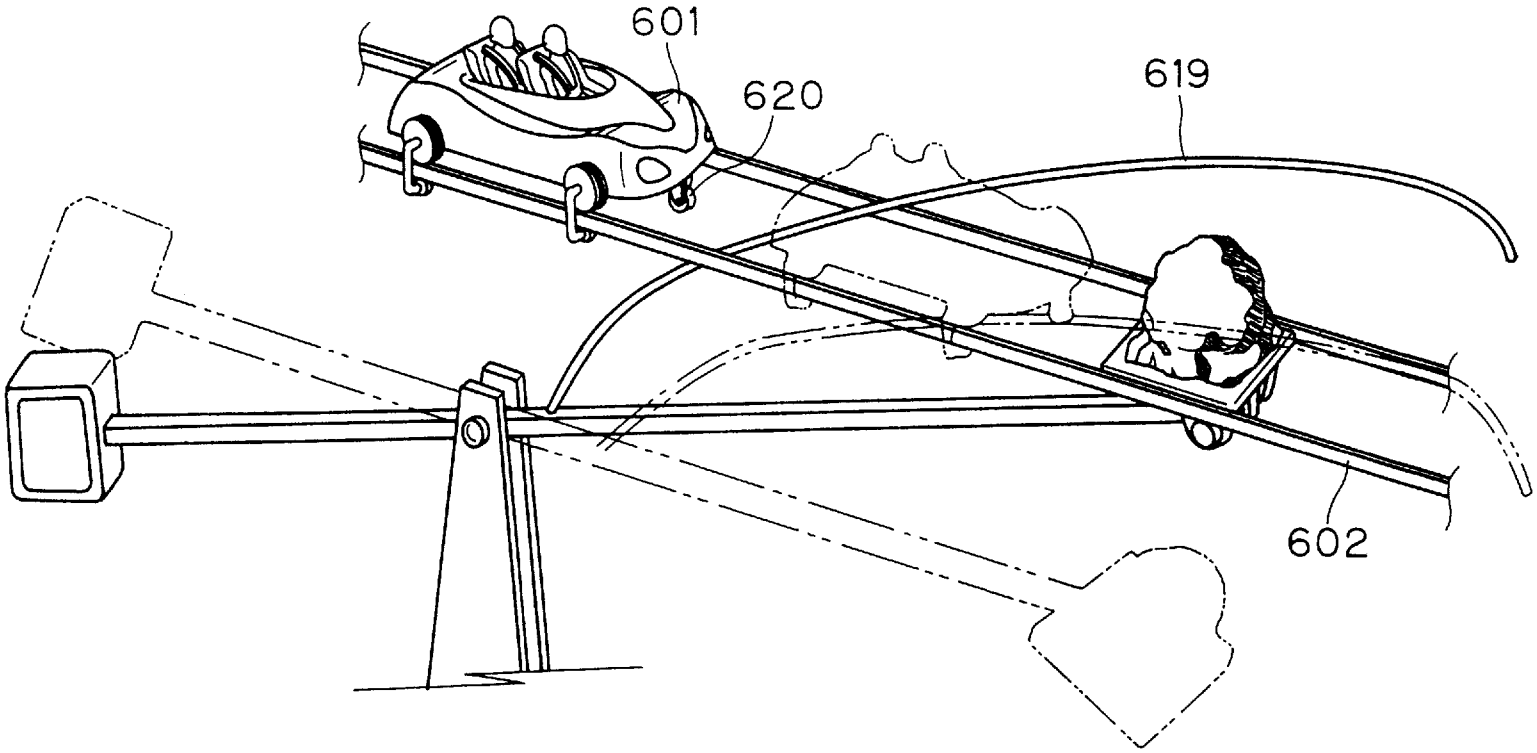
FIG.35 is a perspective view of a modification of the amusement ride of the ninth embodiment.

In this embodiment, the two engageable arms 609 are provided abreast the both sides of the rail track 602 but the arrangement should not be limited to the above. As seen in FIG.35, one engageable arm 619 may extend centrally between the rail track 602 whereas the passenger car 601 may be provided with an engaging roller 620 at the front portion thereof.

Although not particularly illustrated, the aforesaid drive mechanism 604 may be arranged in a vertically symmetrical manner relative to that shown in FIG. 33 or 35. More specifically, the swinging arm 605, support base 606, mounting base 607 and obstacle 603 are disposed above the rail track 602, the obstacle 603 entering the traveling course of the passenger car 601 from above. In this case, the weight 608 is not necessary because the obstacle 603 descends into the traveling course of the car 601 by gravity. The engaging rollers 610 are required to be disposed at suitable place on the car 601 for ensuring a positive engagement with the engageable arm 609. Alternatively, the drive mechanism 604 may be disposed laterally of the rail track 602 in a position turned 90° with respect to the position in FIG. 33 or 35.

Figure 36:
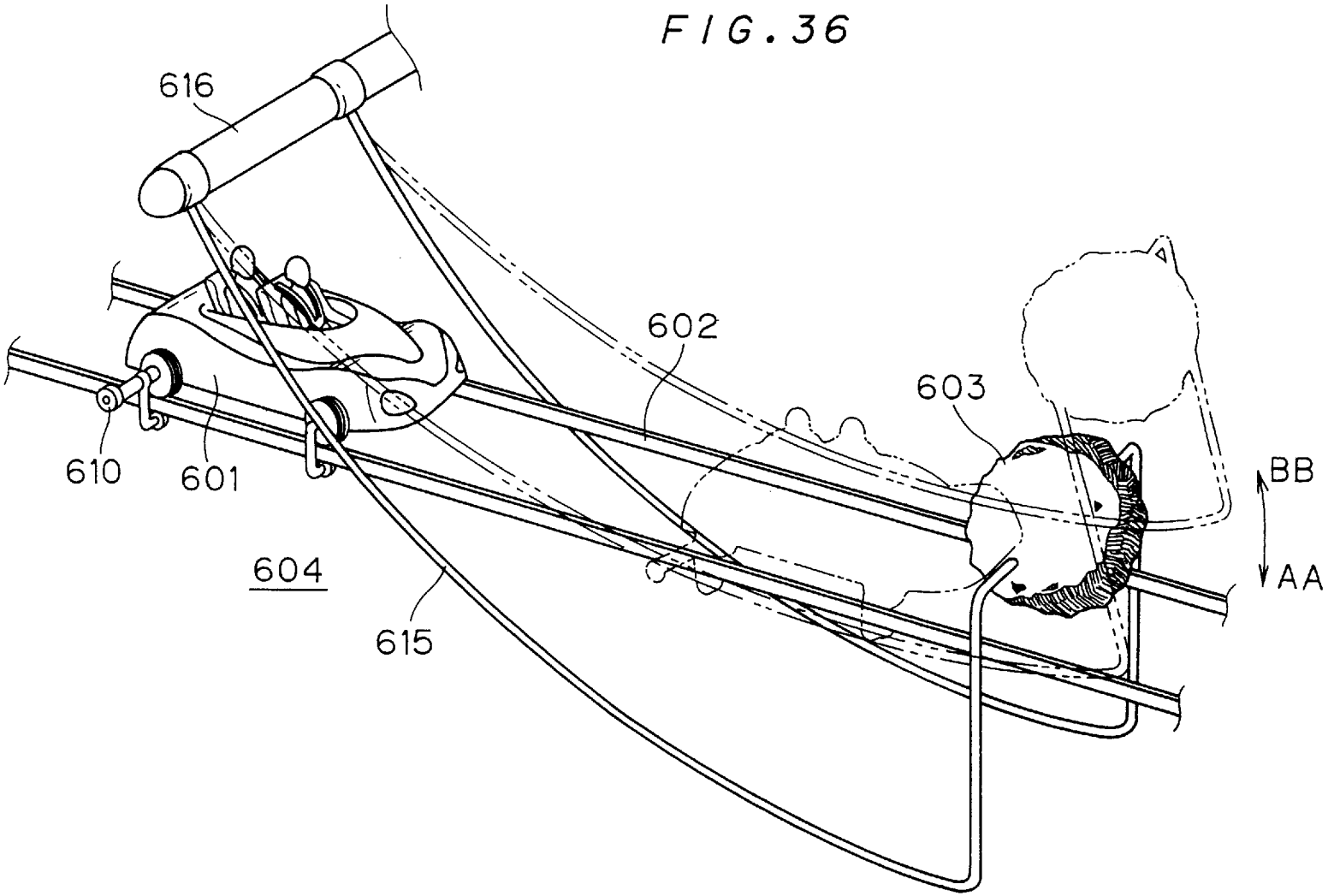
FIG.36 is a perspective view of another modification of the amusement ride of the ninth embodiment.

Further, as shown in FIG. 36, the drive mechanism 604 may comprise a support base 616 disposed above the rail track 602, a swinging arm 615 carrying an obstacle 603 on one end thereof and having the other end thereof secured to a support base 616, and engaging rollers 610 mounted to the passenger car 601. With this arrangement, the car 601 proceeding along the track brings the engaging rollers 610 into engagement with the swinging arm 615 so as to move the swinging arm 615 in the direction of arrow BB and hence, the obstacle 603 is carried out of the traveling course of the car 601. After the car 601 has passed by to disengage the engaging rollers 610 from the swinging arm 615, the swinging arm 615 is urged in the direction of arrow AA, thus returning the obstacle 603 to the original position in the traveling course of the car 601.

Figure 37:
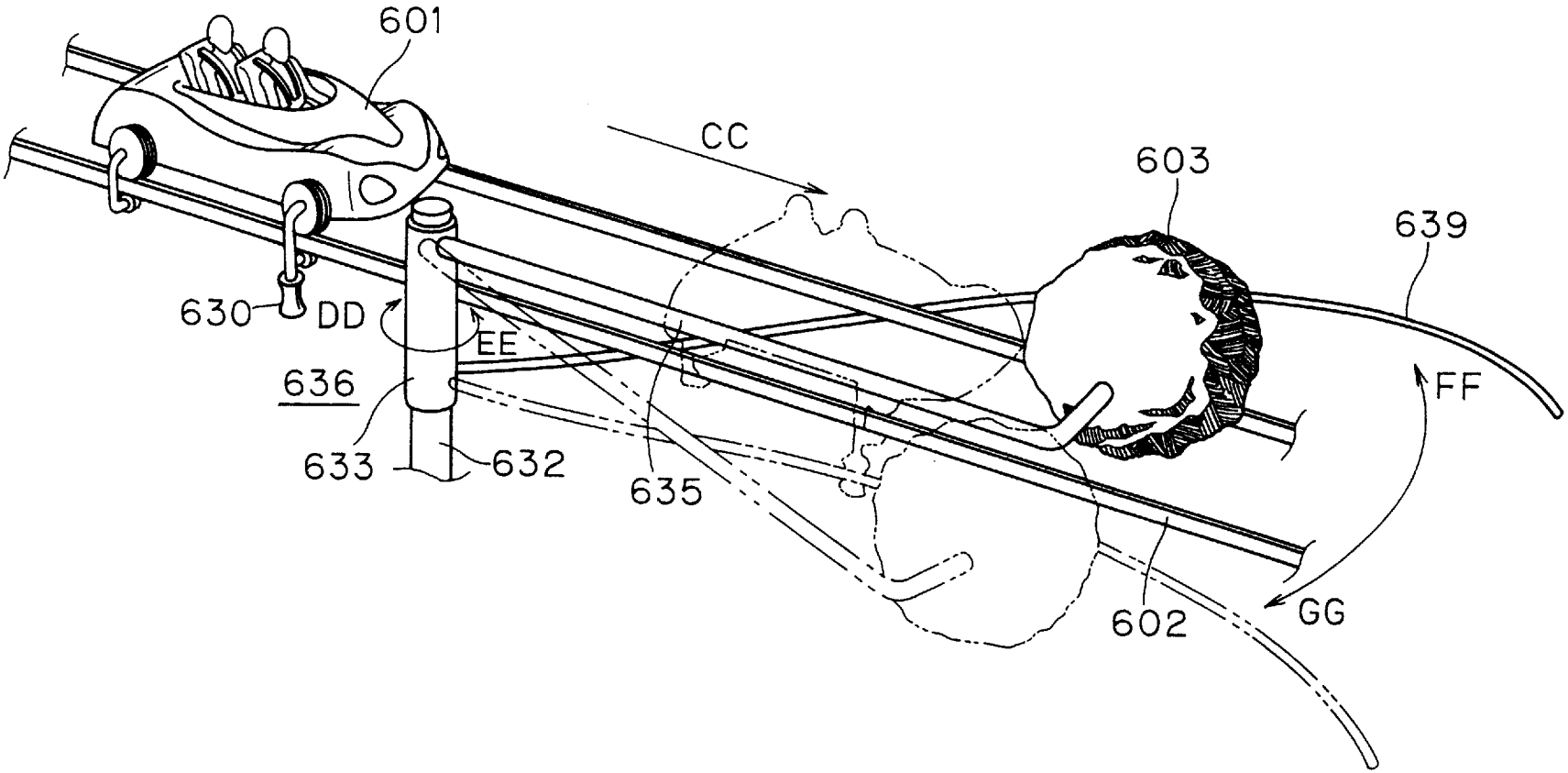
FIG.37 is a perspective view of still another modification of the amusement ride of the ninth embodiment.
Figure 38:
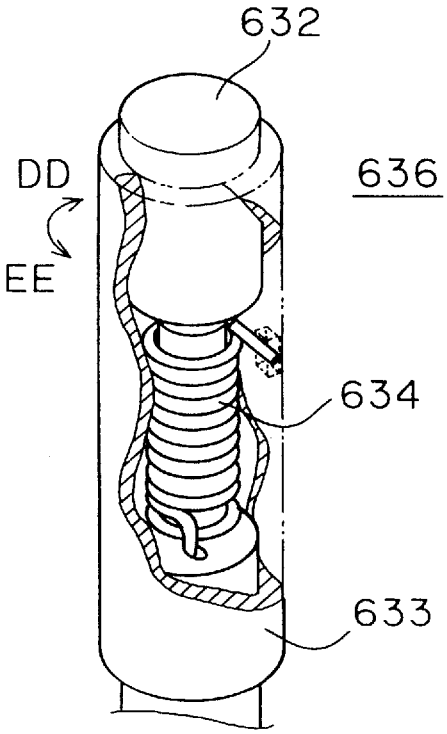
FIG.38 is a partially cutaway view in perspective of a support base of the embodiment of FIG.37.

FIG.37 illustrates an arrangement wherein the obstacle 603 is moved in a horizontal plane. In the figure, a support base 636 is erected at place laterally of the track 602. The support base 636, as shown in FIG.38, comprises a shaft 632, a rotatable cylinder 633, and a helical torsion spring 634. The rotatable cylinder 633 is rotatable in the direction of arrow DD–EE as biased by the helical torsion spring 634 in the direction of arrow EE. As seen in FIG. 37, an L-shaped swinging arm 635 is secured to the upper portion of the rotatable cylinder 633 while an engageable arm 639 is secured to the lower portion thereof. In a normal state, the engageable arm 639 is under the track 602 so that the obstacle 603 mounted to the distal end of the swinging arm 635 is located in the traveling course of the car 601. The passenger car 601 proceeding in the direction of arrow CC brings an engaging roller 630 into engagement with the engageable arm 639 thereby moving the engageable arm 639 in the direction of arrow GG and causing the rotatable cylinder 633 to turn in the direction of arrow DD. Thus, the swinging arm 635 is moved in the direction of arrow GG thereby carrying the obstacle 603 out of the traveling course of the car (in the direction of arrow GG). As associated with the passage of the car 601, the engageable arm 639 and swinging arm 635 are returned to their original positions by the biasing force of the helical torsion spring 634.

An arrangement may be made wherein the aforesaid weight 608 and engageable arm 609 of FIG.33 are eliminated and provided instead are a driving motor for rotating a support shaft on which the support base 606 carries the swinging arm 605, a sensor adjacent the track 602 for detecting a passage of the car 601, and a control device for controlling the driving motor. The control device responds to a detection signal from the sensor to actuate the driving motor for moving the swinging arm 605 in the direction of arrow AA in FIG.33 and thus, the obstacle 603 is carried out of the traveling course of the car. In a predetermined period of time (a sufficient time period for the car 601 to pass by the place of the obstacle), the control device actuates the driving motor again to move the swinging arm 605 in the direction of arrow BB in FIG.33 so that the obstacle is returned into the traveling course of the car.

The principals of levers are applied to the arrangements of the above embodiments, but the embodiments are not limited to the above. Although not particularly illustrated, there may be utilized an air cylinder, hydraulic cylinder or the like, for example, to cause the mounting base 607 to advance into or retreat from the traveling course of the car 601. In addition, a control device for driving the air cylinder, hydraulic cylinder or the like and a sensor for detecting a passage of the car 601 may be provided. The control device is adapted to respond to a detection signal from the sensor for actuating the air cylinder, hydraulic cylinder or the like thereby moving the obstacle 603 out of the traveling course of the car. In a predetermined period of time (sufficient time period for the car 601 to pass by the place of the obstacle), the control device again drives the air cylinder, hydraulic cylinder or the like to return the obstacle into the traveling course of the car.

Figure 39:
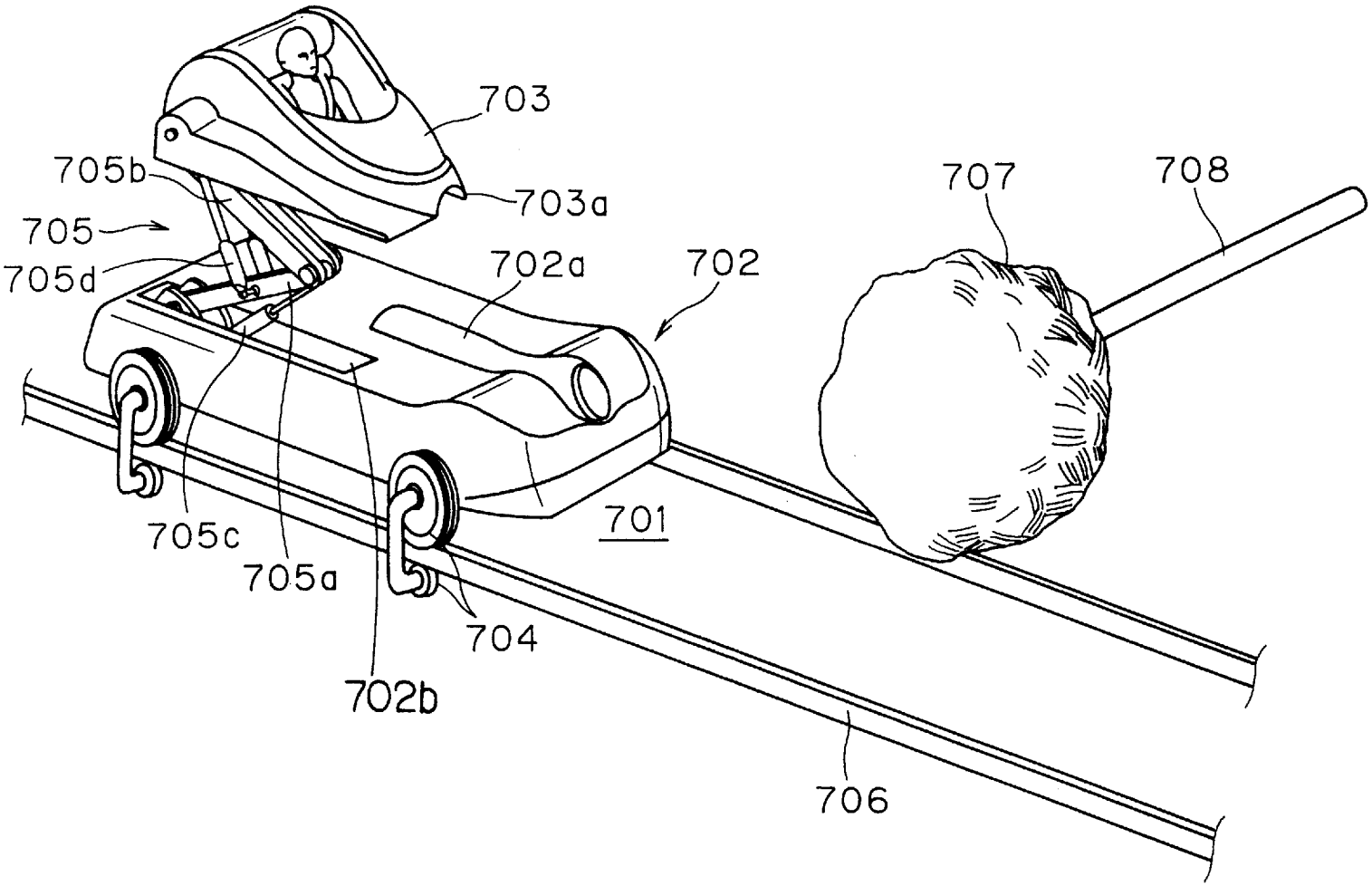
FIG.39 is a perspective view for illustrating an amusement ride according to a tenth embodiment of the invention.

Now referring to FIG. 39, description will be given of a tenth embodiment of the present invention.

As seen in the figure, a ride of this embodiment comprises a passenger car 701, a track 706 and an obstacle 707.

The passenger car 701 comprises a car body 702, a seating section 703, wheels 704 for engaging the track 706 and a lifting mechanism 705 for vertically moving the seating section 703. The structure of the passenger car employed by a variety of the amusement rides is applicable to the principal construction of the car body 702. Examples of such cars include a self-propelled type car and a coaster-type car, or a car traveling on a monorail or double rails. The car body 702 includes a recess 702*b* for securely holding the seating section 703. The construction of a car used in a variety of the amusement rides is applicable to the wheels 704, which are adapted to prevent the disengagement thereof from the track 706.

The aforesaid seating section 703 is formed like a capsule, as shown in the figure, and contains therein a seat (not shown) for seating a passenger. The seating section 703 has a concave portion 703*a* at the bottom for engaging a convex portion 702*a* of the car body 702.

The aforesaid lifting mechanism 705 is constructed as a so-called jack, and comprises arms 705*a* and 705*b* continuously coupled to each other, and hydraulic cylinders 705*c* and 705*d*, as shown in the figure. The arm 705*a* is connected to the car body 702 whereas the arm 705*b* is connected to the seating section 703, respectively. The arms 705*a* and 705*b* are extended by extending piston rods of the hydraulic cylinders 705*c* and 705*d*, and are folded down by retracting the piston rods. The seating section 703 is vertically moved in this manner. The car body 702 contains therein a so-called hydraulic unit (not shown) comprising a tank and a pump which is adapted to supply a high-pressure oil to the hydraulic cylinders 705*c* and 705*d* via an electromagnetic valve assembly for driving the cylinders. The car body 702 also includes therein a control unit (not shown) for controlling the electromagnetic valve assembly and hydraulic unit. In this case, the electromagnetic valve assembly may be closed/opened by means of operation at the seating section 703 or of remote control. Alternatively, a detecting device is mounted to the car body 702 such that upon detection of a target object, a signal indicative of the detection of the target object is supplied to the control unit which, in turn, causes the electromagnetic valve assembly to open/close by means of a sequence circuit or program stored therein. In this embodiment, such target objects are disposed before the obstacle 707 as seen in the traveling direction of the car 701 as well as at different places adjacent the track 706.

The structure of tracks used in a variety of the amusement rides is applicable to the track 706. For example, the track may comprise a single rail like a monorail, but the present embodiment adopts double rails, as illustrated in the FIG. 39, which rest on a known support structure (not shown).

The obstacle 707 is disposed within the traveling course of the passenger car 701, as carried by a support arm 708 which is supported by the aforesaid known support structure (not shown) . The obstacle 707 formed of a fragile material such as styrofoam would ensure the safety of the passenger if the car 701 should collide with the obstacle 707.

According to the amusement ride of the foregoing construction, the passenger car 701 with a passenger seated in the seating section 703 first travels on the track 706 of a given trajectory. At this time, the seating section 703 is lowered, resting on the car body 702.

When the passenger car 701 is traveling in this state, if the detecting device detects a target object disposed at any of the different places and supplies a detection signal to the control unit (not shown), the control unit (not shown) actuates the hydraulic cylinders 705*c* and 705*d* of the lifting mechanism 705 by means of the electric valve assembly to thereby vertically move the seating section 703 intermittently or continuously. This allows the passenger to experience a feeling of speed as the car proceeds forward as well as a sensation as the seating section is vertically moved. Thus an extraordinary sensation is produced with an enhanced element of amusement.

When the passenger car 701 approaches the obstacle 707, the passenger may see the obstacle 707, seized with fear for the car colliding with the obstacle 707. Subsequently, the detecting device detecting the target object supplies a detection signal to the control unit (not shown) which, in turn, actuates the hydraulic cylinders 705*c* and 705*d* of the lifting mechanism 705 by means of the electromagnetic valve assembly to thereby raise the seating section 703. This allows the obstacle to relatively pass through a space between the seating section 703 and the car body 702 and thus, the collision of the seating section 703 with the obstacle 707 is avoided. After the car has passed by the obstacle, the control unit (not shown) actuates the hydraulic cylinders 705*a*and 705*b* of the lifting mechanism 705 by means of the electromagnetic valve assembly to lower the seating section 703. Thus, the seating section 703 is returned to its original position in the car body 702. In this manner, the passenger may experience the mixed thrill of fear and the impression of the speed of the running car, enjoying a ride with a further enhanced element of amusement.

The above embodiment has an arrangement wherein the hydraulic cylinders 705*c* and 705*d* are adapted to vertically move the seating section 703 by means of the arms 705*a* and 705*b*. Alternatively, the hydraulic cylinders may be adapted to directly cause a vertical movement of the seating section 703. In this case, a cylinder side (not shown) of the hydraulic cylinder may be received in and secured to the interior of the car body 702 and a distal end of a piston rod may be secured to the bottom of the seating section 703. It is noted that the number of the hydraulic cylinders is not limited and that even one cylinder is sufficient as long as a stable lifting of the seating section 703 is ensured.

The above lifting mechanism 705 employs a hydraulic cylinder, but is not limited to this means and other means are also usable. For example, the lifting mechanism may comprise an air cylinder or ball screw. In case where an air cylinder is utilized, the aforesaid hydraulic unit may be replaced by a compressor contained in the car body 702 whereby compressed air may be supplied to the air cylinder. In the case where a ball screw is utilized, a screw shaft (male screw) may be erected from the car body 702 and a female screw may be mounted to the seating section 703 for engagement therewith, the screw shaft being driven by a motor.

Figure 40:
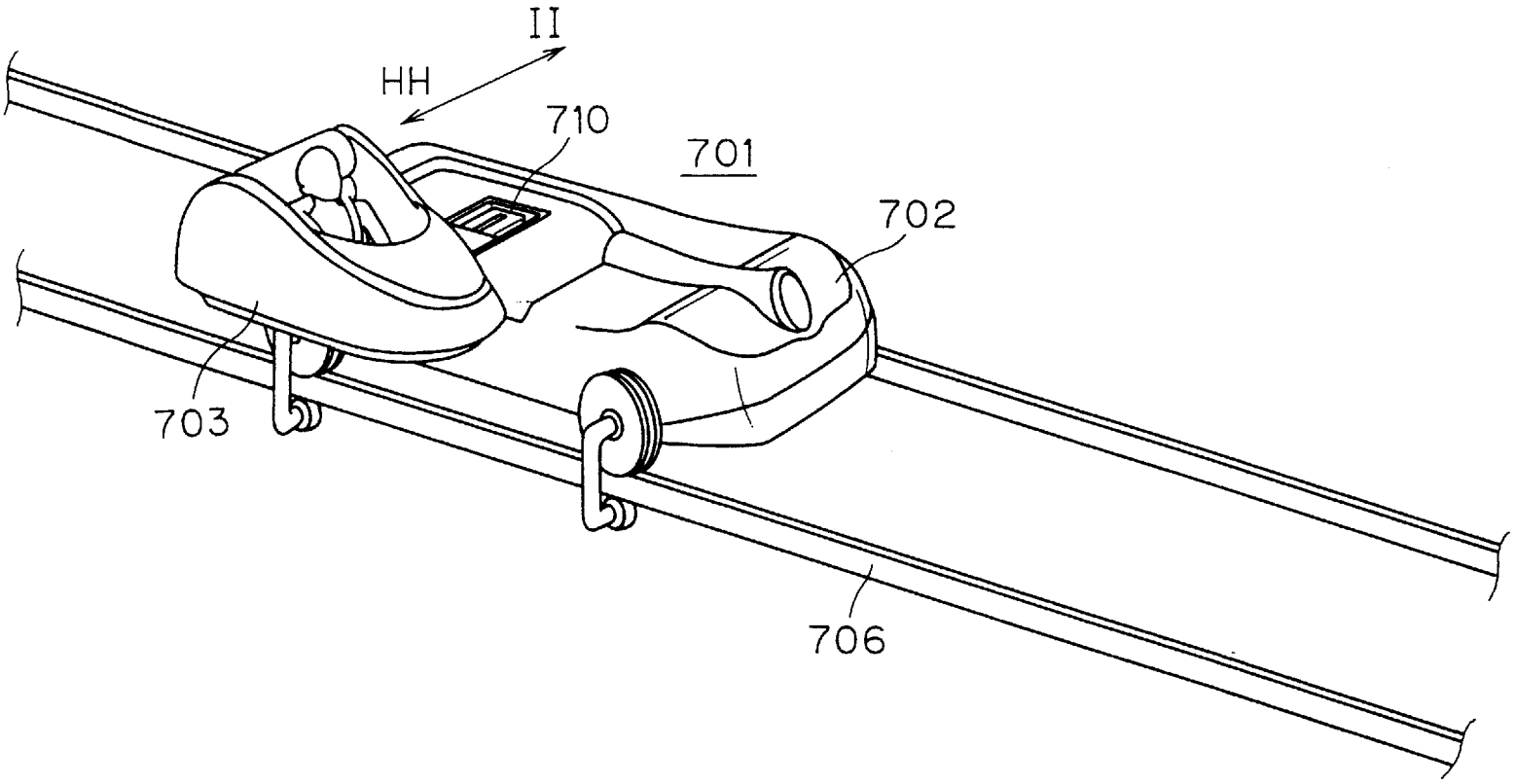
FIG.40 is a perspective view of a modification of the passenger car of the amusement ride of the tenth embodiment.

FIG.40 illustrates the passenger car 701 wherein the seating section 703 is movable in the direction of arrow HH–II. Applicable to a drive mechanism for moving the seating section 703 in the direction of arrow HH–II is a slide unit 710 utilizing a hydraulic cylinder, air cylinder or ball screw. The slide unit 710 comprises a sliding base having a flat, smooth slide surface, a saddle adapted to slide on the sliding base, and any one of a hydraulic cylinder, air cylinder or ball screw, or similar means for moving the saddle in the direction of arrow HH–II. The seating section 703 is secured to the upper surface of the saddle. With this type of passenger car 701, the passenger may experience an extraordinarily unusual sensation as the passenger is moved laterally while proceeding forward. At the same time, the passenger may also experience a scary sensation as the passenger finds him/herself carried out of the rail track 706 as well as the car body 702. Further, in circumventing the obstacle 707, the passenger passes laterally of the obstacle, and may be seized with a different kind of fear from that experienced in the foregoing embodiments.

Figure 41:
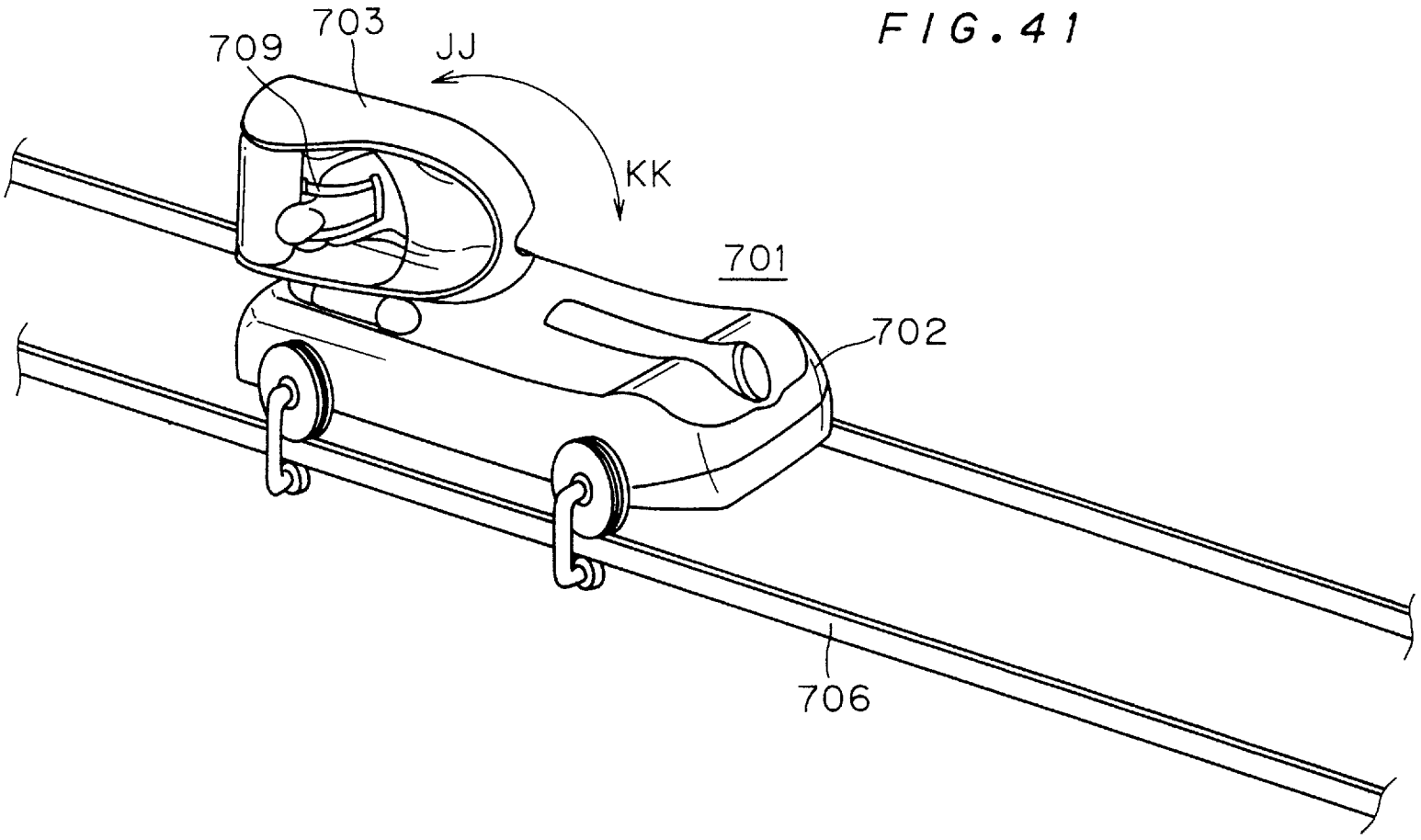
FIG.41 is a perspective view of another modification of the passenger car of the amusement ride of the tenth embodiment.

Alternatively, as shown in FIG. 41, a passenger car 701 carries the seating section 703 which has the lateral side portion thereof secured to the car body 702 by way of a shaft so as to be rotatable in the direction of arrow JJ–KK. As a drive mechanism for moving the seating section in the direction of arrow JJ–KK, a hydraulic cylinder, air cylinder, motor or the like may be employed. More specifically, if a hydraulic cylinder or air cylinder is utilized, a support shaft coupled to the seating section 703 is provided with an arm, the distal end of which is connected to a distal end of a piston rod. If a motor is utilized, the aforesaid support shaft is provided with a gear or pulley such that a driving force of the motor is transmitted by means of the gear or a timing belt. With this type of passenger car 701, the passenger may experience an extraordinarily unusual sensation as the passenger is turned laterally while proceeding forward. Additionally, the passenger may have a scary sensation as the passenger is seized with fear for falling off the seating section 703. It is to be noted that the passenger wearing a seat belt is protected from falling off, and thus is assured safety. The car 701 passes by the obstacle 707 with the seating section 703 turned laterally in the direction of arrow JJ.

Figure 42:
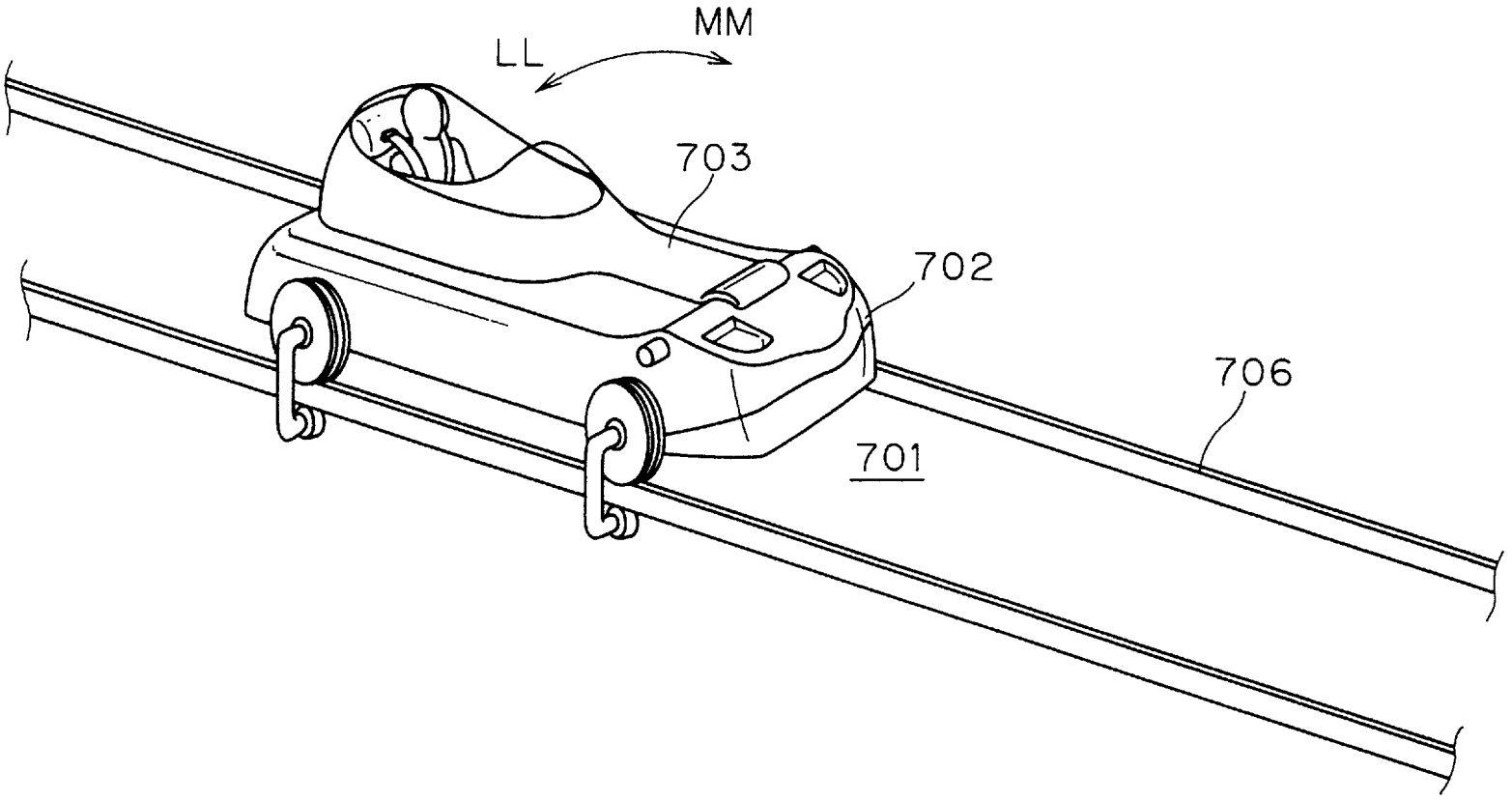
FIG.42 is a perspective view of still another modification of the passenger car of the amusement ride of the tenth embodiment.
Figure 43:
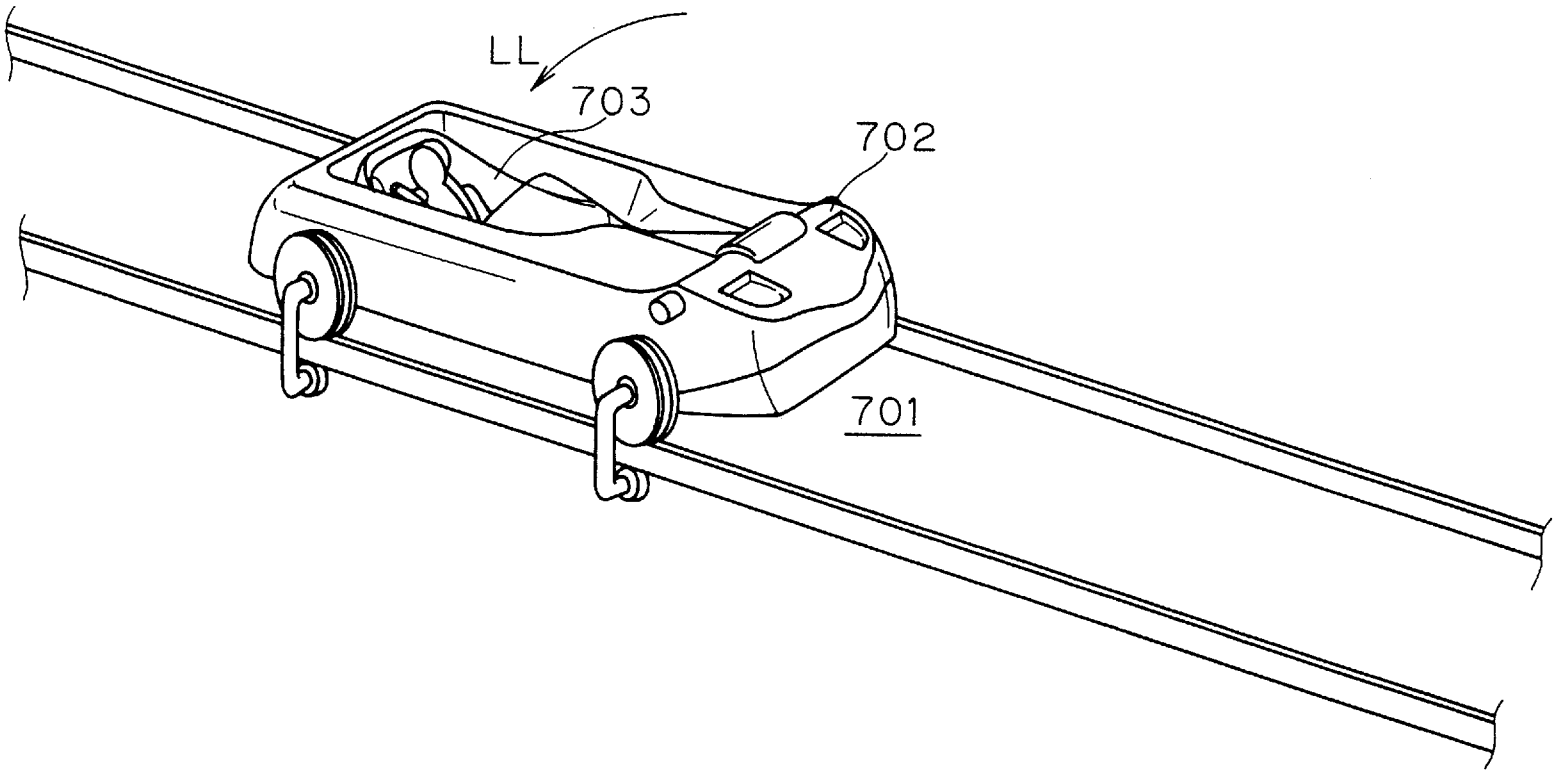
FIG.43 is a perspective view for illustrating the operation of the passenger car of FIG.42.

FIG.42 illustrates a passenger car 701 wherein the seating section 703 has the front end portion secured to the car body 702 by means of a shaft as being pivotable in the direction of arrow LL–MM. As a drive mechanism for moving the seating section 703 in the direction of arrow LL–MM, a hydraulic cylinder, air cylinder, motor or like means may be employed. A similar construction to the foregoing is applicable to the specific construction of the drive mechanism. In this type of passenger car 701, when the seating section 703 is pivoted in the direction of arrow LL, it sinks into the car body 702, as shown in FIG.43. This also offers the passenger an extraordinarily unusual sensation. Incidentally, the passenger car 701 passes by the obstacle 707 while the seating section 703 is pivoted in the direction of arrow LL.

Now referring to FIG. 44, description will be given of an eleventh embodiment of the present invention.

As seen in the figure, an amusement ride of this embodiment comprises a passenger car 711, a primary track 717, an auxiliary track 718 and an obstacle 719.

The passenger car 711 comprises a car body 712, a seating section 713, wheels 714, a connecting arm 715 and an auxiliary wheel 716.

The seating section 713 is movable apart from the car body 712. The car body 712 is formed with a concave 712*a* in the upper surface thereof while on the other hand, the bottom surface of the seating section 713 is formed like a convex such that the seating section 713 may be stably seated within the car body 712.

Figure 44:
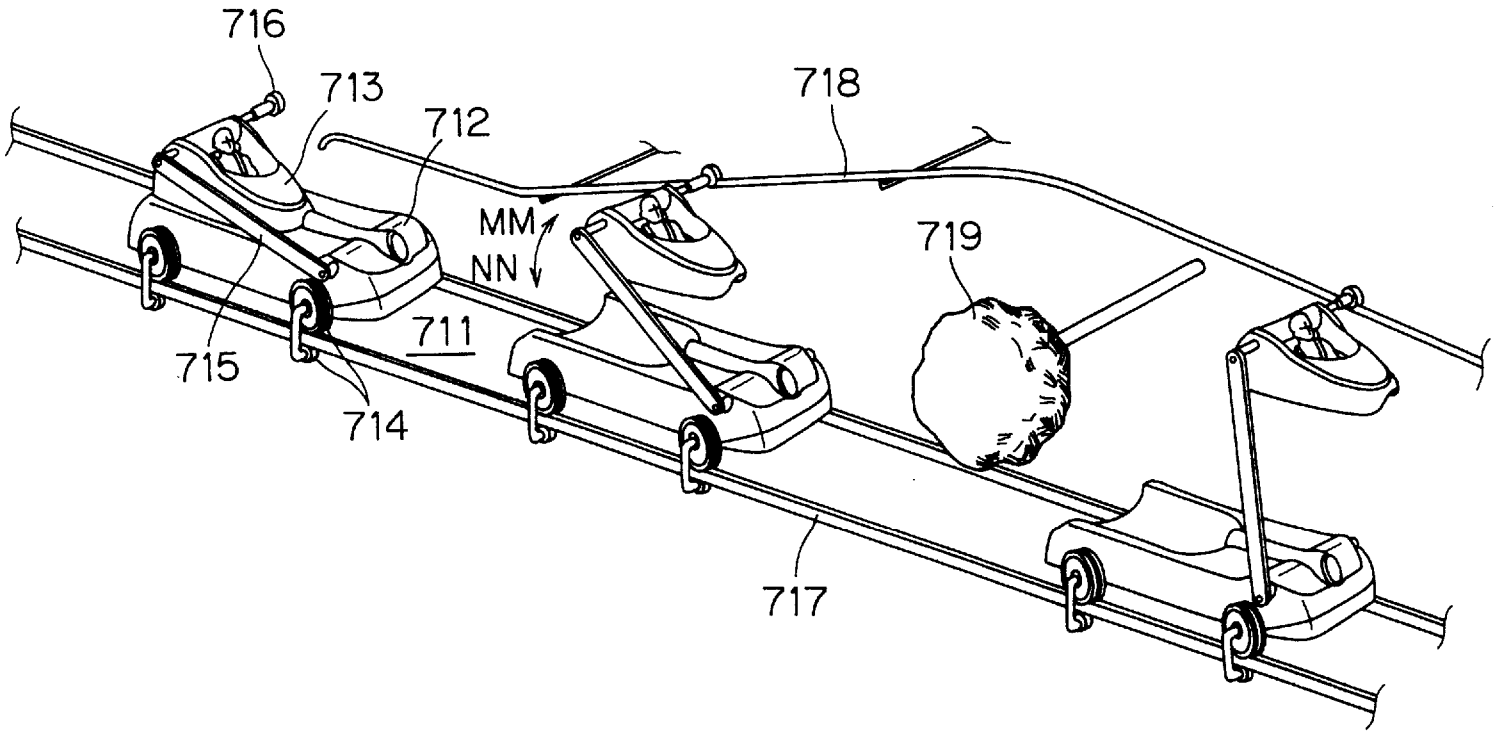
FIG.44 is a perspective view for illustrating an amusement ride according to an eleventh embodiment of the invention.

As shown in FIG. 44, the connecting arm 715 is mounted to one side of the car body 712, and one end of arm 715 connected to the fore portion of the car body 712 and carried on a shaft so as to be capable of pivoting in the direction of arrow MM–NN. On the other hand, the connecting arm 715 has the other end thereof connected to the seating section 713 for carrying the seating section 713 on a shaft.

The auxiliary wheel 716 is mounted on the seating section 713 at a side opposite to the connecting arm 715 and is rotatably carried on a shaft.

As a primary track 717, there may be employed a track used in various types of the known amusement rides. The track of this embodiment comprises, as shown in FIG.44, a pair of rails supported by the known support structure (not shown).

The auxiliary track 718 is laid above the primary track 717 for engagement with the auxiliary wheel 716 and moves upward in the shape of a wave forming a crest portion. Similarly to the primary track 717, it is supported by the known support structure (not shown).

The obstacle 719 is positioned below the crest portion of the auxiliary track 718 and within the traveling course of the passenger car 711, as supported by the aforesaid known support structure (not shown) If a dummy rock or the like is utilized as the obstacle 719, the ride may offer a further enhanced element of amusement.

According to the amusement ride of the above construction, the car 711 with the passenger seated in the seating section 714 first travels on the primary track 717. Then, engaging the auxiliary track 718, the auxiliary wheel 716 of the car 711 proceeds along the auxiliary track 718. When the auxiliary wheel 716 proceeds along an upward incline of the auxiliary track 718, the seating section 713 is moved upward as supported by the connecting arm 715, auxiliary wheel 716 and auxiliary track 718 thereby circumventing the obstacle 719 disposed in the traveling course of the car. When the auxiliary wheel 716 proceeds along the downward incline of the auxiliary track 718, the seating section 713 is moved downward and returned to its original position. Just as in the case of the tenth embodiment, the passenger may experience unprecedented sensations as subjected to a fast forward movement as well as a vertical movement. Thus, the passenger may enjoy a ride with an enhanced element of amusement. The obstacle 719 is disposed at a place such that the passenger may see the obstacle 719 before the seating section 713 starts to be elevated along the auxiliary track 718, and therefore, the passenger may experience the mixed sensations of fear of collision with the obstacle 714 and an impression of the speed of the running car. Hence, the ride offers a further enhanced element of amusement.

Figure 45:
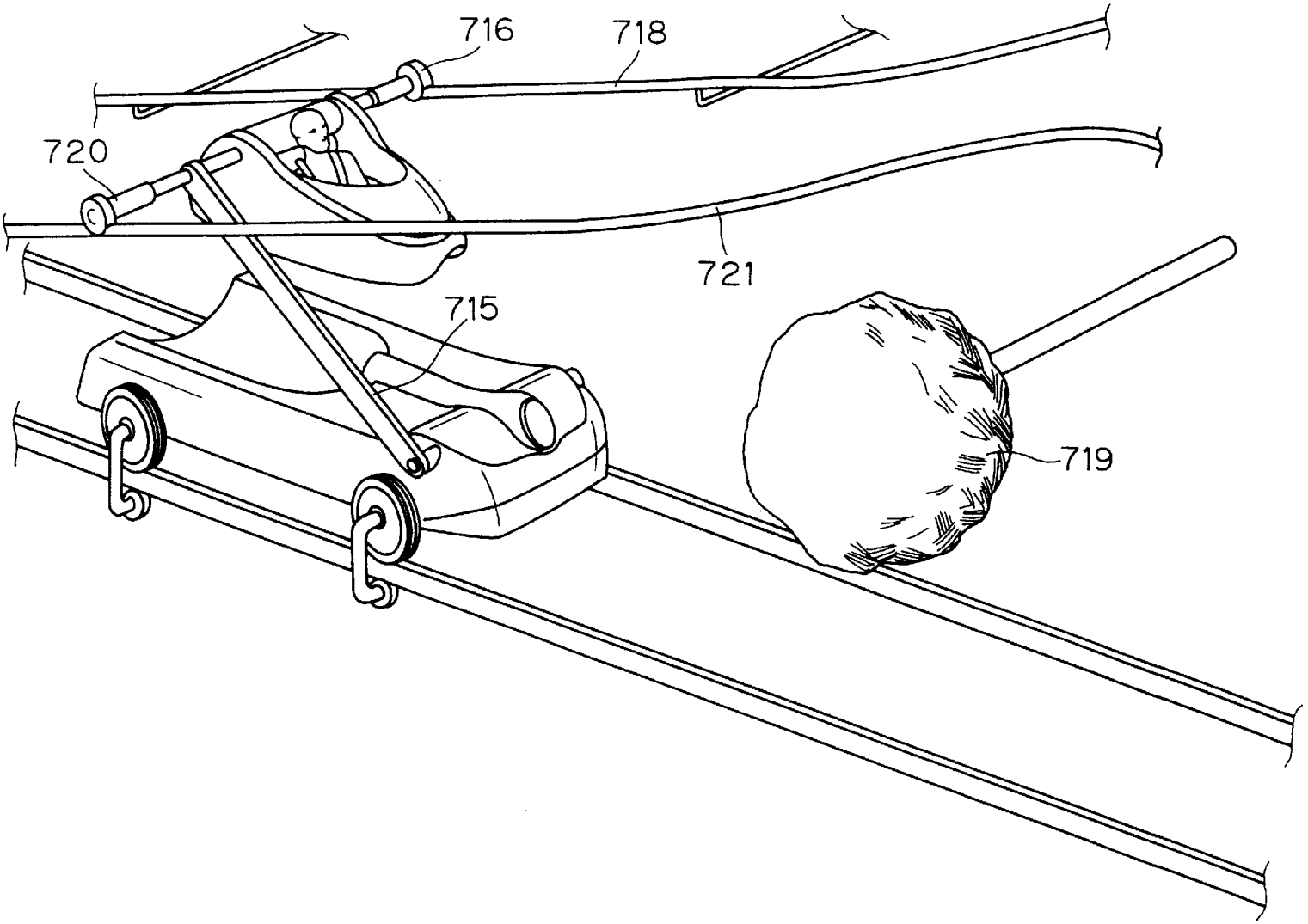
FIG.45 is a perspective view of a modification of the amusement ride of the eleventh embodiment.

FIG. 45 illustrates a modification of the ride of the embodiment of FIG. 44. As seen in the figure, the ride has a construction further including a second auxiliary wheel 720 and a second auxiliary track 721 of the same arrangement as the aforesaid first auxiliary wheel 716 and auxiliary track 718. With this construction, the seating section 713 is supported in a more stable manner by means of the two auxiliary wheels 716 and 720 and the two auxiliary tracks 718 and 721.

In addition, another connecting arm may be mounted to a side opposite to the aforesaid connecting arm 715. However, it is to be noted that this arrangement makes it impossible to locate the obstacle 719 within the traveling course of the car 711.

Next, with reference to FIG. 46, description will be given of a twelfth embodiment of the present invention.

As seen in the figure, a ride of this embodiment comprises a passenger car 801, a first track 806 and a second track 807 constituting a track, and an obstacle 808.

Figure 46:
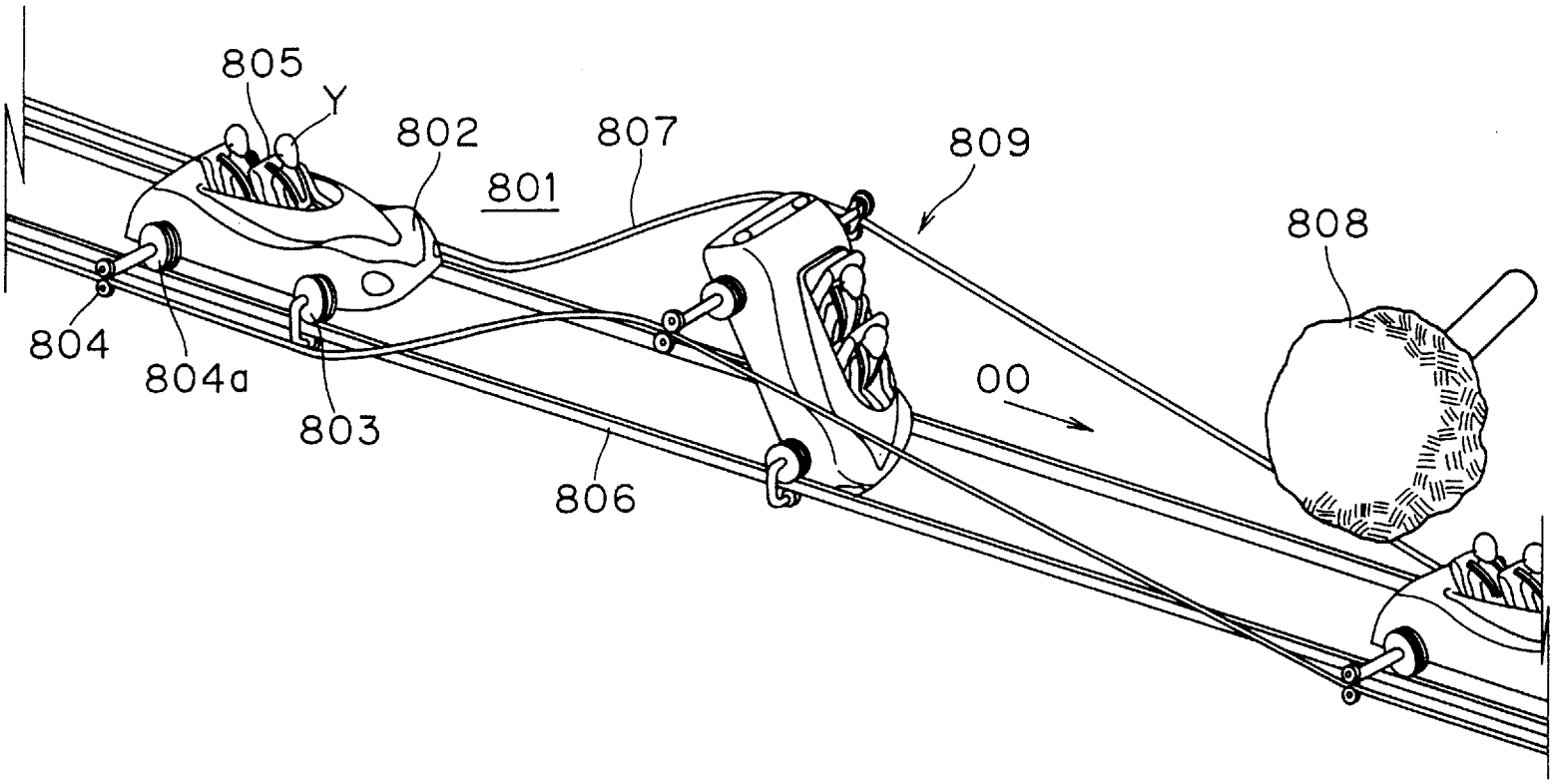
FIG.46 is a perspective view for illustrating an amusement ride according to a twelfth embodiment of the invention.

The first and second tracks 806 and 807 comprise a pair of rails extending in parallel as shown in FIG.46. The rails used in various types of the known amusement rides are applicable to such tracks. Incidentally, the first and second tracks 806 and 807 are supported by an unillustrated support structure. The second track 807 is laid laterally outwardly of and at a slightly higher level than the first track 806. The second track 807 is formed as a vertical wave which crests at a predetermined point. Incidentally, the track comprised of the first and second tracks 806 and 807 may have a wave-like trajectory throughout their respective lengths.

The passenger car 801 is of a self-propelled type or a coaster type, and comprises a car body 802, front wheels 803, rear wheels 804 and a seating section 805. Components used in various types of the amusement rides are applicable to the car body 802, front wheels 803, rear wheels 804 and seating section 805, respectively. One or more passengers Y are seated in seating section 805. It is particularly noted that a seating section 805 equipped with a retaining device for securely retaining the passenger Y is preferred.

The passenger car has the front wheels 803 engaged with the first track 806 and the rear wheels engaged with the second track 807. A rear wheel section has, in addition to the rear wheels 804, auxiliary wheels 804*a* which are engaged with the first track 806. The auxiliary wheels 804*a* are designed to support the car body 802 during a movement in a normal position so as to decrease a load on the rear wheels 804. Accordingly, they are not particularly required if the rear wheels 804 and second track 807 have sufficient strength. The front wheel 803 and rear wheel 804 each have an arrangement wherein two wheels are vertically positioned relative to each other to thereby grip the first track 806 and second track 807 therebetween, respectively. However, the arrangement is not limited to the above, and another wheel contacting the side of the track may also be added so that the track may be griped between the three wheels. Such an arrangement can more assuredly prevent the wheel from being disengaged from the track.

The aforesaid obstacle 808, supported by the aforesaid support structure (not shown), is disposed downstream of a vertical wave portion 809 in the direction of arrow OO (direction in which the car 801 travels) and above the traveling course of the car 801. It is preferred to form the obstacle 707 from a fragile material such as styrofoam, because such a fragile material would ensure the protection of the passengers against injury if the car 701 should collide with the obstacle 808. If a dummy rock or the like is used as the obstacle, the ride will offer a further enhanced element of amusement.

According to the ride of the above construction, the car 801 with the passengers seated in the seating section 805 first travels along the first and second tracks 806 and 807 in a substantially horizontal position. Subsequently, when the passenger car 801 travels along the vertical wave portion 809, the front wheels 803 proceed along the first track 806 and the rear wheels 804 proceed along the second track 807, respectively. As a result, the car 801 is inclined with the front wheels 803 positioned at a relatively lower level and the rear wheels 804 positioned at a relatively higher level, as shown in FIG. 46. In this process, as shown in the figure, the passengers may see the obstacle 808 ahead of them to be seized with fear of a collision with the obstacle 808.

Subsequently, while the rear wheels are moving along a downward slope of the second track 807, the car 801 is inclined at a progressively decreasing angle to assume a horizontal position. In this position, the passenger car 801 passes below the obstacle 808 as moving along the first and second tracks 806 and 807.

As described above, the ride of the above construction provides a variation of the movement of the car locally, such as an upward inclination and downward inclination, in addition to the variation of the track as a whole formed by the first and second tracks. Thus, the ride can offer greater amusement than conventional rides. If the aforesaid vertical wave 809 is provided at a place where the track as a whole is declined, the passenger car 801 will be inclined at an even greater angle with respect to the horizontal plane so that the passengers may feel an even greater intensity of thrill. However, the car 801 actually travels at a speed corresponding to an inclination of the track as a whole with respect to the horizontal plane, which speed is lower than that should correspond to an apparent inclination of the car 801 and hence, the car 801 is easier to control.

Additionally, the passengers may be seized with the fear of a collision with the obstacle 808, as described above, and hence, they may experience the mixed thrill of such a fear and an impression of the speed of the running car. Thus, the ride offers an even enhanced element of amusement.

Now referring to FIGS. 47 and 48, description will be given of a thirteenth embodiment of the present invention.

Figure 47:
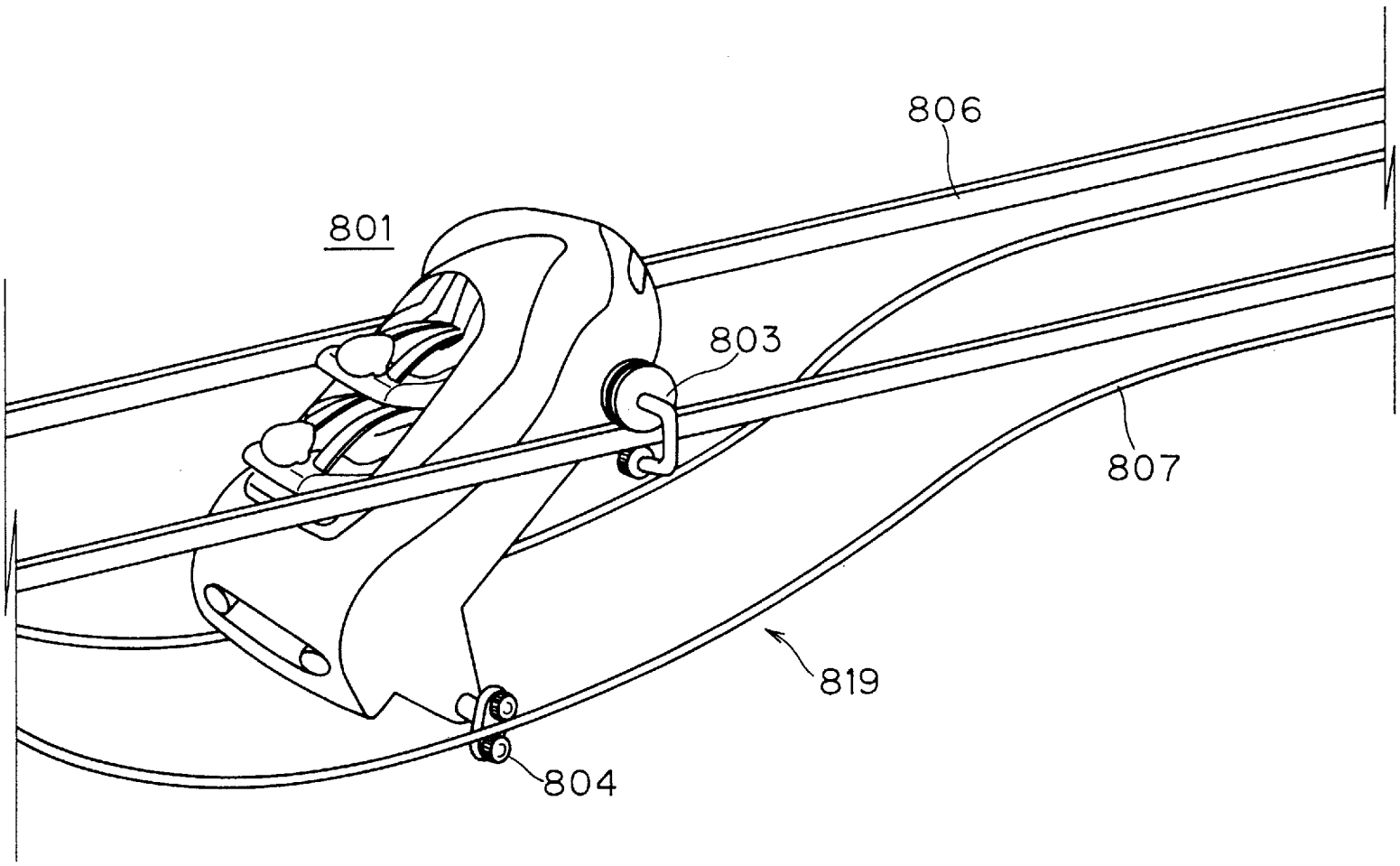
FIG.47 is a perspective view for illustrating an amusement ride according to a thirteenth embodiment of the invention.

As seen in FIG. 47, a ride of this embodiment has the same construction as the twelfth embodiment except for the structure of the second track 807 and that the auxiliary wheels 804*a* are eliminated.

More specifically, the ride of this embodiment has the second track 807 disposed under the first track 806 and formed in the shape of a wave so as to form a trough at a predetermined place.

In this ride, the passenger car 801 is inclined at a vertical wave portion 819 with the front wheels 803 positioned at a relatively higher level and the rear wheels 804 positioned at a relatively lower level. This also subjects the passengers to a vertical movement locally, thus offering an enhanced element of amusement. If the vertical wave portion 819 is provided at a place where the track as a whole is inclined upwardly, the passenger car 801 will be inclined at an even greater angle with respect to the horizontal plane so that the passengers may feel a greater intensity of thrills. However, the car actually travels at a speed corresponding to an angle of the upward inclination of the track as a whole and hence, the passenger car 801 does not slow down as much as it normally does when ascending the apparent incline. As a result, the car 801 proceeds smoothly.

Figure 48:
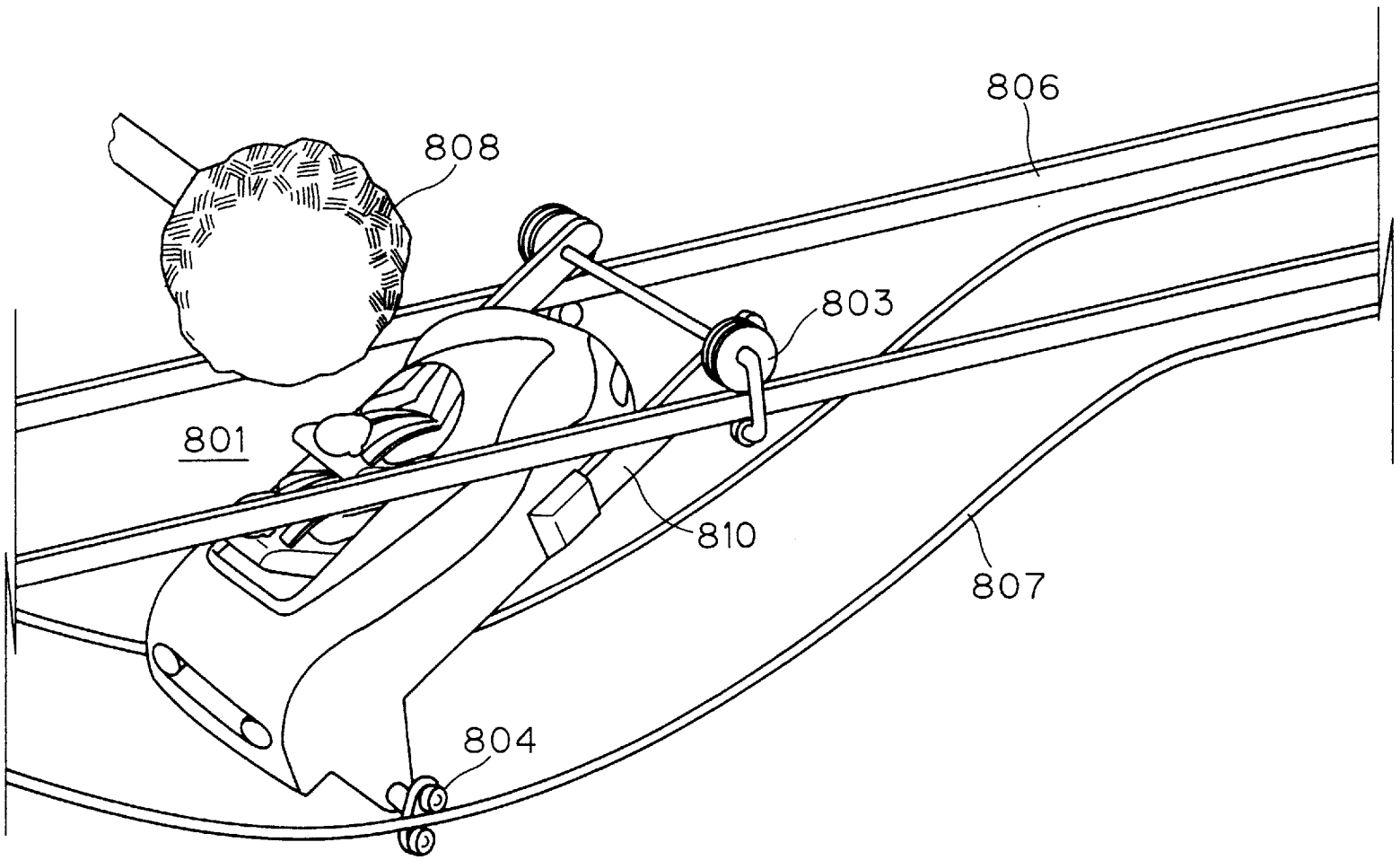
FIG.48 is a perspective view of a modification of the amusement ride of the thirteenth embodiment.

If the obstacle 808 is disposed in the traveling course of the passenger car 801, the car 801 may be arranged as shown in FIG. 48. More specifically, in this case, the car body 802 may be provided with arms 810 extending forward. Arms 810 are then provided with front wheels 803. With this arrangement, only the front wheels 803 are positioned above the first track 806 so that the obstacle 808 may be positioned as close as possible to the first track 806. Accordingly, the passengers may be seized with fear, feeling as if they were really about to collide with the obstacle. Incidentally, the passenger car 801 can readily pass under the obstacle 808.

Although the twelfth and thirteenth embodiments have an arrangement wherein the second track 807 includes a vertical wave portion therein, the first track 806 may include a vertical wave portion therein or both the first and second tracks 806 and 807 may include vertical wave portions therein. If both the tracks include vertical wave portions therein, the vertical position of the traveling car 801 will vary in a more complicated manner, and hence, variations of the movement of the passenger car will be increased.

Now referring to FIG. 49, description will be given of a fourteenth embodiment of the present invention.

As seen in the figure, a ride of this embodiment comprises a first passenger car 901, a second passenger car 902, a first track 903, a second track 904 and a halting mechanism 905.

Figure 49:
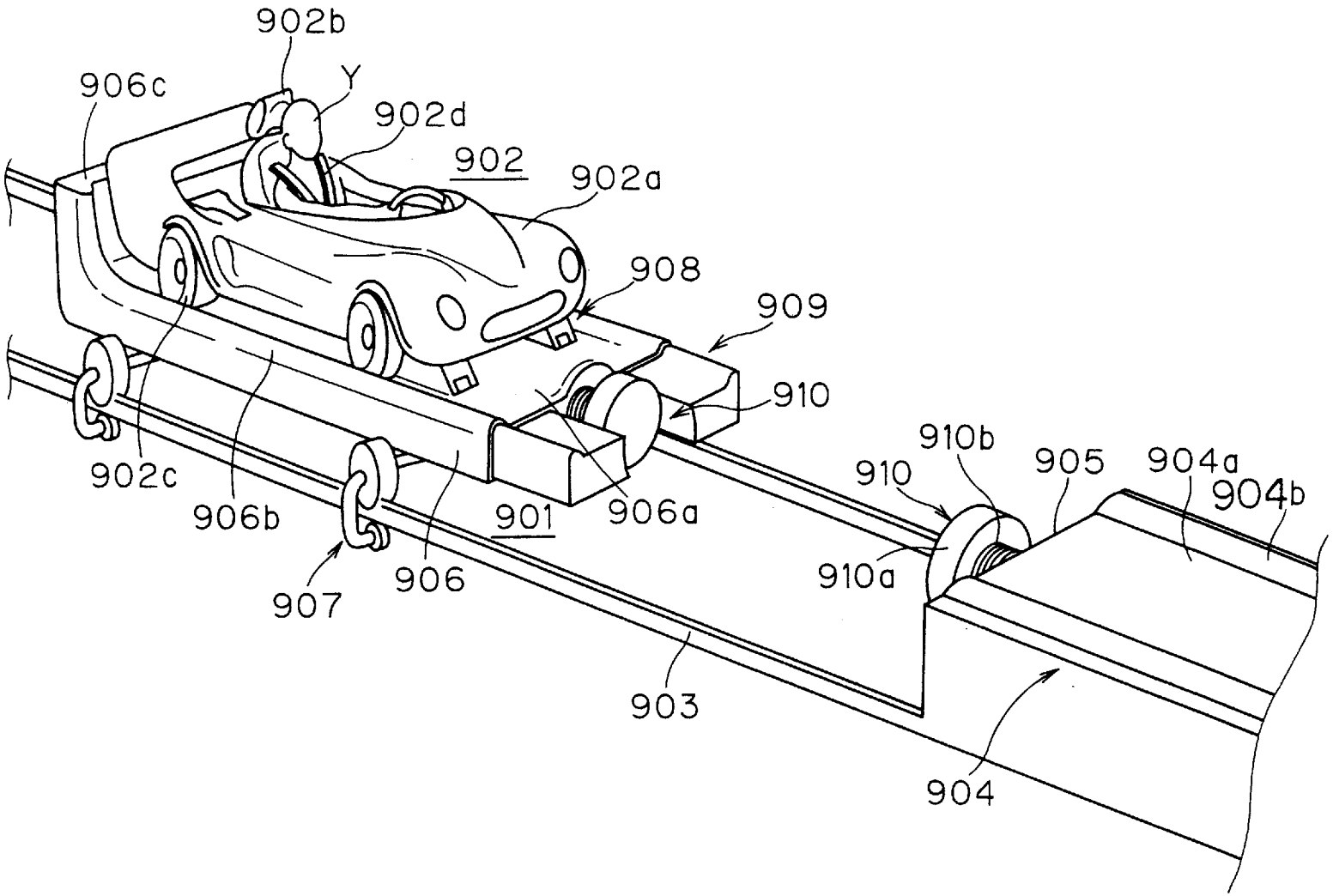
FIG.49 is a perspective view for illustrating an amusement ride according to a fourteenth embodiment of the invention.

The first track 903 comprises a pair of rails extending parallel to each other, as shown in FIG. 49. Rails used in various types of the amusement rides are usable as the rails of the embodiment. The first track 903 is supported by a support structure not shown in the figure.

As seen in FIG.49, the second passenger car 902 is a self-propelled or coaster type four-wheeled car which comprises a car body 902*a*, a seating section 902*b* and tires 902*c*. The seating section 902*b* is provided with a seat belt 902*d* for retaining a passenger Y.

The first passenger car 901 is of a self-propelled or coaster type and comprises a car body 906, a wheel section 907, a locking mechanism 908 and a releasing mechanism 909. The wheel section 907 comprises sets of two wheels vertically disposed relative to each other, the respective sets of wheels being mounted to opposite side ends of the fore and rear portions of the car body 906. The wheel section 907 engages the rails by means of the respective sets of two wheels gripping the rails therebetween. This embodiment is so arranged that the rail is gripped between the two wheels, but the invention is not limited to this configuration. For example, another wheel contacting the side of the rail may be added such that the rail is gripped by the three wheels. Such an arrangement provides a more positive prevention of the disengagement of the wheels from the rail.

As seen in FIG. 49, the aforesaid car body 906 comprises a hollow box, the top surface of which defines a mounting surface 906*a* and which is formed with ridges 906*b* on opposite sides. The mounting surface 906*a* carries the second passenger car 902 thereon.

Figure 50:
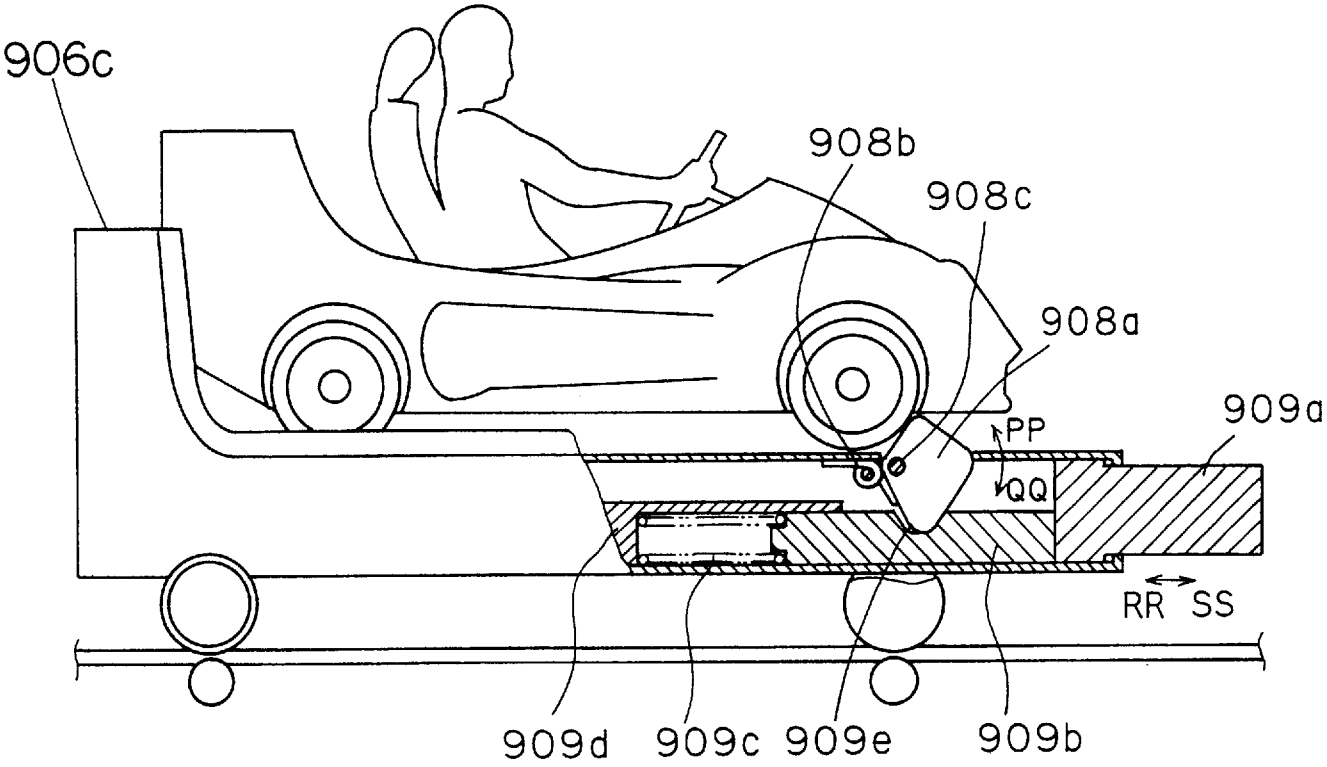
FIG.50 is a side view partly in section for illustrating the amusement ride of the fourteenth embodiment.
Figure 51:
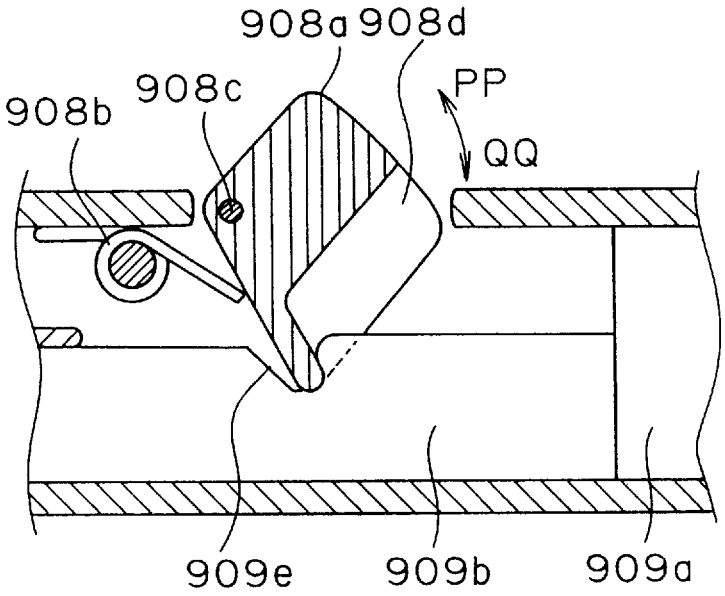
FIG.51 is a sectional view for illustrating a locking mechanism and release mechanism of the amusement ride of the fourteenth embodiment.

As shown in FIG.50, the locking mechanism 908 comprises a wheel stopper 908*a*, a helical torsion spring 908*b* and a rear wall 906*c* disposed at the rear portion of the car body 906. The wheel stopper 908*a* is located in front of each front wheel of the second car 902 and is shaped like a quadrangular prism, as illustrated in FIG.50. The wheel stopper 908*a* is supported by a support shaft 908*c* at one of the apexes of the prism so as to be pivotable in the direction of arrow PP–QQ. The wheel stopper 908*a* is fitted in a hole defined in the top surface of the car body 906, with the upper half thereof projected upwardly from the mounting surface 906*a* so that the tire 902*c* of the second car 902 contacts one of the surfaces of the projected portion for establishing a locked relation. As shown in FIG. 51, a surface opposite to the locking surface of the wheel stopper 908*a* is recessed to define a recess 908*d*. The recess 908*a* is formed by recessing the aforesaid surface with an extension of small thickness left at the lowermost apex of the stopper.

The helical torsion spring 908*b* is secured to the interior of the car body 906 and contacts the lower rear surface of the wheel stopper 908*a* for biasing the wheel stopper 908*a* in the direction of arrow PP.

As shown in FIG. 50, the releasing mechanism 909 comprises an abutment section 909*a*, engageable shaft 909*b*, a helical compression spring 909*c* and a guide barrel 909*d*, which members are provided in pairs correspondingly to the locking mechanism 908. The abutment section 909*a* is fitted in an aperture defined in the front side surface of the car body 906. The fore portion of the abutment section 909*a* projects from the front side surface of the car body 906 and the rear portion thereof contacts the interior surface of the car body 906. The abutment section 909*a* is movable in the direction of arrow RR–SS as guided by the interior surface of the car body 906 at portions where the abutment section 909*a* contacts as fitted in the car body. The engageable shaft 909*b* has one end secured to the rear end surface of the abutment section 909*a* and the other end fitted in the guide barrel 909*d*, which will be described later. The engageable shaft 909*b* includes a depression 909*e* formed generally at the center thereof which is engaged with the lowermost apex of the wheel stopper 908*a*. It is to be noted that the engageable shaft 909*b* and abutment section 909*a* may be integrally formed.

The guide barrel 909*d* is formed by a member and the bottom surface of the car body 906 and shaped like a cylinder opening at on end thereof and closed at the other end thereof. The guide barrel 909*d* is secured to the bottom of the car body 906 concentrically with the engaging shaft 909*b*. As described above, the guide barrel 909*d* fittingly receives the other end of the engageable shaft 909*b* so that the engageable shaft 909*b* may slide in the direction of arrow RR–SS as guided by the guide barrel 909*d*. The helical compression spring 909*c* is interposed between the closed end portion of the guide barrel 909*d* and the engageable shaft 909*b* for biasing the engageable shaft 909*b* in the direction of arrow SS. The biasing force of the helical compression spring 909*c* combines with that of the helical torsion spring 908*b* to bias the wheel stopper in the direction of arrow PP. If the helical compression spring exerts a sufficient biasing force, the helical torsion spring 908*b* is not necessary.

As seen in FIG.49, the second track 904 comprises a pier-like structure disposed on an extension line of the first track 903, the top surface of which defines a traveling surface 904*a*. The traveling surface 904*b* is provided with ridges on opposite sides thereof. The rear end surface of the second track 904 provides for the halting mechanism 905.

It is preferred to provide a shock damper 910 for damping an impact of the first car 901 colliding with the halting mechanism 905. The shock damper 910 comprises a receiving shaft 910*a* having a resilient body at the distal end thereof, and a helical compression spring 910*b*. In this embodiment, a pair of the receiving shaft 910*a* and helical compression spring 910*b* is each provided at the front portion of the first car 901 and at the halting mechanism 905. A positional relationship between the abutment section 909*a* of the releasing mechanism 909 and the receiving shafts 910*a* is made such that immediately after the abutment section 909*a* abuts against halting mechanism 905, the receiving shafts on both sides come into contact with each other. It is to be noted that the receiving shaft 910*a* and helical compression spring 910*b* are not necessarily mounted to both the first car 901 and the halting mechanism 905 and may be mounted to either of them. In this manner, the impact of the aforesaid collision may be absorbed/damped by way of deformation of the helical compression spring 910*b* and the resilient body.

According to this ride, the second car 902 is first mounted on the first car 901 with a passenger seated in the seating section 902*b* of the second car 902. At this time, the abutment section 909*a* of the releasing mechanism 909 and engageable shaft 909*b* are moved in the direction of arrow SS. As associated with this, as shown in FIG. 51, the helical torsion spring 908*b* and depression 909*e* operate to maintain the wheel stopper 908*a* pivoted in the direction of arrow PP, whereby the wheel stopper 908*a* prohibits the second car 902 from moving forward. On the other hand, the rear wall 906*c* of the car body 906 prohibits the second car 902 from moving backward. Thus, the second car 902 is prohibited from moving forward or backward by the wheel stoppers 908*a* and the rear wall 906*c*. In addition, the ridges 906*b* of the car body 906 prevents the second car 902 from moving laterally to fall off the car body 906.

Figure 52:
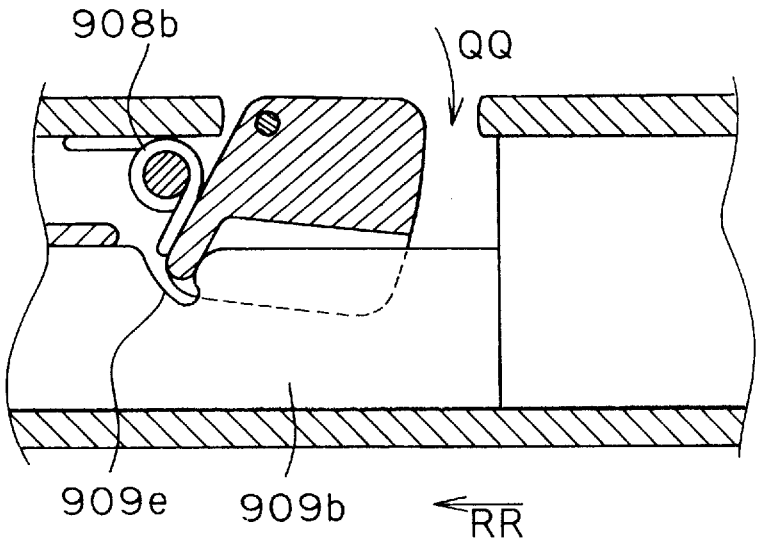
FIG.52 is a sectional view for illustrating the locking mechanism and release mechanism of the amusement ride of the fourteenth embodiment.

In this state, the first car 901 travels on the first track 903 at a predetermined speed. At the halting mechanism 905, the first car 901 collides therewith. In the collision, the abutment section 909*a* of the releasing mechanism 909 first abuts against the halting mechanism 905 whereby the abutment section 909*a* and engageable shaft 909*b* of the releasing mechanism 909 are moved in the direction of arrow RR as shown in FIG. 52. This causes the wheel stopper 908*a* engaged with the depression 909*e* to rotate in the direction of arrow QQ to thereby assume a position shown in FIG.52. More specifically, the surface of the wheel stopper 908*a* for locking the second car 902 becomes substantially flush with the mounting surface 906*a*.

This releases the second car 902 for forward movement, whereby the second car 902 is released forward by inertia preserving its kinetic energy before the collision and second car 902 transfers onto the second track 904, continuing to travel on the second track 904. Incidentally, the safety of the passenger Y is ensured by the seat belt 902*d*.

In the first car 901, on the other hand, after the abutment section 909*a* of the releasing mechanism 909 abuts against the halting mechanism 905, the receiving shafts 910*a* of the shock dampers 910 on both sides come into contact with each other thereby damping an impact of the collision by means of the resilient bodies and helical compression springs 910*b* of the receiving shafts 910*a*. Accordingly, the first car 901 receives a very small impact as it collides with the halting mechanism 901.

According to this ride, as described above, the passenger may experience the mixed thrills of a feeling of speed while riding on the first car 901, and fear and stress caused by the first car 901 colliding with the halting mechanism 905. Additionally, the passenger may enjoy an unprecedented, unique, very amusing ride wherein the second car 902 carrying the passenger transfers from the first track 903 onto the second track 904.

Now referring to FIG. 53, description will be given of a fifteenth embodiment of the present invention.

As seen in the figure, a ride of this embodiment has the same construction as the fourteenth embodiment except for a part of the structure of the locking mechanism 908 and releasing mechanism 909, and therefore, the detailed description of similar portions will be omitted.

Figure 53:
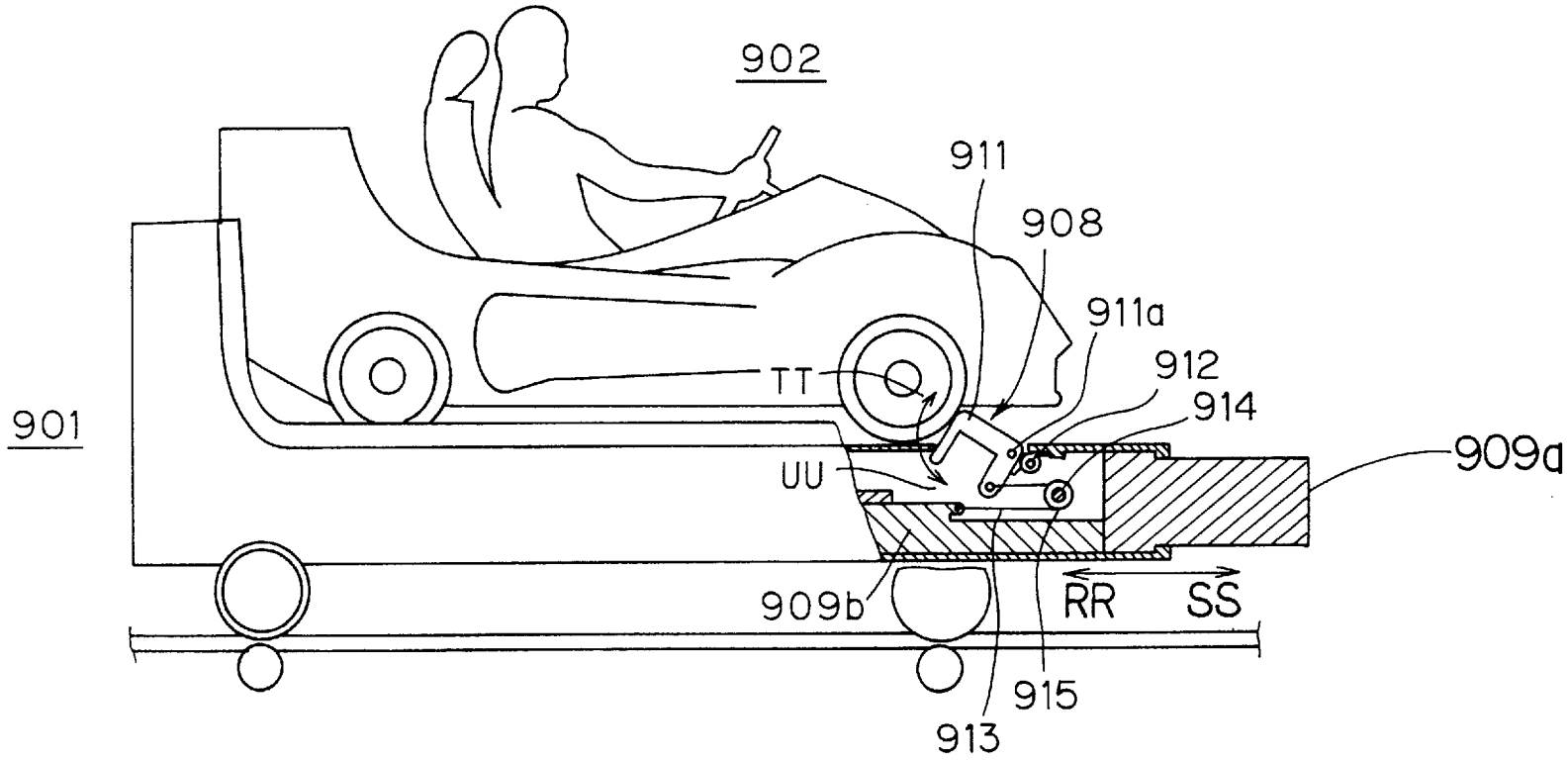
FIG.53 is a side view partly in section for illustrating an amusement ride according to a fifteenth embodiment of the invention.

The locking mechanism 908 comprises a wheel stopper 911 and a helical torsion spring 912, as shown in FIG.53. The wheel stopper 908 comprises, as illustrated by the figure, a member having a U-shaped sectional form which is supported by a support shaft 911*a* so as to be able to pivot in the direction of arrow TT–UU. The helical torsion spring 912 is secured to the interior surface of the car body 906 for biasing the wheel stopper 911 in the direction of arrow TT. In a normal state, as shown in the figure, the wheel stopper 911 has one end portion thereof caught on the edge of a hole in the car body 906 and thus is prohibited from turning in the direction of arrow TT. In this manner, the wheel stopper prohibits the second car 902 from moving forward.

As seen in FIG.53, the releasing mechanism 909 has a different construction from the fourteenth embodiment, wherein instead of being directly engaged, the wheel stopper 911 and engageable shaft 909*b* are in an indirect engagement relation by means of a wire rope 913. More specifically, the wire rope 913 is entrained about a pulley 915 with one end thereof secured to a lower end of the wheel stopper 911 and the other end thereof secured to the engageable shaft 909*b*. The pulley 915 is rotatably mounted to a support shaft 914 disposed within the car body 906.

When the first car 901 collides with the halting mechanism 905 to move the abutment section 909*a* and engageable shaft 909*b* in the direction indicated by the arrow RR, the wheel stopper 911 is turned in the direction of arrow UU by means of the wire rope 913 to thereby release the second car 902 for forward movement.

Figure 54:
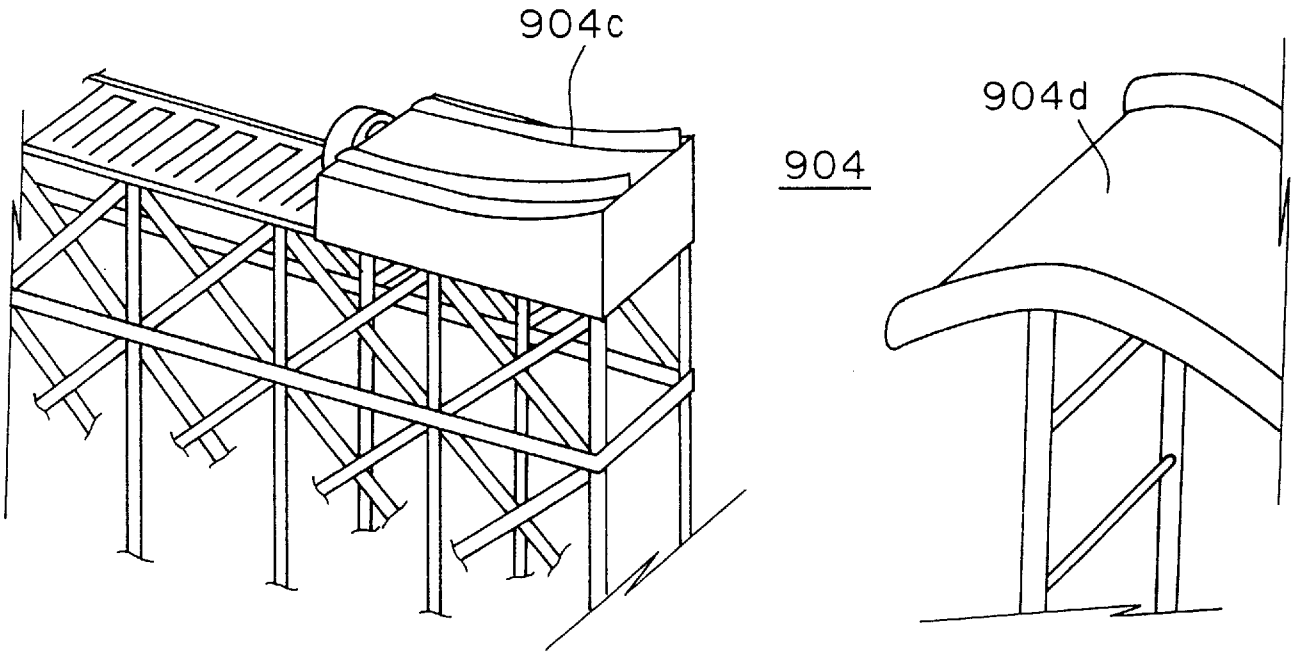
FIG.54 is a perspective view of a modification of the amusement ride of the fourteenth and fifteenth embodiments.

Additionally, the rides of the fourteenth and fifteenth embodiments may have an arrangement wherein the second track has a missing portion therein, as shown in FIG.54.

As seen in the figure, of the divided track sections of the second track 904, a track section 904*c* on the upstream side in the direction of travel of the second car 902 has a rising slope in the form of an upward curve, whereas a track section 904*d* on the downstream side is convexly curved. More specifically, the second car 902 runs through the upstream-side track section 904*c* at a predetermined speed by inertia to be released aslant upwardly therefrom and then transfers onto the downstream-side track section 904*d*. The downstream-side track section 904*d* is curved in the form of a convex on the side of the missing portion, thus allowing the second car 902 to transfer smoothly.

This offers the passenger the mixed thrills of fear and stress as the second car 902 jumps over the missing portion of the second track 904. Hence, the passengers may enjoy a ride of a further enhanced degree of amusement.

Figure 55:
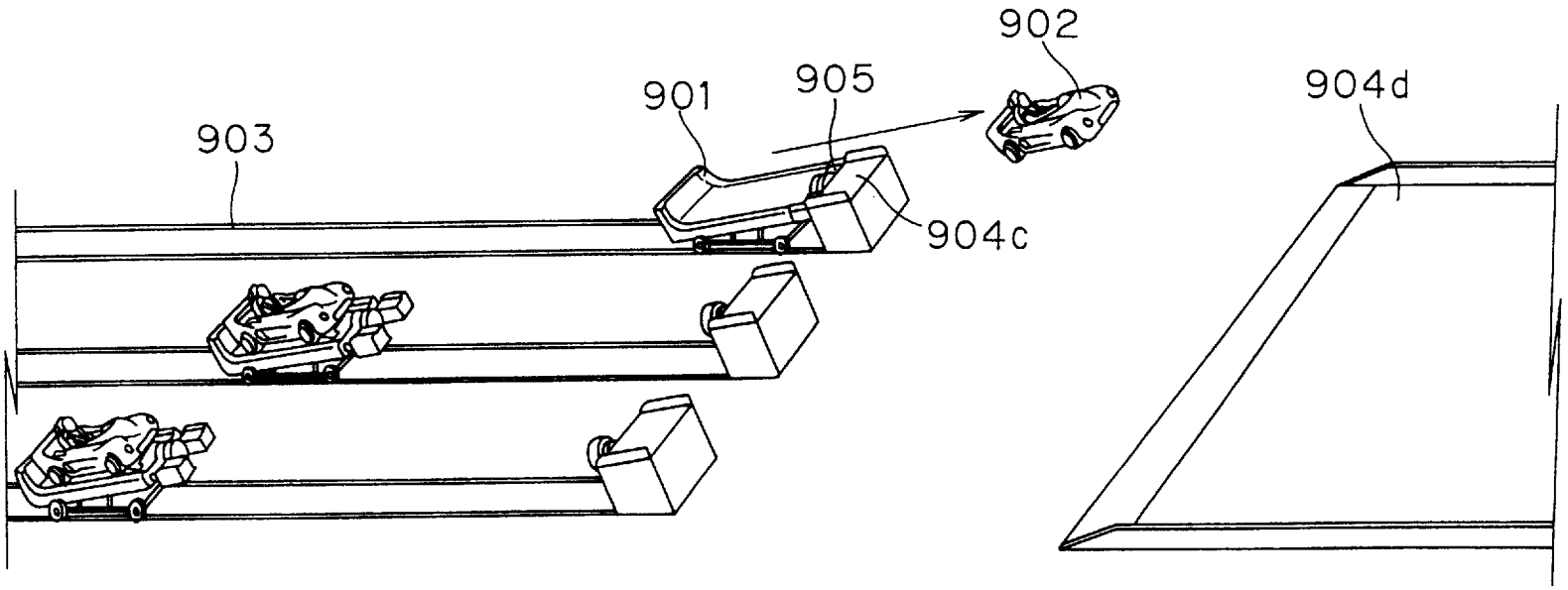
FIG.55 is a perspective view of another modification of the amusement ride of the fourteenth and fifteenth embodiments.

Alternatively, an arrangement may be made such that plural sets of the first car 901, second car 902, first track 903, second track 904 and halting mechanism 905 are provided, as shown in FIG.55. The downstream-side track section 904*d* of the second track 904 has a width greater than a total lateral width of the first tracks 903. Such an arrangement allows a plurality of passengers to enjoy the ride racing with each other and hence, the ride offers a further enhanced element of amusement.

While the present invention has been illustrated by means of certain preferred embodiments, one of ordinary skill in the art will understand that additions, deletions, substitutions and modifications can be made while still remaining within the spirit and scope of the present invention. The scope of the present invention is determined solely by the appended claims.

What is claimed is:

1. An amusement ride comprising:

(a) a track;

(b) a break in the track defining a car releasing section, and a resumption of the track defining a car receiving section, wherein the break and the resumption define a missing portion of the track;

(c) a passenger car for traveling on the track, including (1) a car body, (2) a running wheel assembly connected to the car body, constructed to engage the track, to release the track at the car releasing section and to reengage the track at the car receiving section, and (3) a coasting wheel assembly connected to the car body; and (d) a guide section for receiving the passenger car moving from the car releasing section and guiding the car to the car receiving section, including (1) a receiving plate disposed at least partly in said missing portion providing a surface for said coasting assembly to coast, and (2) guide rollers constructed to engage said car body and guide said running wheel assembly onto said car receiving section.

2. An amusement ride as defined in claim 1, wherein said guide rollers are arranged to define a gradually narrowing space in the direction of the car receiving section.

3. An amusement ride as defined in claim 1, wherein the track comprises rails, said rails being tapered at the car releasing section and the car receiving section to facilitate releasing and re-engaging of the running wheel assembly, respectively.

4. An amusement ride as defined in claim 1, wherein said guide section is movable from a first position out of view of passengers in said car, to a second position for guiding the passenger car over the missing portion.

* * * * *